US012059118B2

(12) United States Patent
Mathias et al.

(10) Patent No.: US 12,059,118 B2
(45) Date of Patent: Aug. 13, 2024

(54) LOW COST CLEANING HEAD FOR CLEANING DEVICES

(71) Applicant: SharkNinja Operating LLC, Needham, MA (US)

(72) Inventors: Richard Mathias, Needham, MA (US); Brandon J. Suleski, Cambridge, MA (US)

(73) Assignee: SharkNinja Operating, LLC, Needham, MA (US)

( * ) Notice: Subject to any disclaimer, the term of this patent is extended or adjusted under 35 U.S.C. 154(b) by 34 days.

(21) Appl. No.: 17/653,558

(22) Filed: Mar. 4, 2022

(65) Prior Publication Data

US 2022/0280013 A1 Sep. 8, 2022

Related U.S. Application Data

(60) Provisional application No. 63/238,579, filed on Aug. 30, 2021, provisional application No. 63/234,204, filed on Aug. 17, 2021, provisional application No. 63/156,901, filed on Mar. 4, 2021.

(51) Int. Cl.

| | |
|---|---|
| ***A47L 9/06*** | (2006.01) |
| ***A47L 5/28*** | (2006.01) |
| ***A47L 7/00*** | (2006.01) |
| ***A47L 9/14*** | (2006.01) |
| ***A47L 13/16*** | (2006.01) |
| ***A47L 13/20*** | (2006.01) |

(52) U.S. Cl.

CPC ..... *A47L 9/0673* (2013.01); *A47L 5/28* (2013.01); *A47L 7/0009* (2013.01); *A47L 9/14* (2013.01); *A47L 13/16* (2013.01); *A47L 13/20* (2013.01)

(58) Field of Classification Search

CPC ..... A47L 13/16; A47L 13/20; A47L 7/0004; A47L 7/0009; A47L 7/0014; A47L 9/0673; A47L 13/258

USPC ..... 15/288

See application file for complete search history.

(56) References Cited

U.S. PATENT DOCUMENTS

| | | | | |
|---|---|---|---|---|
| 11,800,962 | B2 * | 10/2023 | Zorzo | A47L 13/256 |
| 2021/0045601 | A1 | 2/2021 | Douglas et al. | |

FOREIGN PATENT DOCUMENTS

| | | | | |
|---|---|---|---|---|
| DE | 29822052 | U1 * | 2/1999 | A47L 11/34 |
| EP | 2215947 | A2 | 8/2010 | |
| JP | 2008188375 | A | 8/2008 | |

OTHER PUBLICATIONS

DE-29822052-U1 translation (Year: 1999).*

(Continued)

*Primary Examiner* — Abbie E Quann

(74) *Attorney, Agent, or Firm* — Mintz, Levin, Cohn, Ferris, Glovsky and Popeo, P.C.

(57) ABSTRACT

A cleaning head is provided having a support structure having a front edge. A foldable portion is coupled to the support structure at least partially along the front edge. A receptacle is connected to the foldable portion and defining a chamber therein. A suction inlet is arranged within the foldable portion for allowing debris to flow into the chamber. A cleaning pad is positioned underneath the support structure. An attachment tab extends from a rear edge of the cleaning pad.

19 Claims, 41 Drawing Sheets

(56) References Cited

OTHER PUBLICATIONS

International Search Report and Written Opinion received for PCT Application No. PCT/US2022/070971, dated Jun. 22, 2022, 13 pages.
U.S. Appl. No. 17/653,557, filed Mar. 4, 2022, Low Cost Cleaning Devices.

* cited by examiner

LOW COST CLEANING HEAD FOR CLEANING DEVICES

CROSS-REFERENCE TO RELATED APPLICATIONS

The present application claims priority under 35 U.S.C. § 119(e) to U.S. Provisional Patent Application No. 63/156,901 filed on Mar. 4, 2021, U.S. Provisional Patent Application No. 63/234,204 filed on Aug. 17, 2021, and U.S. Provisional Patent Application No. 63/238,579 filed on Aug. 30, 2021, the entire contents of which are hereby expressly incorporated by reference herein.

FIELD

The present application generally relates to cleaning devices, connectors, and cleaning heads for use with a cleaning device.

BACKGROUND

Cleaning devices are used in the home and office to clean floors and other surfaces. Various types of cleaning devices are known, such as vacuum cleaners and mops, which use a removable component such as a cleaning pad or the like that are removably attached to the base of the device.

Cleaning a surface, such as a hard floor or carpeted surface, can be challenging when there are a variety of different types of debris and spills, such as wet, dry, or mixed media spills. Cleaning devices are often suited for cleaning wet or dry debris, but not for cleaning both. As such, users typically need to use multiple cleaning devices to clean their floors. For example, the user may use a broom and/or vacuum cleaner to remove dry debris and then use a mop to clean up wet spills and/or to remove stains. In some instances, even with debris that is of the same type, a user may need to use multiple cleaning devices. For example, a vacuum may be successful at picking up large particles but may not capture smaller dust particles, and thus a mop may be needed. Using multiple cleaning devices can be time consuming. For example, not only may the user need to use multiple cleaning devices, the user may need to use the same cleaning device more than once to fully clean the floor. For example, a user may need to sweep and/or vacuum the floor before mopping and then again after mopping, such as to pick up debris that was not removed from the surface prior to mopping or to pick up dirt or debris that was formed during mopping.

Using multiple cleaning devices can also be messy and/or can require long setup time or after-use maintenance. For example, in some instances, the user may prefer to use a broom instead of a vacuum because of the readiness of the broom as compared to the time to set up the vacuum cleaner. With the broom, a user will sweep up and dispose of the dirt particles. Vacuums may require the user to either remove a bag from within the vacuum or repeatedly empty a dirt cup. Some cleaning devices have attempted to handle both wet and dry media, but some of these devices can have higher-set up times than using a broom and then a mop to clean a floor. Additionally, the after-use maintenance can be high for such devices, especially when cleaning liquids are involved. For example, some combination tools can become unsanitary or develop an odor if not properly cleaned after each use.

SUMMARY

Cleaning devices and removable cleaning heads for use therewith are provided.

In one embodiment, a cleaning device connector is provided having a connector housing with a front wall, a rear wall, a bottom surface, and a top surface. A cavity is arranged within the bottom surface of the housing. A bracket is arranged within the cavity of the housing. A pin extends from the rear wall of the housing. A release button is positioned on the housing and configured to move the bracket and the pin from a first position to a second position.

The housing can have a variety of configurations. For example, in some embodiments, the housing can include at least one projection disposed within the cavity. The bracket can include at least one bore aligned with the at least one projection. In some embodiments, the at least one projection can be configured to be positioned within the at least one bore when the bracket is in the second position. In other embodiments, the housing can include a securement tab configured to lock the bracket in the second position. The securement tab can be configured to release the bracket from the second position in response to insertion of a cleaning head into the cavity.

In some embodiments, a linkage assembly can be arranged within the housing, where the linkage assembly includes a front arm connected to the release button and the bracket, and a rear arm connected to the release button and the pin. In other embodiments, the front and rear arms can be pivotally connected to the housing.

In some embodiments, the actuation of the release button can be configured to simultaneously move the bracket and the pin from the first position to the second position.

In some embodiments, the pin can be partially retracted within the housing in the second position.

In some embodiments, the bracket can be configured to slide longitudinally within the cavity between the first position and the second position.

In another embodiment, a cleaning device assembly is provided that includes a cleaning device and a cleaning head. The cleaning device includes a body having a proximal end and a distal end, a vacuum source positioned within the body, a handle coupled the proximal end of the body, and a connector housing is coupled to the distal end of the body. The connector housing includes a front wall, a rear wall, a bottom surface, and a top surface. A cavity is arranged within the bottom surface of the housing. A bracket can be arranged within the cavity of the housing, and a pin can extend from the rear wall of the housing. A release button can be positioned on the connector housing and it can be configured to move the bracket and the pin to move the bracket and the pin from a first position to a second position. The cleaning head is removably attached to the connector housing of the cleaning device. The cleaning head can have a foldable portion configured to connect to the bracket of the connector housing, an attachment tab configured to connect to the pin of the connector housing, and a cleaning pad.

The cleaning head can have a variety of configurations for allowing the cleaning head to be removably attached to the connector housing on the cleaning device. For example, in some embodiments, the foldable portion of the cleaning head can be configured to be secured between the bracket of the connector housing and an internal surface of the cavity. In other embodiments, a receptacle defining a dirt collection chamber can be arranged within the cavity of the cleaning head.

In other embodiments, the vacuum source can be configured to apply a suction force to the dirt collection chamber.

In some embodiments, a linkage assembly can be arranged within the housing, and the linkage assembly having a front arm connected to the release button and the bracket, and a rear arm connected to the release button and the pin. In other embodiments, the pin of the connector housing can be arranged within a through-bore of the attachment tab.

In another embodiment, a method of detaching a cleaning head to a cleaning device includes actuating a release button positioned on a connector housing of a cleaning device to cause a bracket within the connector housing to move from a closed position to an open position, and to cause a pin within the connector housing to move from an extended position to a retracted position, such that a cleaning head engaged by the bracket and pin are released from the connector housing.

In another embodiment, a cleaning head is provided that includes a support structure having a front edge. A foldable portion is coupled to the support structure at least partially along the front edge. A receptacle is connected to the foldable portion and defining a chamber therein. A suction inlet is arranged within the foldable portion for allowing debris to flow into the chamber. A cleaning pad is positioned underneath the support structure. An attachment tab extends from a rear edge of the cleaning pad.

In some embodiments, the receptacle can be partially formed from an air permeable filter configured to allow a suction force to be applied therethrough and through the suction inlet while retaining debris within the chamber. In other embodiments, the receptacle can be configured to expand when a suction force is applied to the chamber.

In some embodiments, a valve can be arranged within the receptacle and can be movable relative to the suction inlet in response to a suction force applied to the chamber. The valve can be arranged to allow debris to enter the chamber while limiting debris from exiting the chamber.

The foldable portion can have a variety of configurations. For example, in some embodiments, the front edge of the support structure can form a living hinge with the foldable portion. In other embodiments, the foldable portion can be configured to move from a first position substantially parallel to the cleaning pad, to a second position substantially perpendicular to the cleaning pad. In some embodiments, the foldable portion can include apertures formed in opposite sides of the suction inlet.

The attachment tab can also have a variety of configurations. For example, in some embodiments, the attachment tab can include an aperture formed therethrough. In other embodiments, the attachment tab can be configured to move from a first position substantially parallel to the cleaning pad, to a second position substantially perpendicular to the cleaning pad.

In some embodiments, a total area of the support structure can be less than a total area of the cleaning pad.

In another embodiment, a cleaning device is provided that includes a body having a proximal end and a distal end. A vacuum source is positioned within the body, a handle is coupled to the proximal end of the body, and a connector housing coupled to the distal end of the body. The connector housing having a cavity formed in a bottom surface of the connector housing, and a pin extending from a rear wall of the connector housing. A cleaning head can be configured to removably attach to the connector housing. The cleaning head can include a support structure including a front edge, and a foldable portion coupled to the support structure at least partially along the front edge. The foldable portion can be configured to extend into the cavity. A receptacle can be connected to the foldable portion and define a cavity, and a suction inlet can be arranged within the foldable portion for allowing debris to flow into the chamber. A cleaning pad can be positioned underneath the support structure, and an attachment tab can extend from a rear edge of the cleaning pad and can be configured to connect with the pin of the connector housing.

The removable connection between the connector housing and the cleaning head can have a variety of configurations. For example, in some embodiments, the pin can be configured to extend through an aperture formed in the attachment tab. In other embodiments, the pin can be configured to retract within the connector housing to remove the pin from the aperture of the attachment tab. In some embodiments, the foldable portion can include apertures arranged on opposed sides of the suction inlet, and each aperture can be configured to align with a protrusion formed in the cavity to connect the cleaning head to the connector housing. In certain embodiments, the foldable portion and the support structure can be configured to contact a gasket arranged within the bottom surface of the connector housing.

The connector housing can also have a variety of configurations. For example, in some embodiments, the connector housing can include a moveable bracket which is configured to clamp the foldable portion between an internal wall and the bracket. In other embodiments, the bracket can be configured to move away from the internal wall to release the foldable portion from the connector housing. In certain embodiments, the receptacle can be configured to expand within the cavity when a suction force is applied to the cavity. In other embodiments, the bottom surface of the connector housing can be configured to contact the cleaning pad when the cleaning head is connected to the connector housing.

In another embodiment, a method of connecting a cleaning head to a cleaning device is provided and includes moving a foldable portion of a cleaning head positioned along a front edge of a support structure from a first position to a second position, moving an attachment tab positioned along a rear edge of a cleaning pad arranged underneath the support structure from a first position to a second position, and to position the attachment tab on a pin of a connector housing on a cleaning device, positioning the foldable portion within a cavity of the connector housing, and actuating a clamping mechanism on the connector housing to cause the foldable portion to be clamped between a moveable bracket and an internal wall of the cavity.

BRIEF DESCRIPTION OF THE DRAWINGS

These and other features will be more readily understood from the following detailed description taken in conjunction with the accompanying drawings, in which.

It is noted that the drawings are not necessarily to scale. The drawings are intended to depict only typical aspects of the subject matter disclosed herein, and therefore should not be considered as limiting the scope of the disclosure.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

In general, cleaning devices and removable cleaning heads are provided. In an exemplary embodiment, a cleaning device is provided having a connector housing configured to removably engage a cleaning head. The cleaning head can include a support structure configured to attach to the connector housing on the cleaning device. A receptacle defining a dirt collection chamber and a cleaning pad for cleaning a surface can both be coupled to the support structure. The entire cleaning head can have a configuration that reduces manufacturing costs, and that allows the cleaning head to be discarded after use. In certain embodiments, the support structure can be formed from a low cost material, such as cardboard, and it can have a generally planar configuration providing a relatively low profile for packaging and shipping. The support structure can be configured to unfold or otherwise expand to facilitate attachment to a cleaning device. The receptacle can be formed from a low cost material as well, such as a fabric material that defines a chamber therein for collecting debris, but that also functions as an air filter to prevent debris from being drawn into the cleaning device. The cleaning pad can be mated to the bottom surface of the support structure for cleaning a floor surface.

Figure 1:
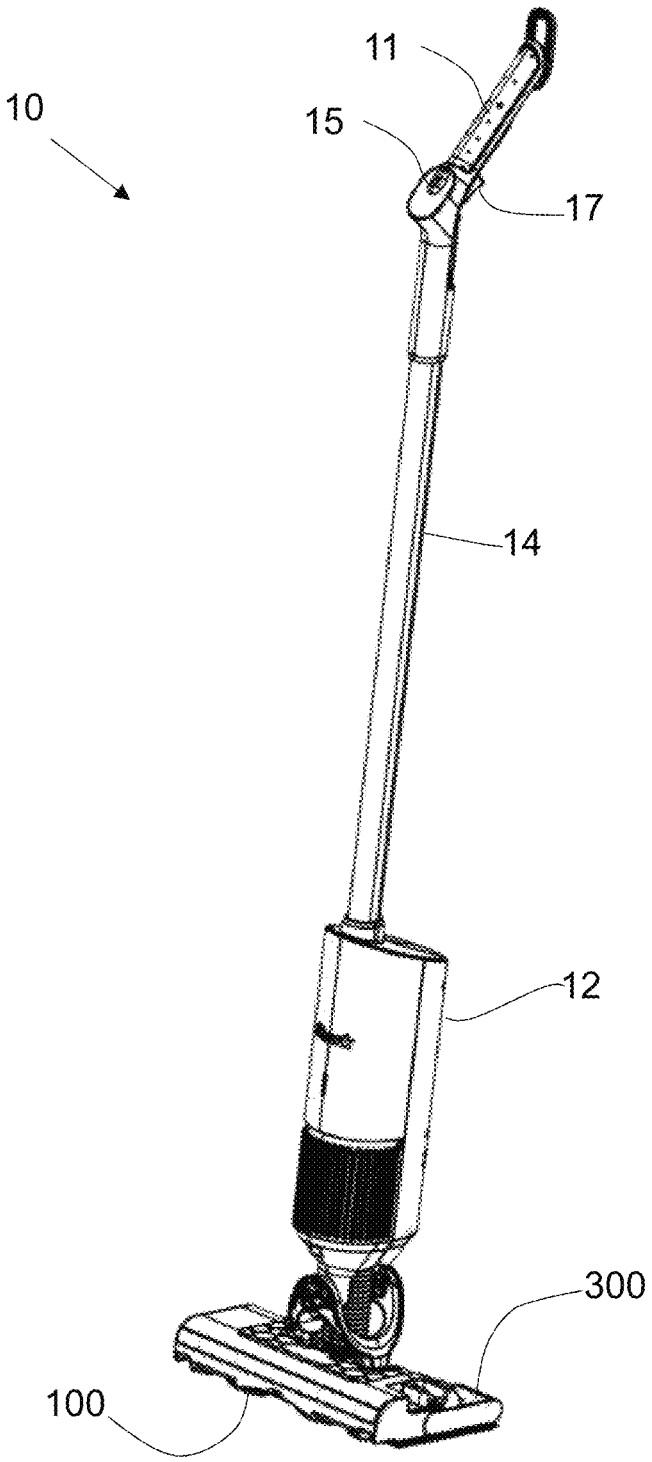
FIG. 1 is a front perspective view of one embodiment of a cleaning device having a cleaning head removably coupled thereto.

FIG. 1 illustrates one embodiment of a cleaning device 10. As shown, the cleaning device 10 generally includes a body 12 having a handle 14 coupled to a proximal end thereof, and a connector housing 300 coupled to a distal end thereof. A cleaning head 100 is removably mated to the connector housing 300. The body 12 can include various features to facilitate operation of the device, such as a fluid reservoir (not shown) which can store and dispense a cleaning fluid on a surface to be cleaned, and a motor and vacuum source (not shown) configured to apply a suction force through the connector housing 300 and cleaning head 100. The handle 11 can be coupled to the body 12 for manipulating the device. For example, an elongate shaft 14 can extend proximally from the body 12, and a handle 11 can be formed on the proximal end of the elongate shaft 14. The shaft 14 can have a length that is adjustable to allow a user to adjust the height of the cleaning device. For example, the shaft 14 may be telescoping to increase or decrease the length of the shaft. Additionally, in some embodiments, the handle 11 may include switches 15 and 17 arranged thereon. Switch 15 can have any configuration, such as a rocker switch configured to control to output of a cleaning fluid from the body 12 or connector housing 300. In one exemplary embodiment, the switch 15 can control two different output modes for the cleaning fluid, including a burst spray and a continuous spray. In said embodiment, the burst spray may consist of separate pulses of cleaning fluid or delivery of a greater volume of cleaning fluid. Additionally, switch 17 can be used to activate the vacuum source to apply a suction force through the connector housing 300 and cleaning head 100. A person skilled in the art will appreciate that the cleaning device can have a variety of other configurations and can include various features, and that the illustrated cleaning device is merely one exemplary embodiment.

Figures 2A, 2B, 2C, 2D:
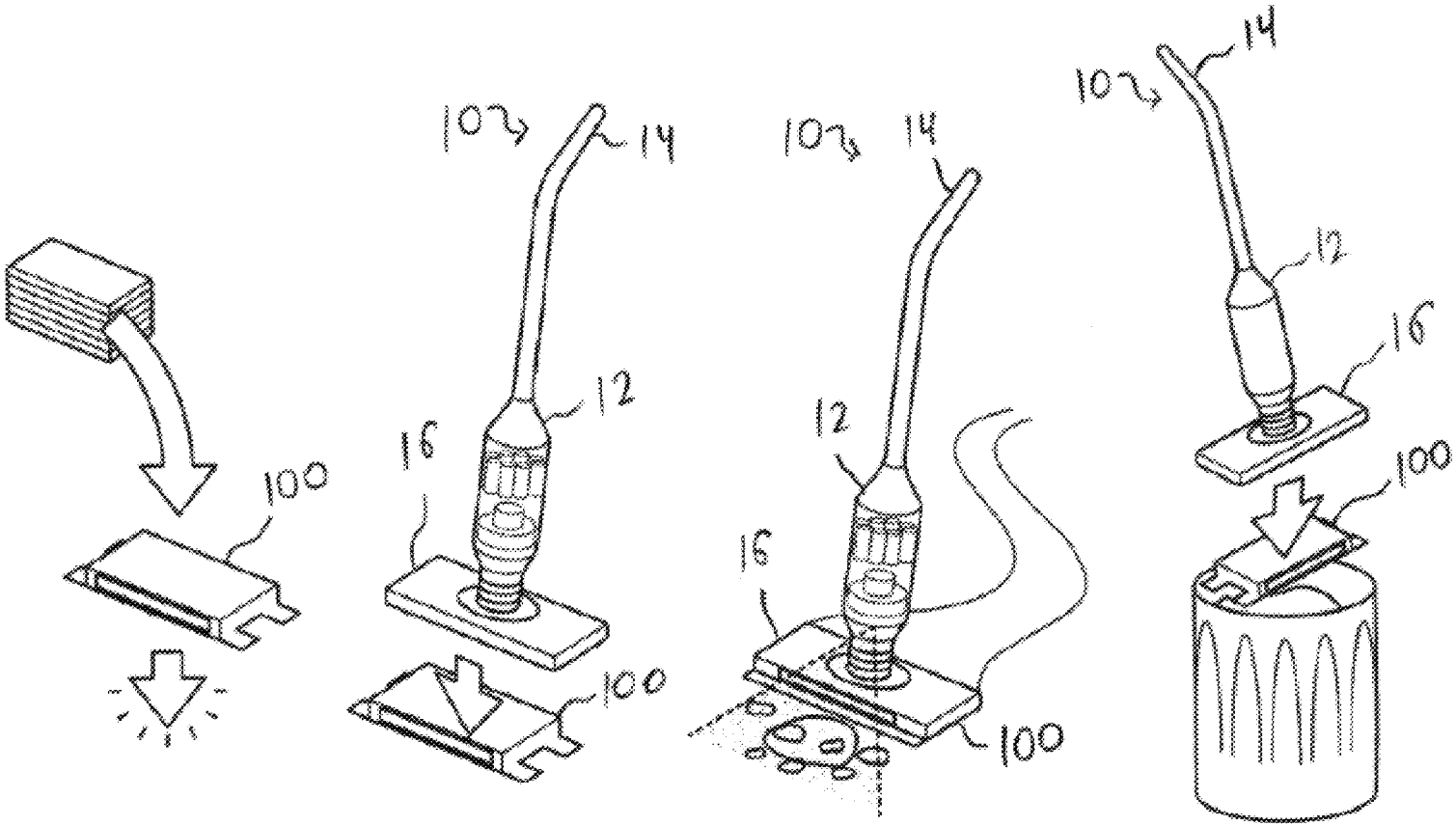
FIG. 2A is a top perspective view of a kit of cleaning heads including the cleaning head of FIG. 1, shown detached from the cleaning device.
FIG. 2B is a top perspective view of showing the cleaning device of FIG. 1 about to be attached to the cleaning head.
FIG. 2C is a top perspective view showing the cleaning device and cleaning head of FIG. 2B in use.
FIG. 2D is a top perspective view of the cleaning device and the cleaning head of FIG. 2C, showing the cleaning head detached for disposal.
Figure 3:
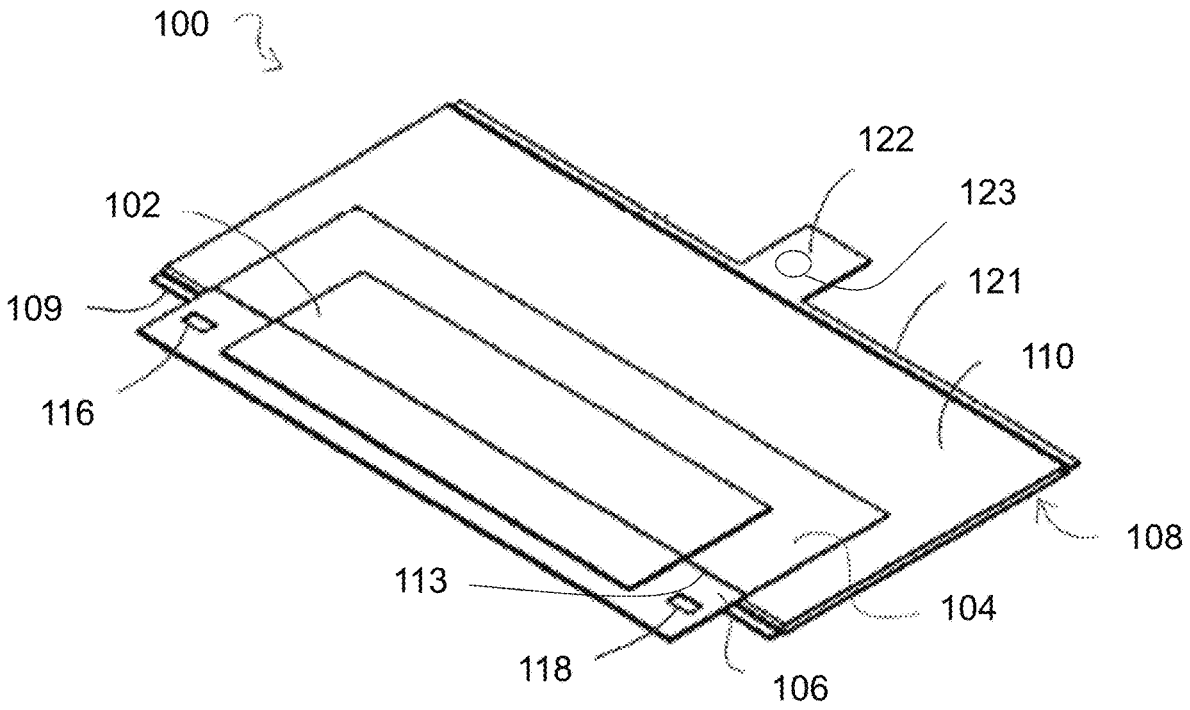
FIG. 3 is a top perspective view of the cleaning head of FIG. 1.
Figure 4:
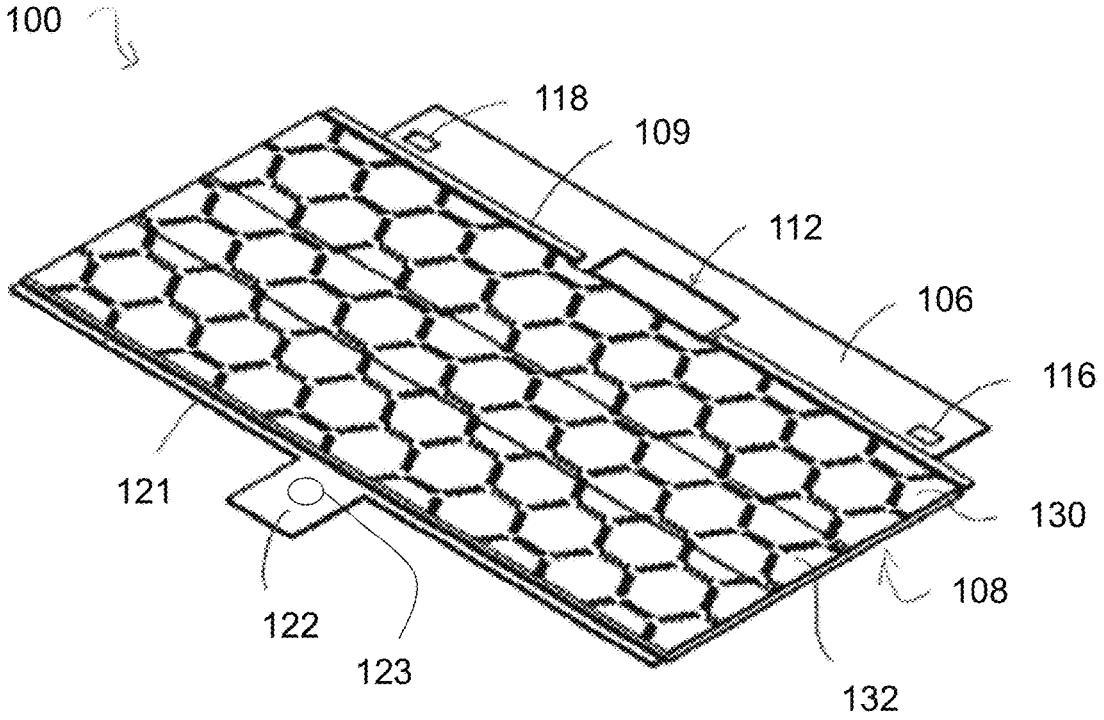
FIG. 4 is a bottom perspective view of the cleaning head of FIG. 3.

FIGS. 2A-2D illustrate a process for attaching the cleaning head 100 to the cleaning device 10. As shown in FIG. 2A, a user may select the cleaning head 100 from a kit or box of disposable cleaning heads. As shown in FIG. 2B, the user attaches the selected cleaning head 100 to the cleaning device 10. This can be achieved by positioning the cleaning head 100 on the floor, and aligning the cleaning device 10 over the cleaning 100. The cleaning device 100 can then be lowered toward the cleaning head 100 to cause a portion of the cleaning head 100 to extend into a cavity in the cleaning device 10. As will be discussed in more detail below, the cleaning device 10 can include features that engage the cleaning head 100 to mate the cleaning head to the cleaning device 10. Once attached, the cleaning device 10 can be operated, as shown in FIG. 2C, to suction dirt through a suction nozzle and into the dirt collection chamber of the cleaning head. In some embodiments, the user can activate the cleaning device 10 to apply a liquid to the surface to be cleaned, and a pad on the cleaning head 100 can be used to clean any fluid sprayed onto the surface, thereby cleaning the surface. Once cleaning is complete, the cleaning head 100 can be ejected from the cleaning device, as shown in FIG. 2D, and it can be disposed of in a trash receptacle.

The cleaning head can have various configurations which allow the cleaning head to mate to the cleaning device. Additionally, the various configurations of the cleaning head can be designed such that the cleaning head can be folded or arranged substantially flat to allow for greater shipping efficiency. The cleaning head can then be unfolded to form an internal volume with a dirt collection chamber for collecting dirt during vacuuming.

FIGS. 3-8D illustrate one embodiment of cleaning head 100 having a support structure 104, a cleaning sheet 108 coupled to a bottom surface of the support structure 104, and a receptacle 102 coupled to a top surface of the support structure 10. While the support structure can have a variety of configurations, in the illustrated embodiment the support structure 104 is in the form of a planar rectangular sheet, e.g., a cardboard or paperboard sheet, that includes a foldable portion 106, which is arranged along one side of the support structure 104. The foldable portion 106 can be defined by a fold line 113 formed in the support structure 104. The fold line 113 can be scored or pre-folded to aid in the mobility of the foldable portion 106 relative to the support structure 104. The fold line 113 can be positioned such that a length of the foldable portion as measured from a leading edge to the fold line 113 is less than a length of the remainder of the support structure 104. In use, the foldable portion 106 can be moved relative to the support structure 104 about the fold line 113, thus allowing the foldable portion 106 to extend substantially perpendicular to the support structure 104. When folded, the fold line 113 will define a leading edge of the support structure 104.

In an exemplary embodiment, the foldable portion 106 is thicker than the remainder of the support structure 104 to provide rigidity to the foldable portion 106. This can be achieved by folding a first foldable section 107*a* onto a second foldable section 107*b* about fold line 109 such that the free edge of the first foldable section 107*a* aligns with fold line 113. The two sections 107*a*, 107*b* can be permanently affixed to one another, such as by an adhesive.

A person skilled in the art will appreciate that the foldable portion 106 can be formed using a variety of other techniques, rather than being integrally formed as part of the support structure. For example, the foldable portion 106 can be a separate structure made from the same or different material as the remainder of the support structure, and it can be mated to the support structure in a manner that allows the foldable portion to move relative to the support structure. Further, in other embodiments, the foldable portion need not be foldable and instead can be positioned at a fixed angle relative to the support structure. In some embodiments, the foldable portion 106 and the support structure can be formed from 16 pt paper board with a density of 322 gsm.

Figure 5:
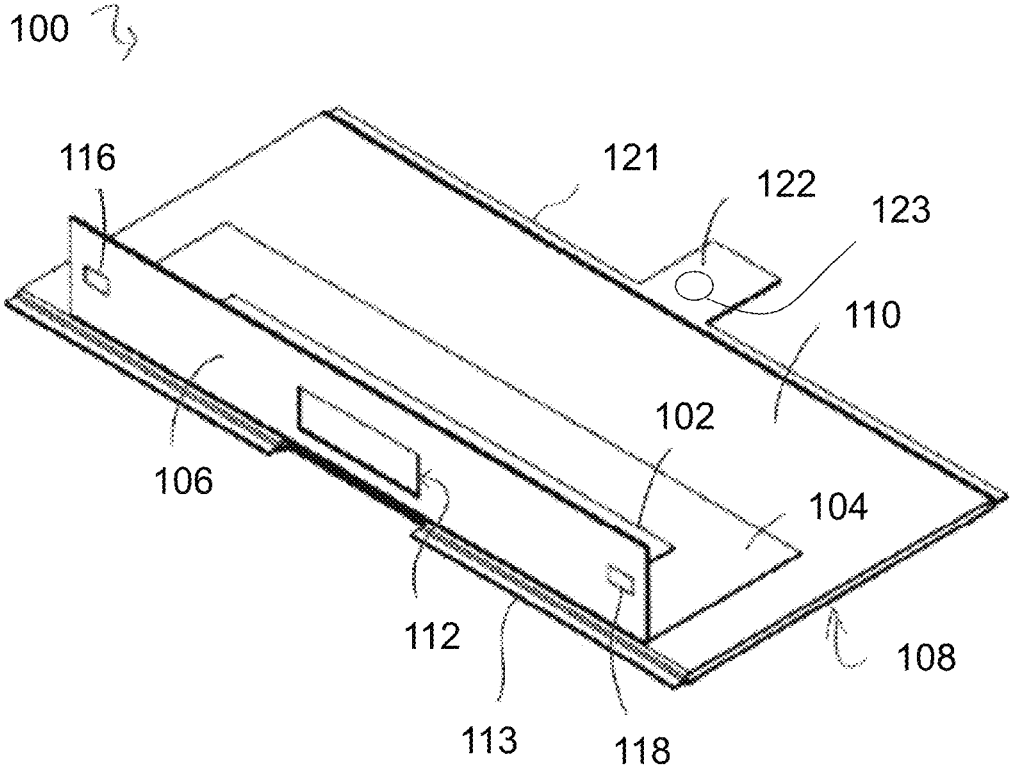
FIG. 5 is a top perspective view of the cleaning head of FIG. 3 in a folded configuration.
Figure 6A:
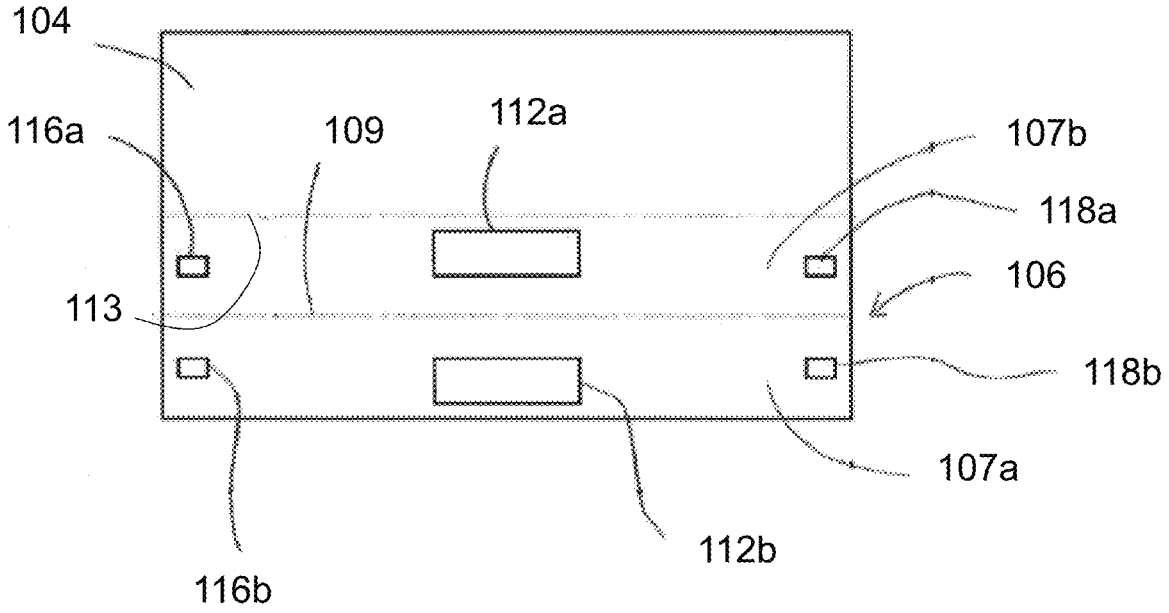
FIG. 6A is top view of an unfolded support structure of the cleaning head of FIG. 3.
Figure 6B:
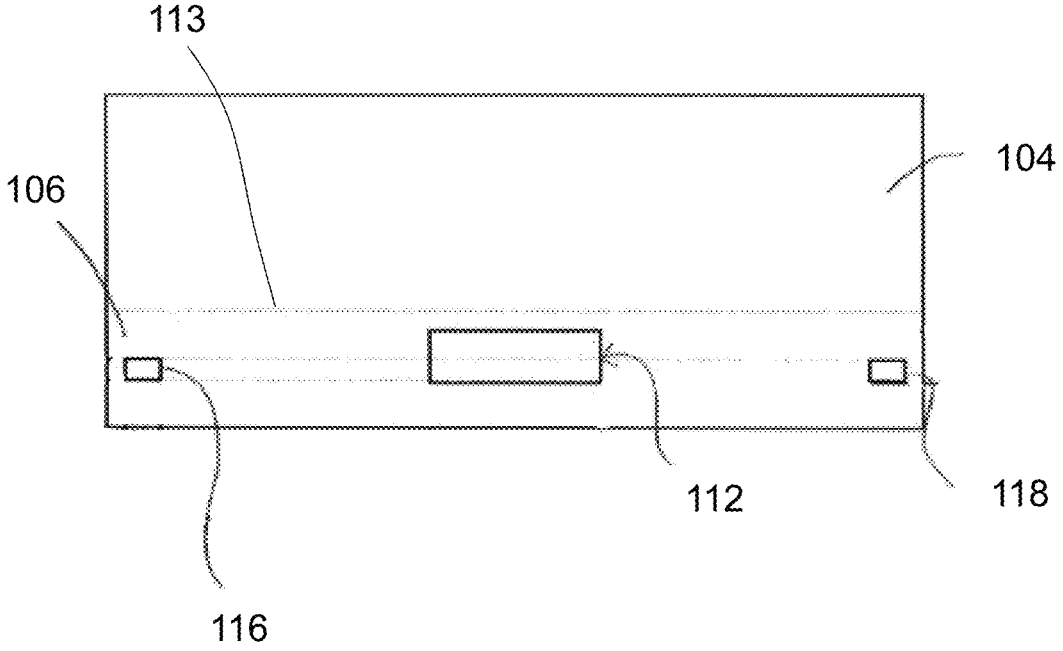
FIG. 6B is a top view of a folded support structure of the cleaning head of FIG. 6A.

As best shown in FIG. 5, the foldable portion 106 can further include two apertures 116, 118, which can be arranged on opposed sides of a receptacle 102 coupled to the support structure 104, discussed in further detail below. The apertures 116, 118 can be positioned adjacent to the sides of the support structure 104, and can each have a configuration that aids in securing the cleaning head 100 to a connector on a cleaning device when the foldable portion 106 is in a folded configuration (e.g., bent 90° relative to the polyfilm layer 110A, as will also be discussed in more detail below. The apertures 116, 118 can be formed in the foldable portion 106 after the foldable sections 107*a*, 107*b* are affixed to one another, or each foldable section 107*a*, 107*b* can include apertures 116*a*, 116*b*, 118*a*, 118*b* formed therein as shown in FIG. 6A. When the foldable sections 107*a*, 107*b* are joined together, apertures 116*a*, 118*a* will align with apertures 116*b*, 118*b*, respectively.

The foldable portion 106 can also include a suction inlet 112 formed therein, as shown in FIG. 5, for allowing debris to be suctioned into the receptacle 102. Similar to the apertures, the suction inlet 112 can be formed after the foldable sections 107*a*, 107*b* are joined, or as shown in FIG. 6A each foldable section 107*a*, 107*b* can include an aperture 112*a*, 112*b* therein that align with one another once the foldable sections 107*a*, 107*b* are joined together.

Figure 7A:
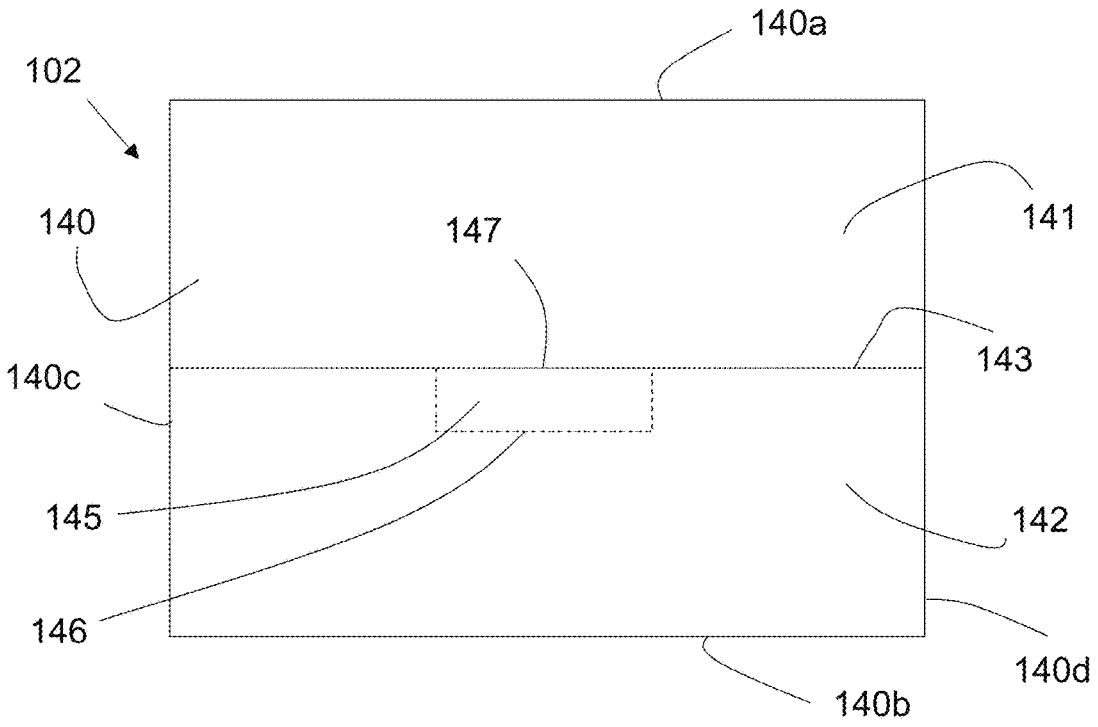
FIG. 7A is top view of an unfolded receptacle of the cleaning head of FIG. 3.
Figure 7B:
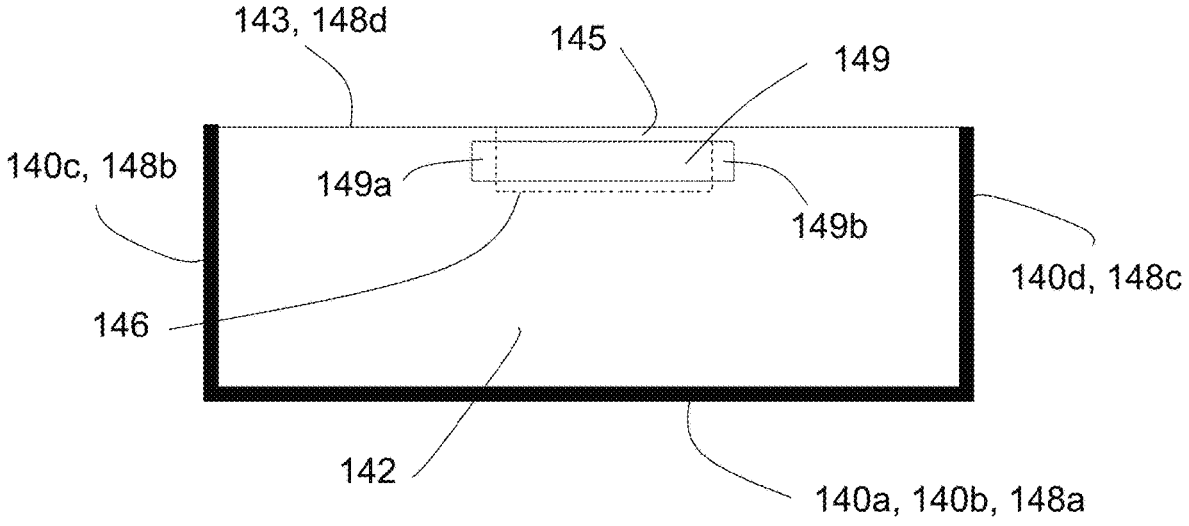
FIG. 7B is a top view of a folded receptacle of the cleaning head of FIG. 7A.

As previously indicated, the cleaning head 100 can further include a receptacle 102 that defines the dirt collection chamber for collecting debris. While the receptacle 102 can have a variety of configurations, in an exemplary embodiment, the receptacle 102 is made from a permeable material to allow a suction force to pass through the receptacle 102. For example, the permeable material of the receptacle 102 can be a 44 grams per square meter SMS (spunbond melt-blown spunbond) coated material. In some embodiments, the permeable material of the receptacle 102 may be hydrophobic. The receptacle 102 can be formed using various techniques, but as shown in FIGS. 7A and 7B, in an exemplary embodiment the receptacle 102 is formed from a substantially rectangular material 140 that is folded in half along a fold line 143. The rectangular material 140 includes tops edge 140*a*, bottom edge 140*b*, and side edges 140*c*, 140*d*, with the fold line 143 arranged substantially in the center of the rectangular material 140 and separating the rectangular material 140 into a first portion 141 and a second portion 142. In order to form the receptacle 102 from the rectangular material 140, the first portion 141 is folded onto the second portion 142 at the fold line 143. The top and bottom edges 140*a*, 140*b* can be sealed together to form a sealed edge 148*a*, and the side edges 140*c*, 140*d* can be sealed together to form sealed edges 148*b*, 148*c*, respectively. The sealed edges 148*a*, 148*b*, 148*c*, along with folded edge 148*d* formed at the folded line 143, define a dirt collection chamber within the receptacle 102.

In order for dirt and debris to be collected within the receptacle 102, an opening can be formed in the second portion 142 by cutting the material along a cut line 146. In an embodiment, the cut line 146 can be a 3-sided rectangle, with the folded edge 148*d* forming the forth side. This creates a living hinge 147 which can form a valve 145 that is configured to pivot along the fold line 143. The valve 145 can be configured to move inward to an open position to allow debris to enter into the chamber in response to a suction force applied to the chamber, and it can be configured to return to a resting substantially closed position when no suction force is applied.

In one embodiment, a backing plate 149 can be arranged on an internal surface of the valve 145, within the chamber, in order to prevent the valve 145 from moving forward out of the receptacle 102. The backing plate 149 can have a length that is greater than a length of the valve 145 such that end portions 149*a*, 149*b* of the backing plate 149 extend from opposite sides of the valve 145 beyond the cut line 146. Due to the arrangement of the end portions 149*a*, 149*b*, the valve 145 is prevent from moving away from the second portion 142, thus retaining the valve in the closed position and preventing debris from falling out the chamber when no suction force is applied.

In order to secure the receptacle 102 to the support structure 104, the receptacle 102 can be positioned on the support structure 104 and on the foldable portion 106 to align the cut line 146 in the receptacle 102 with the suction inlet 112 in the support structure 104, as shown in FIG. 5. When secured to the support structure 104, the valve 145 is likewise aligned with the suction inlet 112. The receptacle 102 can be attached to the support structure 104 using any technique, such as adhesive. In an exemplary embodiment, an adhesive layer is 103*a* applied adjacent to and around the outer edge of the cut line 146 so that the valve 145 stays aligned with the suction inlet 112 when a suction force is applied to the receptacle 102 and through the suction inlet 112. The remaining portion of the second portion 142 can be secured to the support structure 104 along a middle span of the second section 142, and/or along the sealed edges 148*a*, 148*b*, 148*c*, 148*d*.

As indicated above, the support structure 104 can also include a cleaning sheet 108 attached to the lower surface of the support structure 104, opposite the receptacle 102. In this embodiment, the cleaning sheet 108 has a length extending between leading and trailing edges that is greater than a length of the support structure 104. The support structure 104 can thus be mounted with the fold line 109 aligned with the leading edge of the cleaning sheet 108, such that the cleaning sheet 108 extends a distance behind and trails the support structure 104.

The cleaning sheet 108 can be formed multiple layers of material having various properties. In an exemplary embodiment, as shown in FIGS. 8A-8D, the cleaning sheet 108 can include in order from top to bottom a poly film layer 110A, an adhesive layer 110B, a top acquisition layer 124, an adhesive layer 125, a superabsorbent polymer (SAP) layer 126, a bottom acquisition layer 128, a face layer 130, and multi-functional strips 132, 133, and 135. In some embodiments, the acquisition layer is formed from 50-100 gsm, 70% pulp, 30% bi-component polyethylene/polypropylene (BICO). The SAP layer 126 can be formed of a 50 gsm laminate. The face layer can be formed of a 75 gsm spunbound material having 3-dimensional features embossed therein. The multi-function strip can be formed of a 40 gsm meltblown polypropylene. Additionally, poly film layer 110A can be arranged underneath the support structure 106 and can be in the form of a planar rectangular sheet. The poly film layer 110A can be secured to the support structure 106 by, for example, adhesive strips 107. In an exemplary embodiment, the poly film layer 110A is formed of a polyethylene film with a 0.0008 gauge size. The poly film layer 110A and the face layer 130 can include tabs which are used to seal the layers of the cleaning sheet 108 together using a heat sealing method and/or the adhesive layer 110B, which also include corresponding tabs.

In order to couple the support structure 104 to the poly film layer 110A, the adhesive strips 107 an be arranged between the poly film layer 110A and the support structure 104. The adhesive strips 107 can extend the width of the support structure 104, and can include a single or multiple adhesive strips. Since the support structure 104 is arranged on the forward half of the cleaning sheet 108, the adhesive strips 107 can also be arranged on the forward half of the poly film layer 110A.

Additionally, the receptacle 102 can be coupled to the support structure 104 and foldable portion 106 through the use of adhesive layers 103A and 130B. Adhesive layer 103A is arranged forward of the fold line 113, while the adhesive layer 103B is arranged rearward of the fold line 113. The adhesive layers 103A, 103B ensure that the receptacle stays secured to both the support structure 104 and the foldable portion 106 regardless of the position of the foldable portion 106 relative to the support structure 104.

The various layers of the cleaning sheet can be held together using various mating techniques, such as via adhesive layers arranged between the layers, or securement techniques such as ultrasonic welding. In some embodiments, the cleaning sheet 108 can include multiple SAP layers 126 and multiple multi-functional strips 132, 133, and 135, and each strip can be made from either the same or different materials. SAP materials generally swell when exposed to liquid. In embodiments with multiple SAP strips, said SAP strips may be placed such that they keep the surface of the cleaning sheet level when they absorb cleaning liquid. For instance, a first SAP strip positioned towards the front of the cleaning sheet and a second SAP strip positioned towards the back of the cleaning sheet. Where the multi-functional strips 132, 133, and 135 are made from different materials they can have different functions (e.g., scrubbing, polishing, disinfecting). In some embodiments, a multi-functional strip can be a scrubbing strip formed of 49 gsm material formed from 40% thermoplastic, 50% Lyosell and 10% polypropylene. The scrubbing strip may undergo heat treatment to melt some fibers and create a coarser scrubbing surface.

Figure 8A:
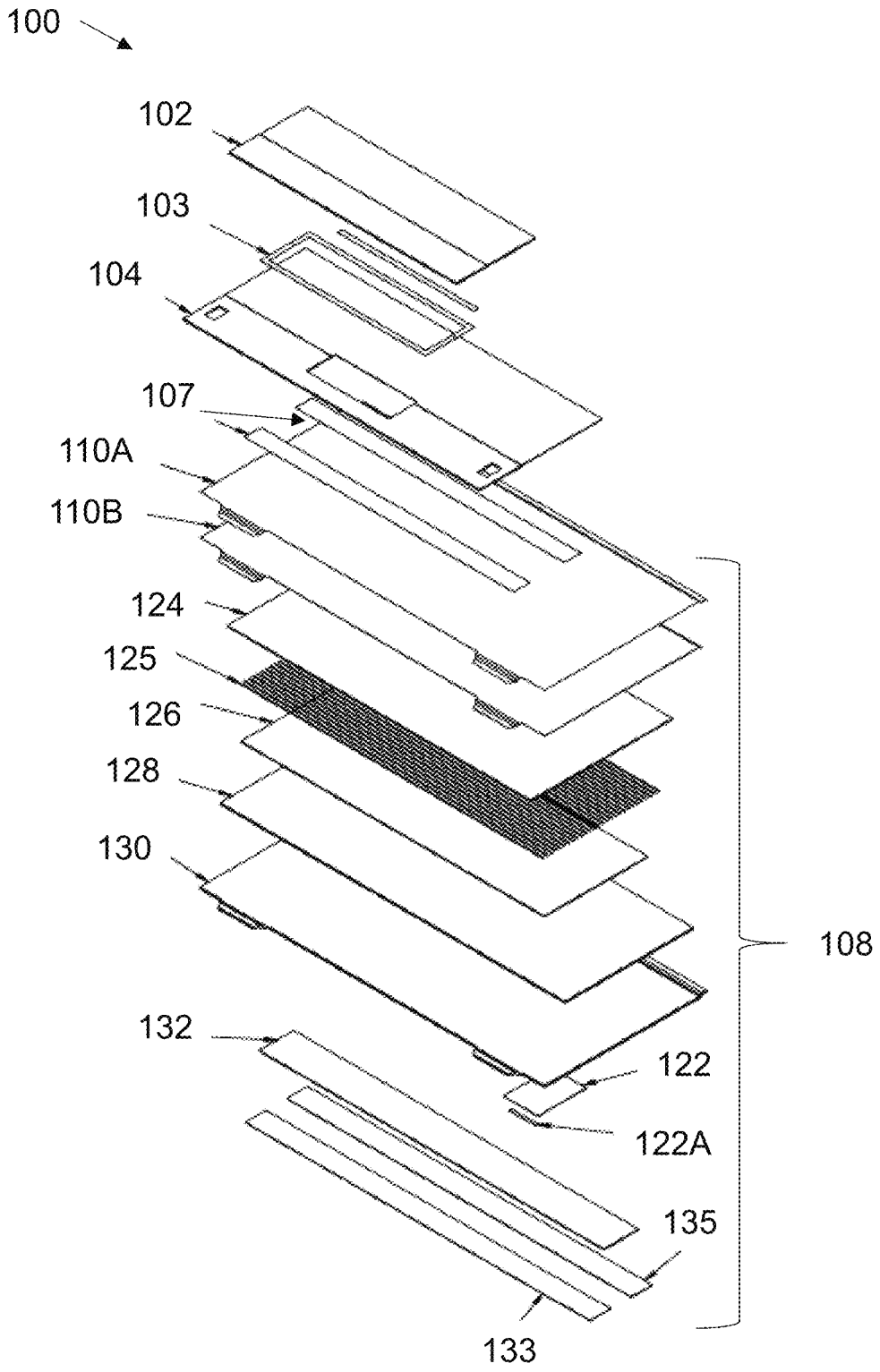
FIG. 8A is an exploded view of the cleaning head of FIG. 3.
Figure 8B:
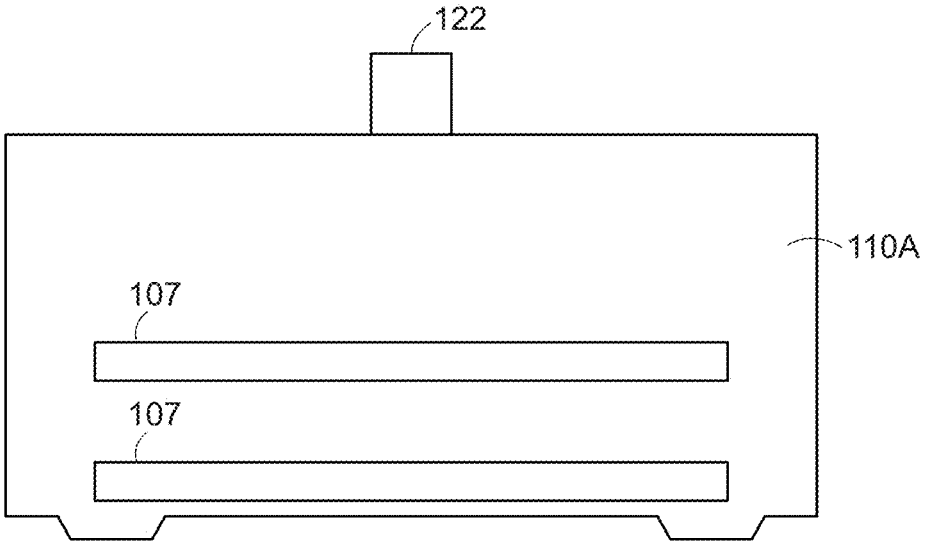
FIG. 8B is a top view of a portion of the cleaning head of FIG. 3.
Figure 8C:
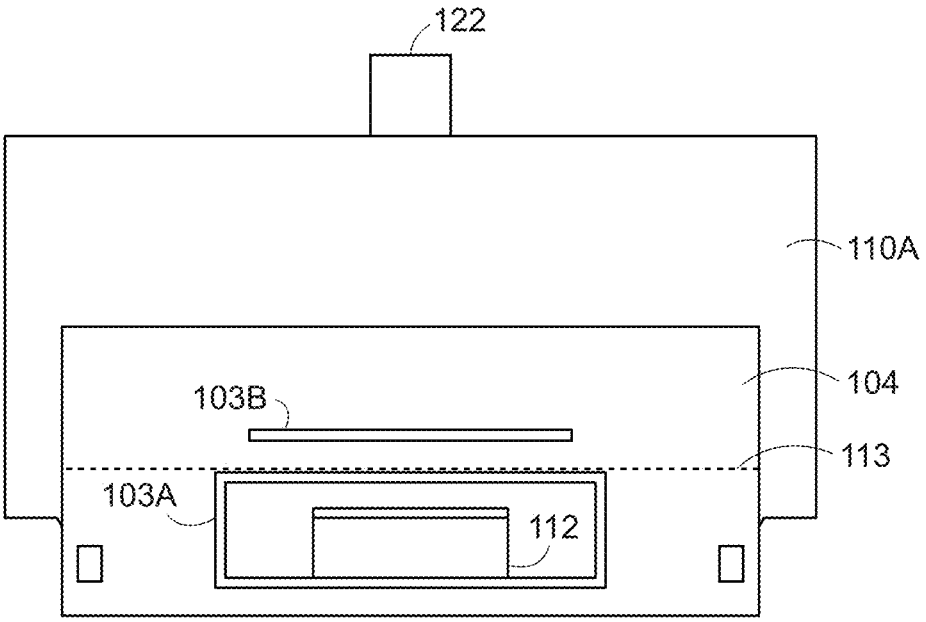
FIG. 8C is a top view of a portion of the cleaning head of FIG. 3.
Figure 8D:
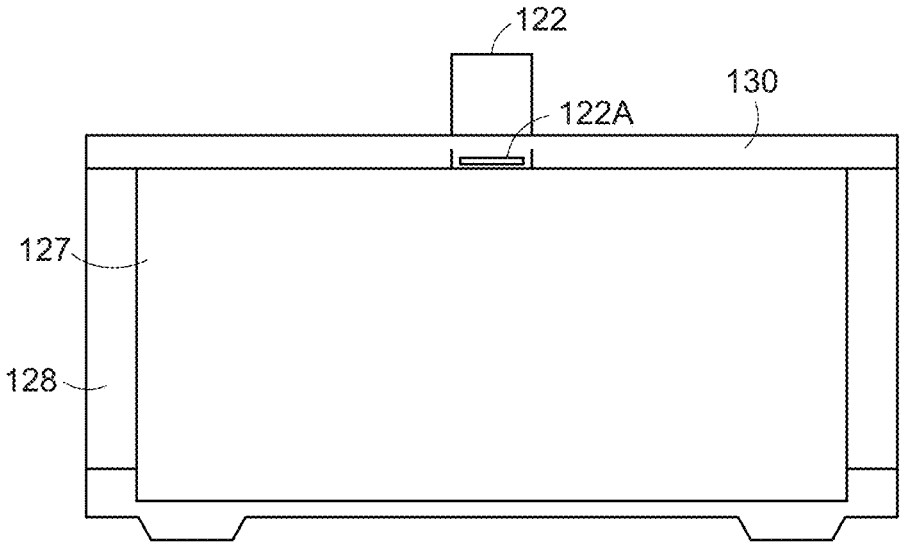
FIG. 8D is a top view of a portion the cleaning head of FIG. 3.

The cleaning head 100 can also include additional features to aid in attachment of the cleaning head 100 to a cleaning device. In the illustrated embodiment, the cleaning head includes a layer having an attachment tab 122 that extends from the trailing edge 121 of the cleaning sheet 108. In this embodiment, only a single attachment tab 122 is centered on the trailing edge 121 of the cleaning sheet 108, however the cleaning sheet 108 can include more than one attachment tab arranged on the trailing edge 121 thereof. If the cleaning sheet 108 includes more than one attachment tab, the attachment tabs can be spaced apart along the trailing edge 121. Each attachment tab 122 can include an aperture 123 formed therethrough which can be configured to receive a pin on the cleaning device to allow the tab to engage the pin and thereby aid in retaining the cleaning head 100 on the cleaning device. Alternatively, the attachment tab 122 can be secured within a slot or similar feature on the cleaning device. In certain exemplary embodiments, the attachment tab(s) 122 can be formed as part of the polyfilm layer 110A of the cleaning sheet 108. In some embodiments, the attachment tab 122 is not integrally formed with a layer of the cleaning sheet 108, but rather is a separate attachment tab 122 that is secured to the face layer 130 of the cleaning sheet 108 using an adhesive strip 122A along the trailing edge of the cleaning sheet 108, as shown in FIG. 8D. In some embodiments, the attachment tab 122 is formed from a 103 gsm Elastic Laminate material. An adhesive, welding, or other techniques can be used to secure such an attachment tab to the edge of the cleaning sheet or between separate layers of the cleaning use.

In use, when attached to a cleaning device, the receptacle 102 can be configured to be arranged within a confinement volume formed in the cleaning device, the foldable portion 106 can extend along a leading edge of the device, and the cleaning sheet 108 can extend along the underside of the device. This arrangement separates the receptacle 102 from the cleaning sheet 108, and allows for a shorter support structure 104 to be used since the confinement volume can support the receptacle 102 and a lower support structure on the cleaning device and support the cleaning sheet 108 while in use.

Figure 8E:
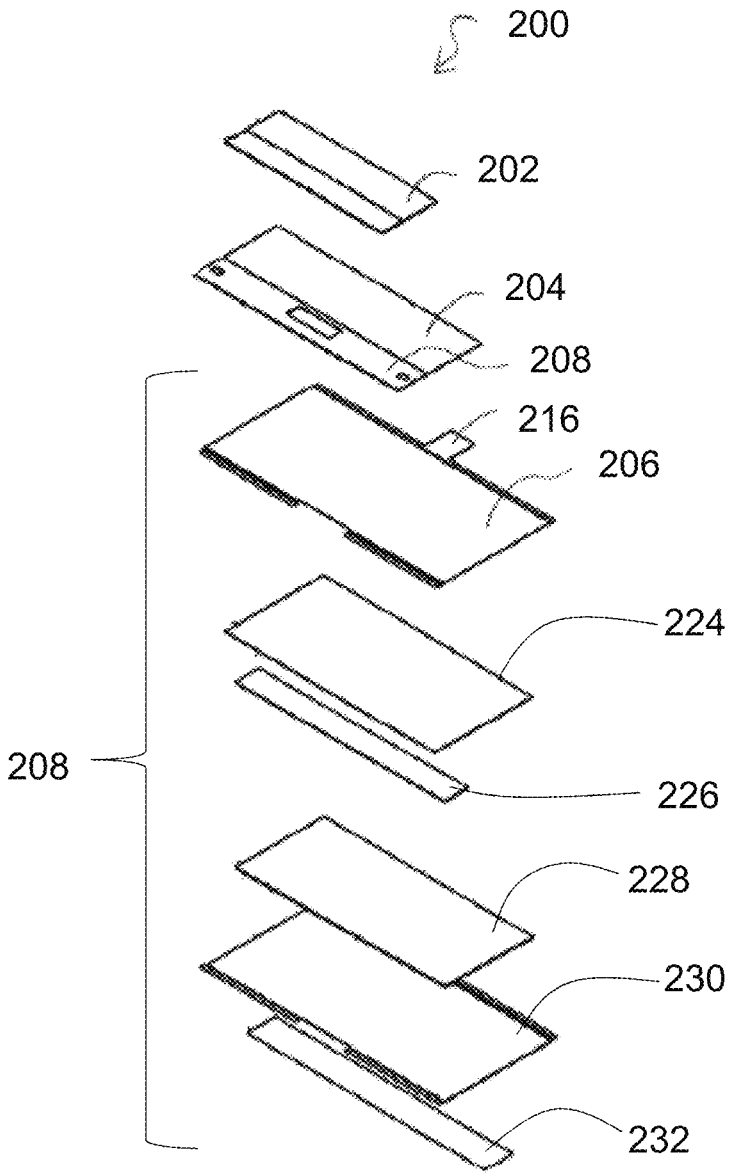
FIG. 8E is an exploded view of a cleaning head according to another embodiment.

FIG. 8E is an exploded view of another exemplary embodiment of a cleaning head 200. The cleaning head 200 is substantially similar to the cleaning head 100, except that the cleaning pad of the cleaning head 200 includes less layers within the cleaning pad 208 that the cleaning pad 108 of the cleaning head 100. The cleaning head 200 still includes a receptacle 202, a support structure 204, and a cleaning pad 208. The support structure 204 includes a foldable portion 208 having a suction inlet 210, and apertures 212, 214 for securing the cleaning head 200 to a cleaning device. Additionally, the cleaning sheet includes an attachment tab 216, e.g., on the barrier layer 206, which is substantially similar to the attachment tab 522 of cleaning head 100. The cleaning head 200 can be formed from a plurality of layers, including an acquisition layer 224, a SAP strip 226, another acquisition layer 228, a face layer 230, and a multi-functional strip 232. The various layers can be held together using various mating techniques, such as via adhesive layers arranged between the layers, or securement techniques such as ultrasonic welding.

FIGS. 9-22 illustrate the connector housing 300 of the cleaning device of FIG. 1. The connector housing 300 is configured to operate with a cleaning head attached thereto, such as cleaning head 100 described above. As shown, the connector housing 300 generally includes a body 302, a hinge connector 304, and a tube 306. The tube 306 is configured to connect to a suction source downstream of the connector housing 300 to allow suction to be applied through the body 302 and within the cleaning head.

The illustrated body 302 is in the form of a rectangular housing that generally includes a top surface 308, a bottom surface 310, a front surface 312, and a rear surface 314. In this embodiment, the connector housing 300 includes a release button 316 arranged in the top surface 308 of the body 302. As will be described below, the release button 316 is connected to an internal linkage assembly 332 which is configured to releasably secure a cleaning head to the bottom surface 310 of the connector housing 300.

The front surface 312 includes a central opening 311 that is configured to align with the suction inlet 112 of a cleaning head connected to the connector housing 300. Additionally, the front surface can include castellations 313, with openings 315 arranged therebetween. The castellations 313 can be configured to increase the suction force being applied to debris outside of the connector housing 300 in order to draw more debris into the suction inlet 112. In one embodiment, the castellations 313 can be in the form of triangles of various sizes extending downward from the connector head 320. The castellations 313 can also act as filters for very large debris which would not fit through the suction inlet 112.

The bottom surface 310 of the connector housing 300 includes an opening 320 therein. The opening is configured to allow access to an internal cavity 322 of the body 302 where a receptacle defining a dirt collection chamber of a cleaning head can be arranged. In the illustrated embodiment, the connector housing 300 includes a gasket 329 arranged around the opening 320 in order to help create a seal with a cleaning head when the cleaning head is attached to the connector housing 300. Additionally, a wall 330 is arranged within the cavity 320 in order to aid in keeping a cleaning head flush with a surface to be cleaned and to prevent the cleaning head from being sucked into the cavity 322 by a suction force. Additionally, the wall 330 can include a cage 331 configured to prevent large debris from passing into the body 12 through the central opening 302A.

The connector housing 300 can further include a linkage assembly 332 to removably secure the cleaning head to the connector housing 300. In the illustrated embodiment, the linkage assembly 332 generally includes a pin 318, a bracket 324, a front pivoting lever 334, and a rear pivoting lever 336. As described in detail below, the components of the linkage assembly 332 operate in unison through actuation of the release button 316 by simultaneously retracting the pin 318 while also increasing the engagement slot 325 by moving the bracket 324 forward within the body 302.

The front and rear pivoting levers 334, 336 can have a variety of configurations, but in general the front pivoting lever 334 is configured to mate to the bracket 324 and the rear pivoting lever 336 is configured to mate to the pin 318. Each pivoting lever 334, 336 can have a generally elongate configuration but can be bowed around a mid-portion. A first end 334A of the front pivoting lever 334 can extend at an angle in a rearward direction for allowing a slot 335 formed therein to slidably receive a post 333 formed on the release button 316. A second end 334B of the front pivoting lever 334 can be positioned forward of the central opening 302A for abutting a mid-portion of the bracket 324. The mid-portion of the front pivoting lever 334 can include a pivot joint 334C for allowing the front pivoting lever 334 to pivot relative to the body 302. Similarly, a first end 336A of the rear pivoting lever 336 can extend at an angle in a forward direction for allowing a slot 337 formed therein to slidably receive the post 333 formed on the release button 316. A second end 336B of the rear pivoting lever 336 can be positioned rearward of the central opening 302A for pivotally engaging a pin housing 318A coupled to the pin 318. The mid-portion of the rear pivoting lever 336 can include a pivot joint 336C for allowing the rear pivoting lever 336 to pivot relative to the body 302. The front and rear pivoting levers 334, 336 can be connected to the release button 316 by a post 333 extending from the bottom of the release button 316 and into the body 302. In particular, the post 333 can extend through the slots 335, 337. A screw 333*a* can be connected to the post 333 in order to prevent the front and rear pivoting levers 334, 336 from being dislodged from the post 333.

Figure 17:
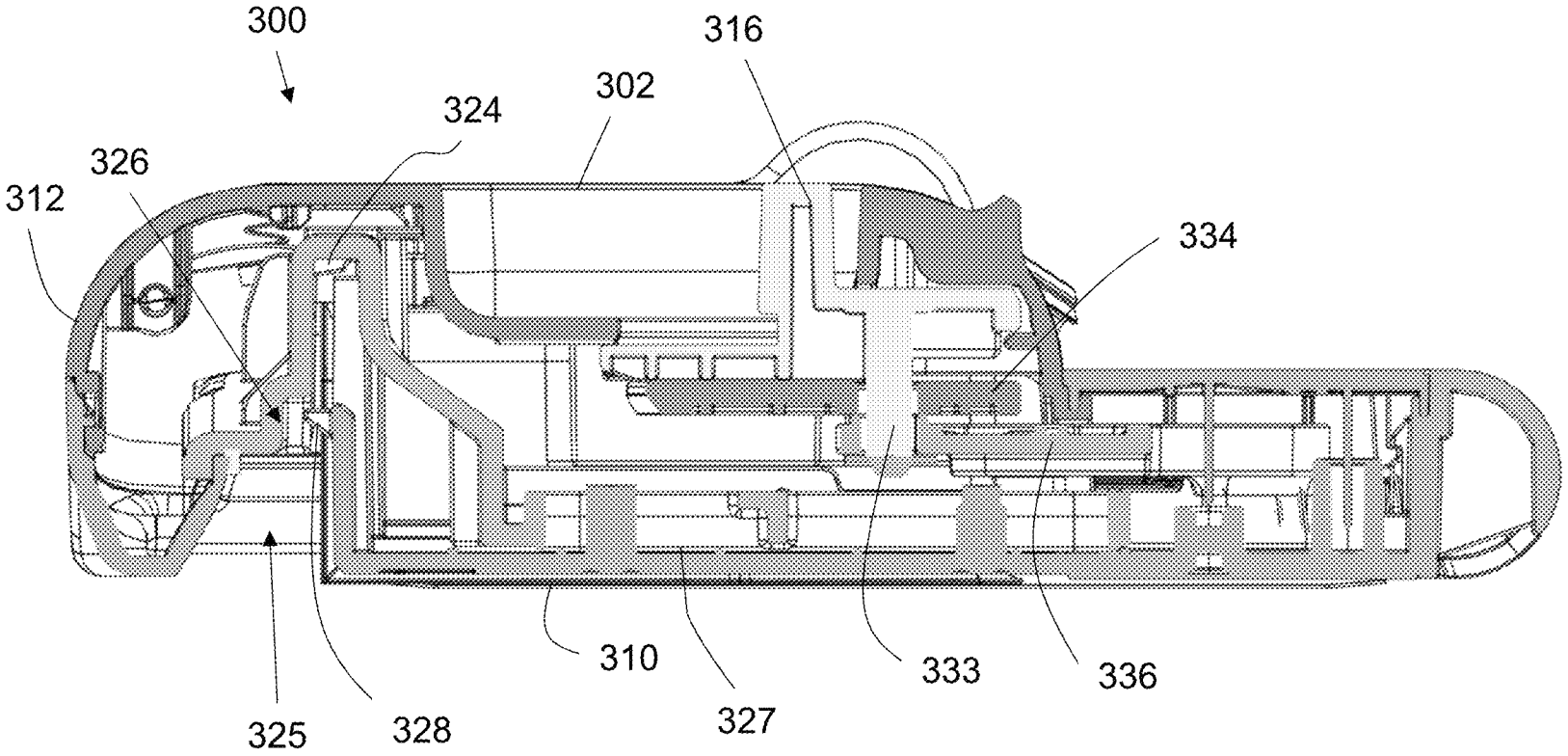
FIG. 17 is a cross-sectional view of the connector housing of FIG. 9 depicting the bracket in the first position.
Figure 18:
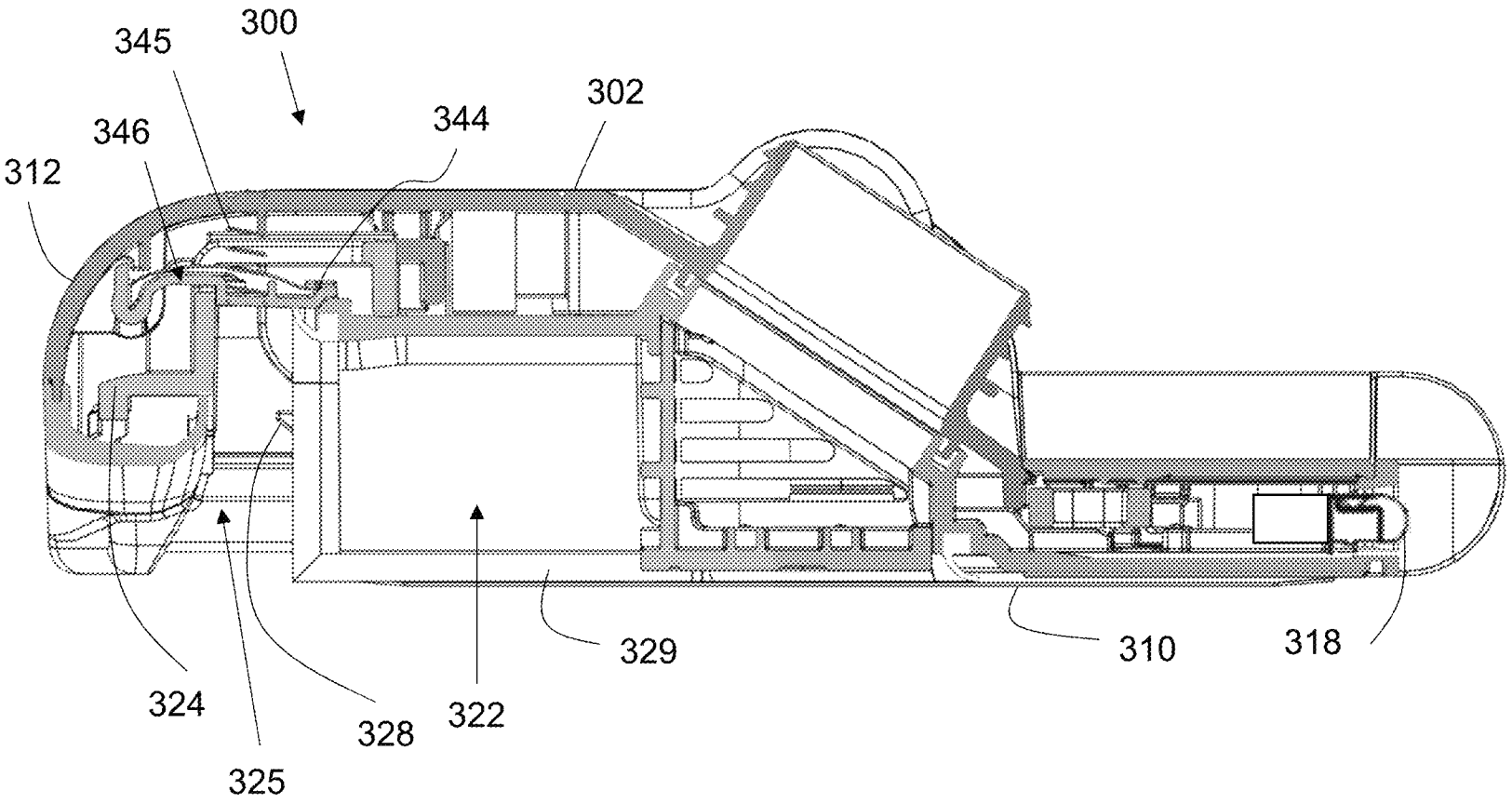
FIG. 18 is a cross-sectional view of the connector housing of FIG. 16 depicting the bracket and the pin in a second position.
Figure 19:
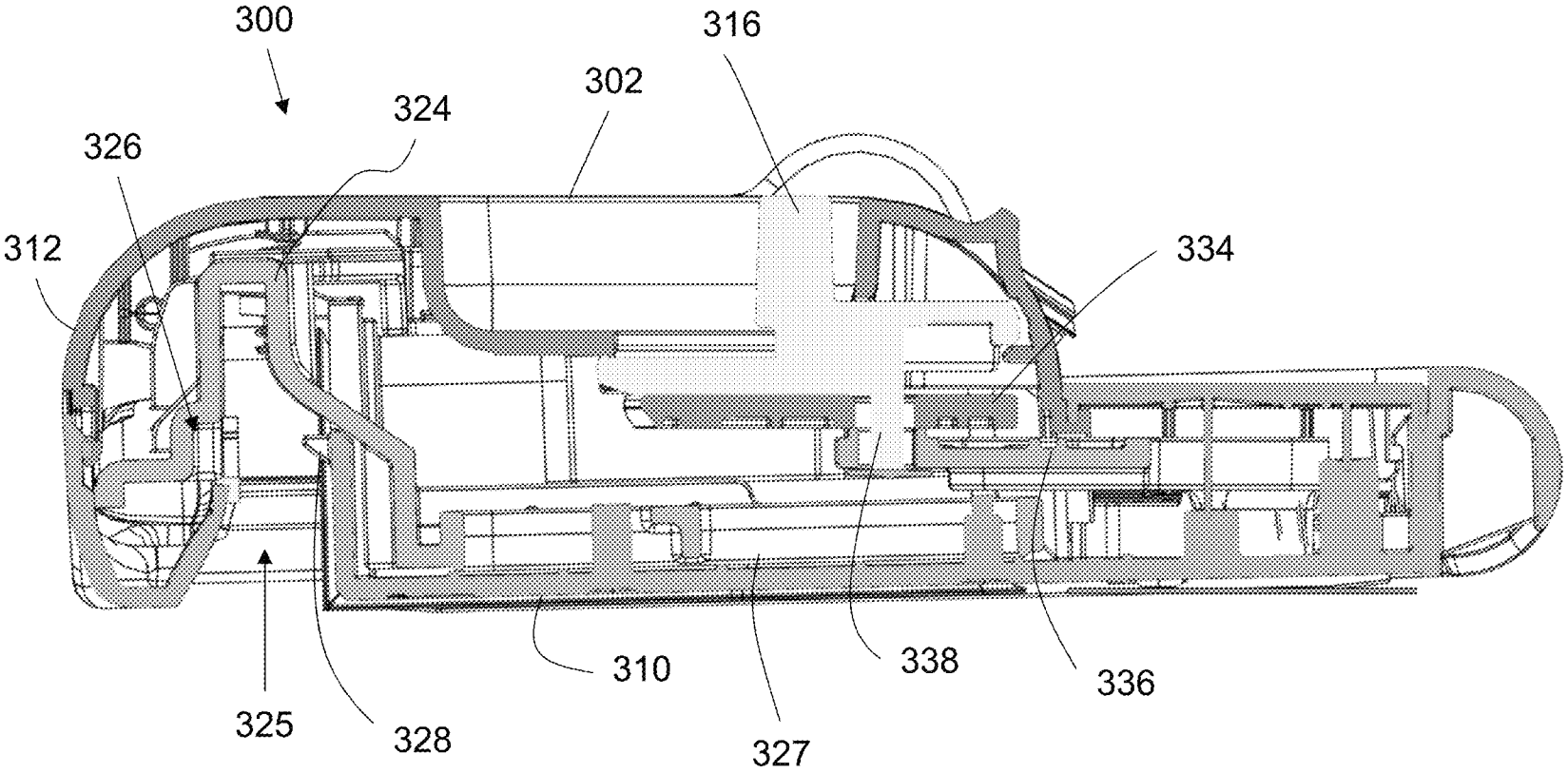
FIG. 19 is a cross-sectional view of the connector housing of FIG. 17 depicting the bracket in the second position.
Figure 20:
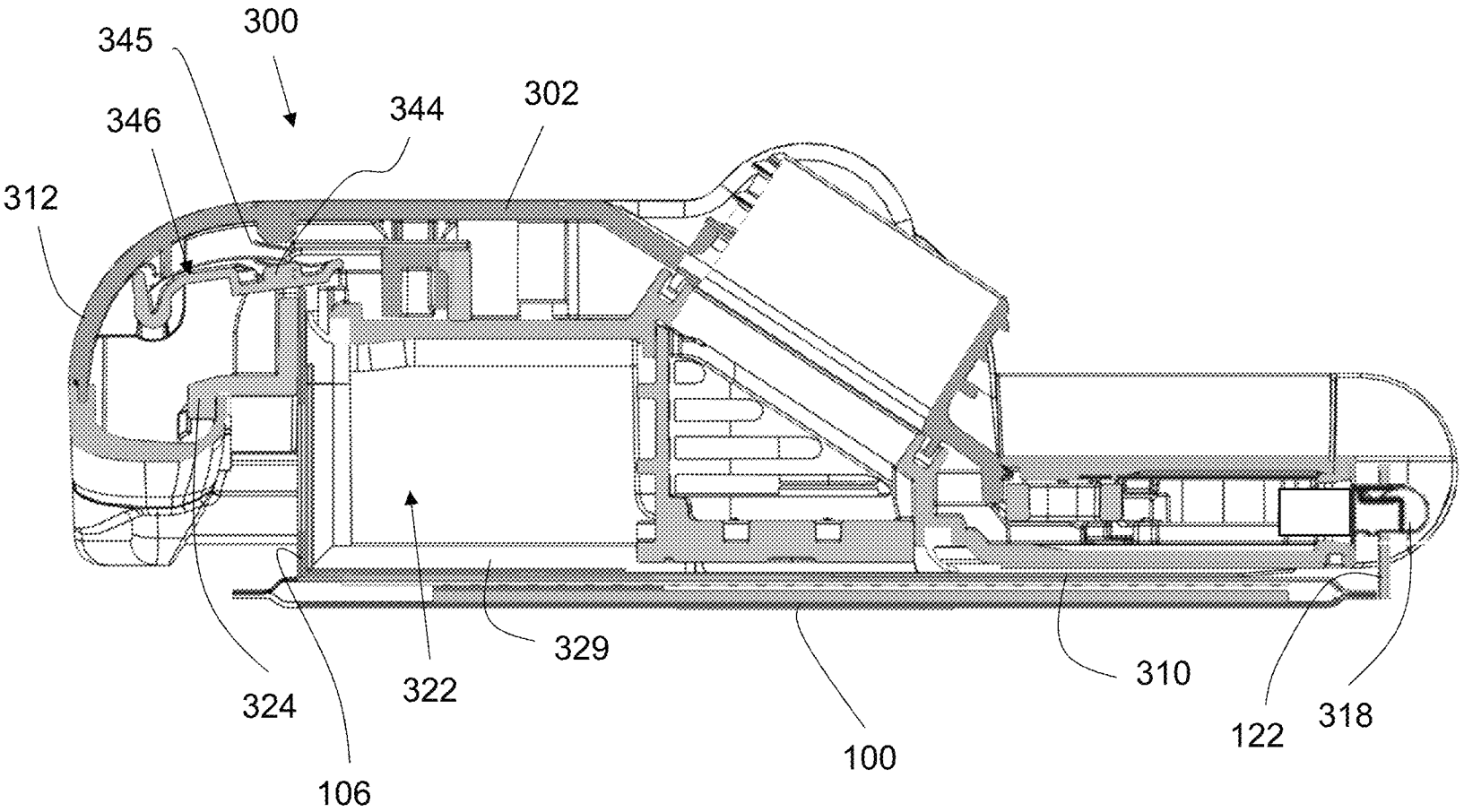
FIG. 20 is a cross-sectional view of the connector housing of FIG. 16 depicting the bracket and the pin in the first position and showing the cleaning head of FIG. 1 coupled thereto.
Figure 21:
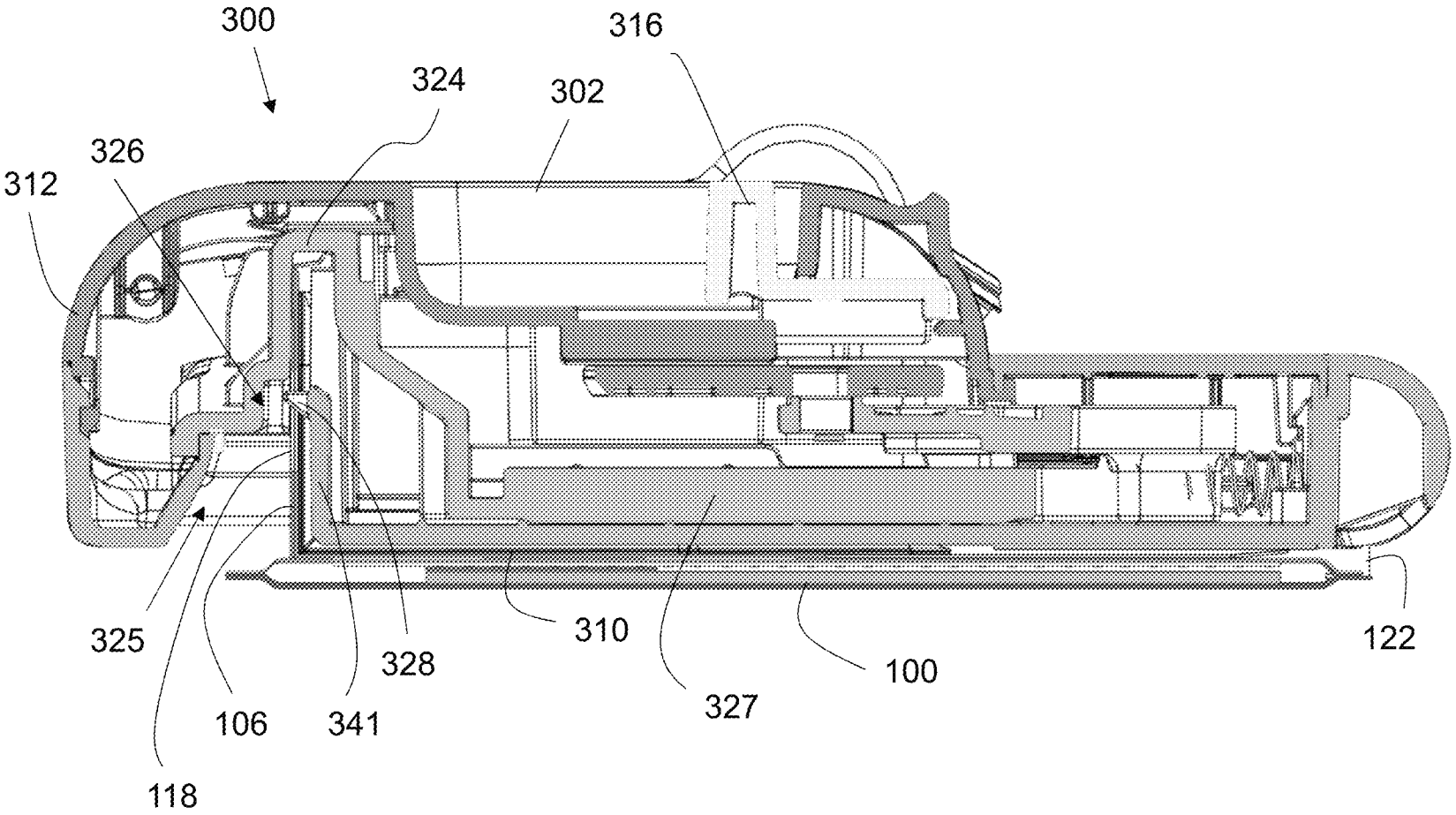
FIG. 21 is a cross-sectional view of the connector housing and cleaning head of FIG. 20 depicting the bracket and the pin in the first position.
Figure 22:
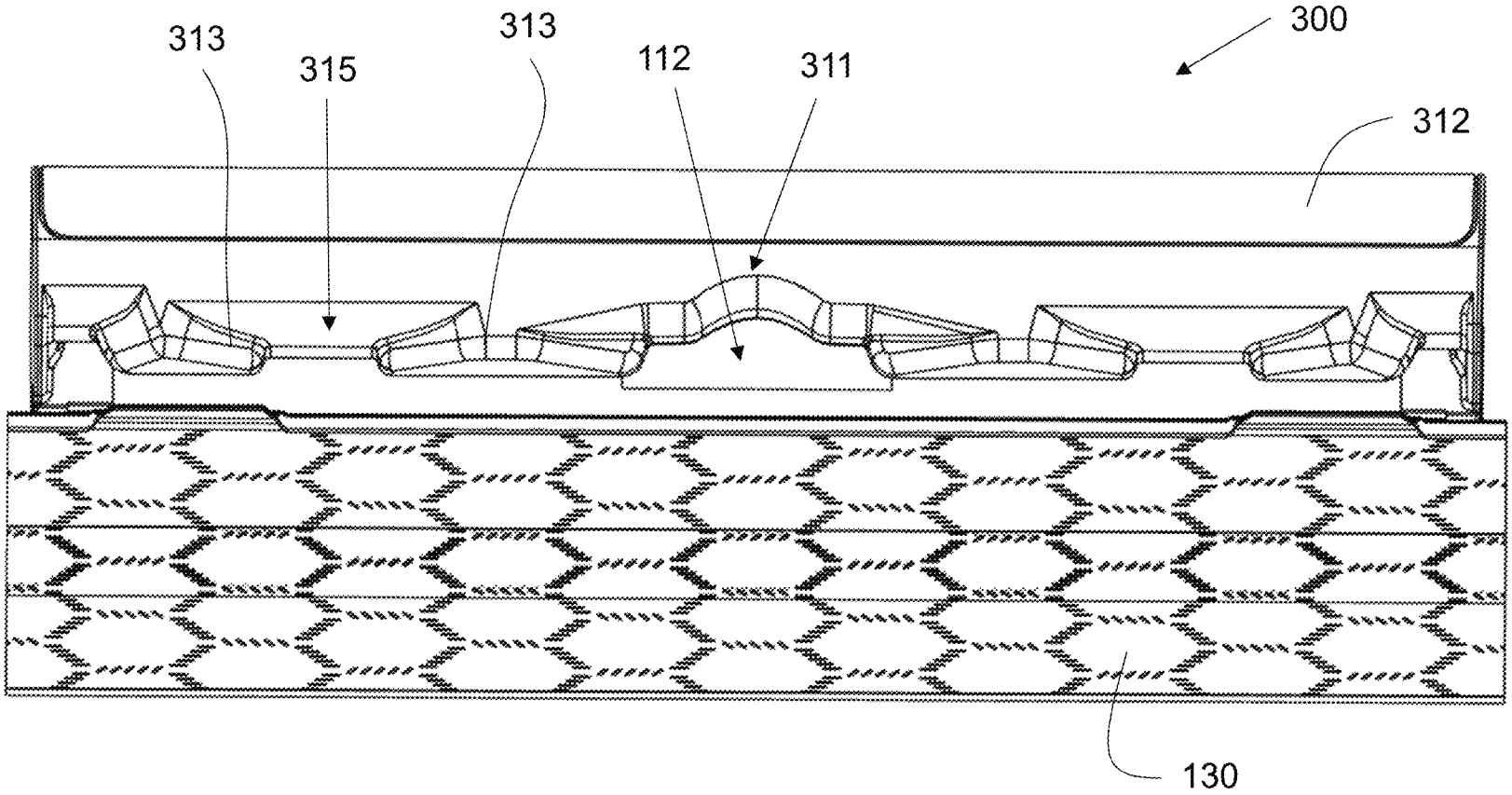
FIG. 22 is a bottom perspective view of the connector housing and cleaning head of FIG. 20.

As best shown in FIGS. 17-18, the bracket 324 is movably disposed within the cavity 322 such that an engagement slot 325 is formed between the bracket 324 and the body 302. In this embodiment, the bracket 324 is mechanically connected to the release button 316 such that when the release button 316 is actuated to a release position, the bracket 324 will move to increase a size of the engagement slot 325 thereby releasing a cleaning head mated to the cleaning device. In the illustrated embodiment, the bracket 324 includes bores 326 which are aligned with projections 328 extending from an internal wall 341 of the body 302. As will be described in detail below, as the bracket 324 slides within the body 302, the projections 328 can extend into the bores 326 to encapsulate and clamp a portion of a cleaning head, such as a foldable portion 106, between the bracket 324 and the internal wall 341. In particular, the projections 328 can extend through the apertures 116, 118 within the foldable portion 106 to secure the cleaning head 100 to the connector housing 300. The bracket 324 can further include elongate arms 327 extending rearwardly from opposed terminal ends thereof. The arms 327 include slides that are configured to slidably receive projections (not shown) within the connector housing 302 in order to allow the bracket to slide forward and backward within the body 302. The bracket 324 also includes a tab 340 configured to receive an input force from the second end 334B of the front pivoting lever 334 to slide the bracket 324 within the housing, as discussed further below.

As indicated above, the linkage assembly 332 also includes a retractable pin 318 arranged on the rear surface 314 of the body 302. The pin 318 is configured to project from the housing in order to secure a portion of a cleaning head, such as an aperture of the attachment tab 122 to the cleaning head. The pin 318 is also configured to be retracted into the housing to release the cleaning head. In the illustrated embodiment, the pin 318 is mated to a pin housing 318A that is spring-biased in a direction that retracts the pin 318 into the housing. The pin housing 318A mated to the pin has an indent 318B formed therein that is configured to aid in locking the pin 318 in the extended position.

Figure 15:
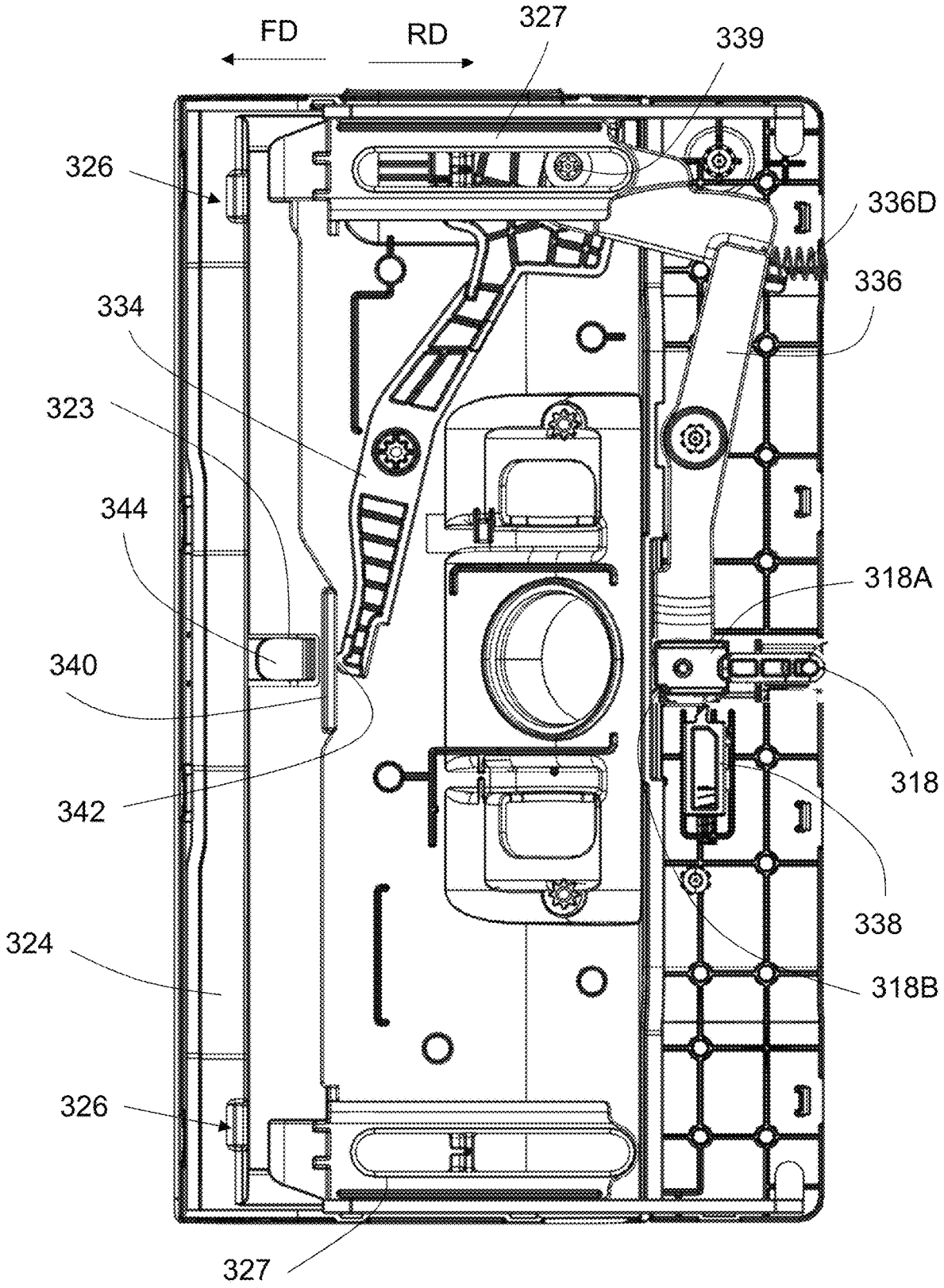
FIG. 15 is a bottom view of the connector housing of FIG. 9 showing the linkage assembly in the second position.
Figure 15A:
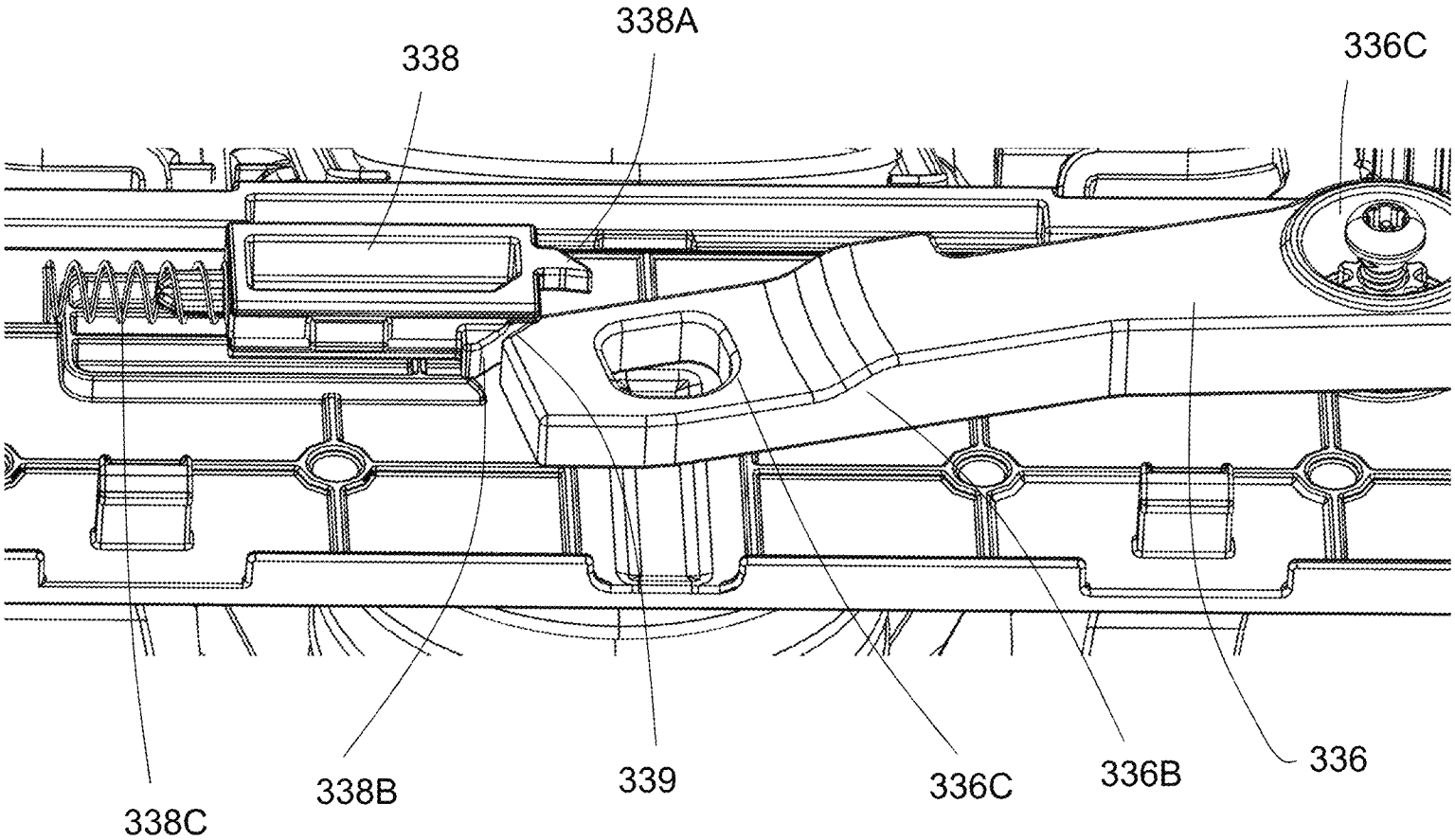
FIG. 15A is a detailed bottom perspective view of the connector housing of FIG. 9 showing a portion of the linkage assembly of FIG. 13 and a locking mechanism.
Figure 16:
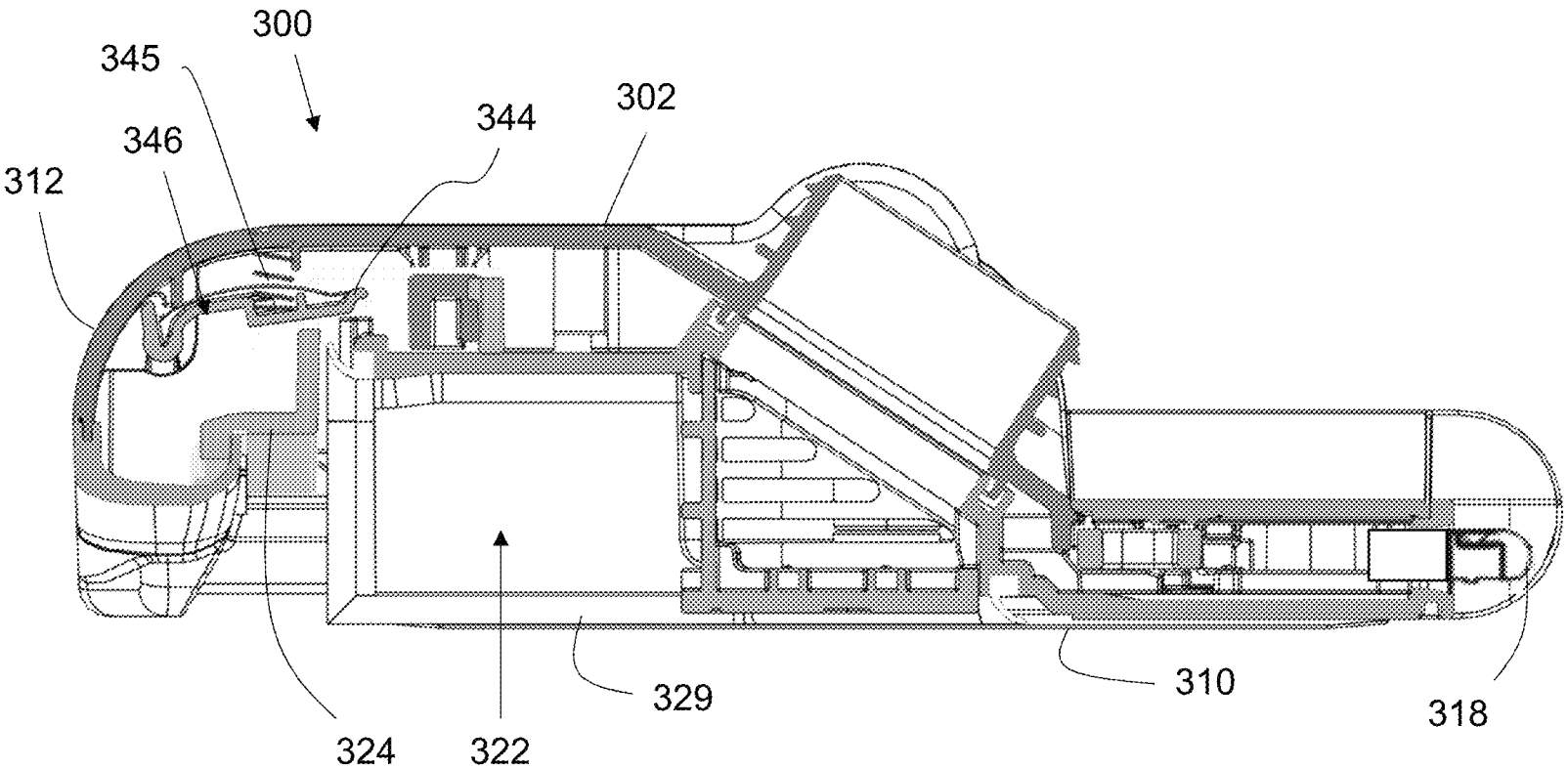
FIG. 16 is a cross-sectional view of the connector housing of FIG. 9 depicting a bracket and a pin in a first position.

A locking mechanism 338 can be provided to prevent the pin 318 from retracting into the body 302 without the release button 316 being actuated. As shown in more detail in FIG. 15A, the illustrated locking mechanism 338 includes a spring-biased member having a tab 338A formed on the end thereof that engages the indent 318B in the pin housing 318A. The pin housing 318A is pivotally connected to the rear pivoting lever 336 at the through-bore 336C. The locking mechanism 338 also includes an angled surface 338B on the end thereof that interacts with an angled surface 339 on the second end 336B of the rear pivoting arm 336. With the tab 338A in engagement with the indent 318B in the pin housing 318A such that the pin 318 is locked in the extended position, movement of the second end 336B of the rear pivoting lever 336 in a forward direction causes the angled surface 339 to push against the angled surface 338B on the locking mechanism 338, thereby causing the locking mechanism 338 to move against the bias of the spring 338C thus moving the tab 338A out of engagement with the indent 318B. The spring bias on the pin housing 318A thereafter causes the pin housing 318A to move forwardly, retracting the pin 318 into the body 302.

In certain exemplary embodiments, the body 302 and pin 318 can have different configurations. For example, in an exemplary embodiment, the body 302 can have two pins extending from the rear surface 314 of the body 302. The body 302 can also include tabs (not shown) extending from the upper edge or side edges of the rear surface 314 of the body 302 to aid in aligning attachment tabs of a cleaning head 300 with the pins. The body 302 can also include exterior tabs (not shown) and interior tabs (not shown) extending from the rear surface 314 of the body 302 to aid in aligning attachment tabs of a cleaning head 300 with the pins. The exterior tabs and interior tabs form a slot which further can secure an attachment tab of a cleaning head 300 to the pins. As in the embodiments described above, the pins can retract and extend within and from the housing.

FIGS. 12-15 illustrate the linkage assembly 332, while omitting the body 302 and bracket 324 for clarity. In the illustrated embodiment, the release button 316 can slide within the body 302, which moves both the front and rear pivoting levers 334, 336. In particular, as the release button 316 is moved in a release direction RD, the post 333 translates that motion to the first end 334A, 336A of the front and rear pivoting levers 334, 336 in order to pivot the second end 334B of the front pivoting lever forward in the body 302, and to pivot the second end 336B of the rear pivoting layer away from the rear of the body 302.

Pivotal movement of the second end 336B of the rear pivoting lever 336 releases the locking mechanism 338, thus allowing the pin 318 to move to the retracted position within into the body 302. When the release button 316 is released, the rear pivoting lever 336 returns to its initial position against the bias of a spring 336D, causing the second end 336B of the rear pivoting lever 336 to move rearwardly to push the pin housing 318A thereby causing the pin 318 to extend from the body 302. With the pin housing 318A moved rearwardly, the tab 338A will engage the indent 318B in the pin housing 318A, thereby retaining the pin 318 in the extended position.

Pivotal movement of the second end 334B of the front pivoting lever 334 causes a projection 342 arranged on the second end 334*b* to contact the tab 340 such that the bracket 324 is pushed forward. Since the bracket 324 can move relative to the body 302, this forward movement of the bracket 324 enlarges the engagement slot 325 so that a portion of a cleaning head (e.g., foldable portion 106) can be inserted into the engagement slot 325. With a portion of a cleaning head inserted, the bracket can be slid backwards within the body 302 in order to secure the cleaning head between the bores 326 and projections 328.

Figure 9:
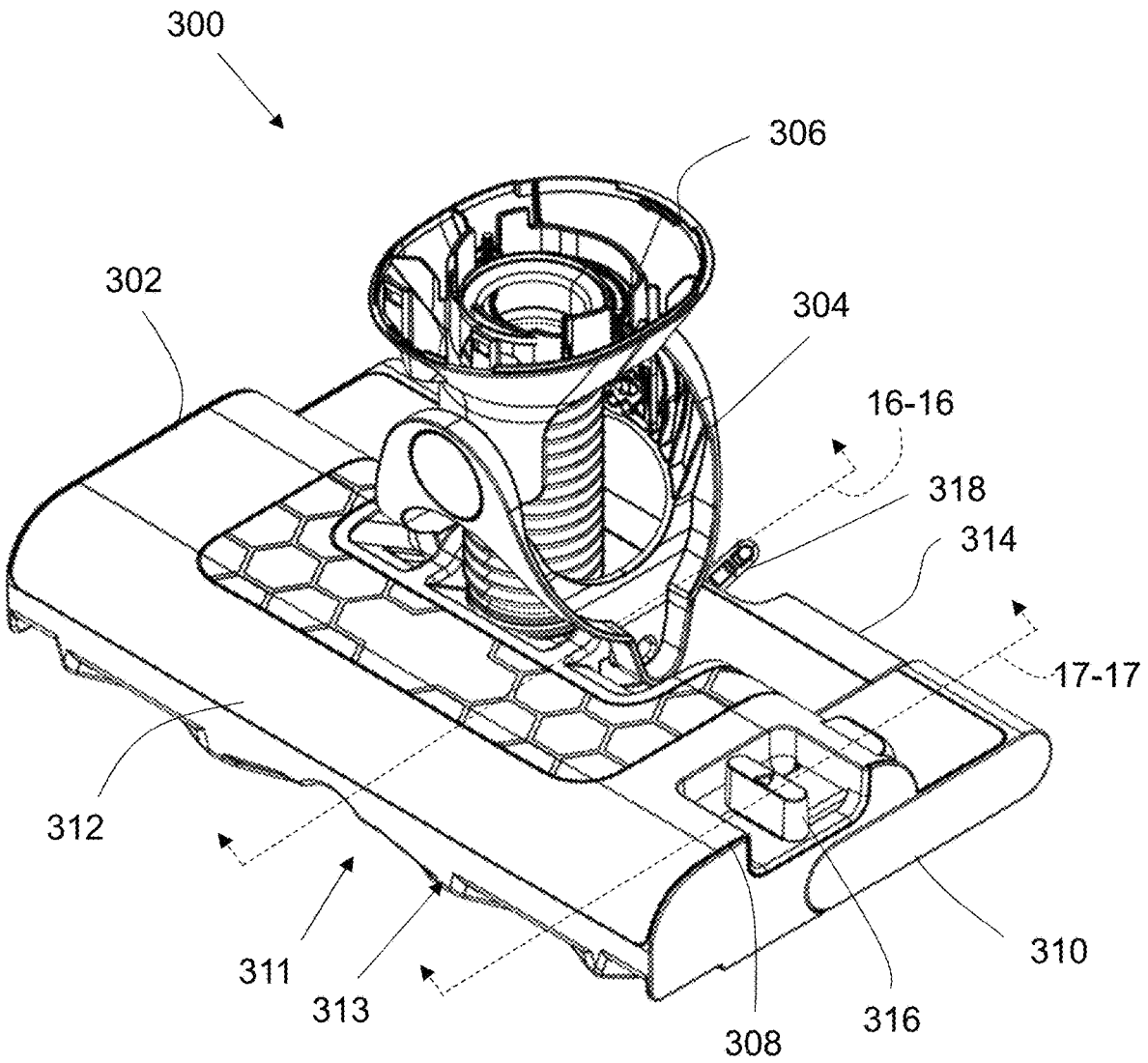
FIG. 9 is a top perspective view of a connector housing of the cleaning device of FIG. 1.
Figure 10:
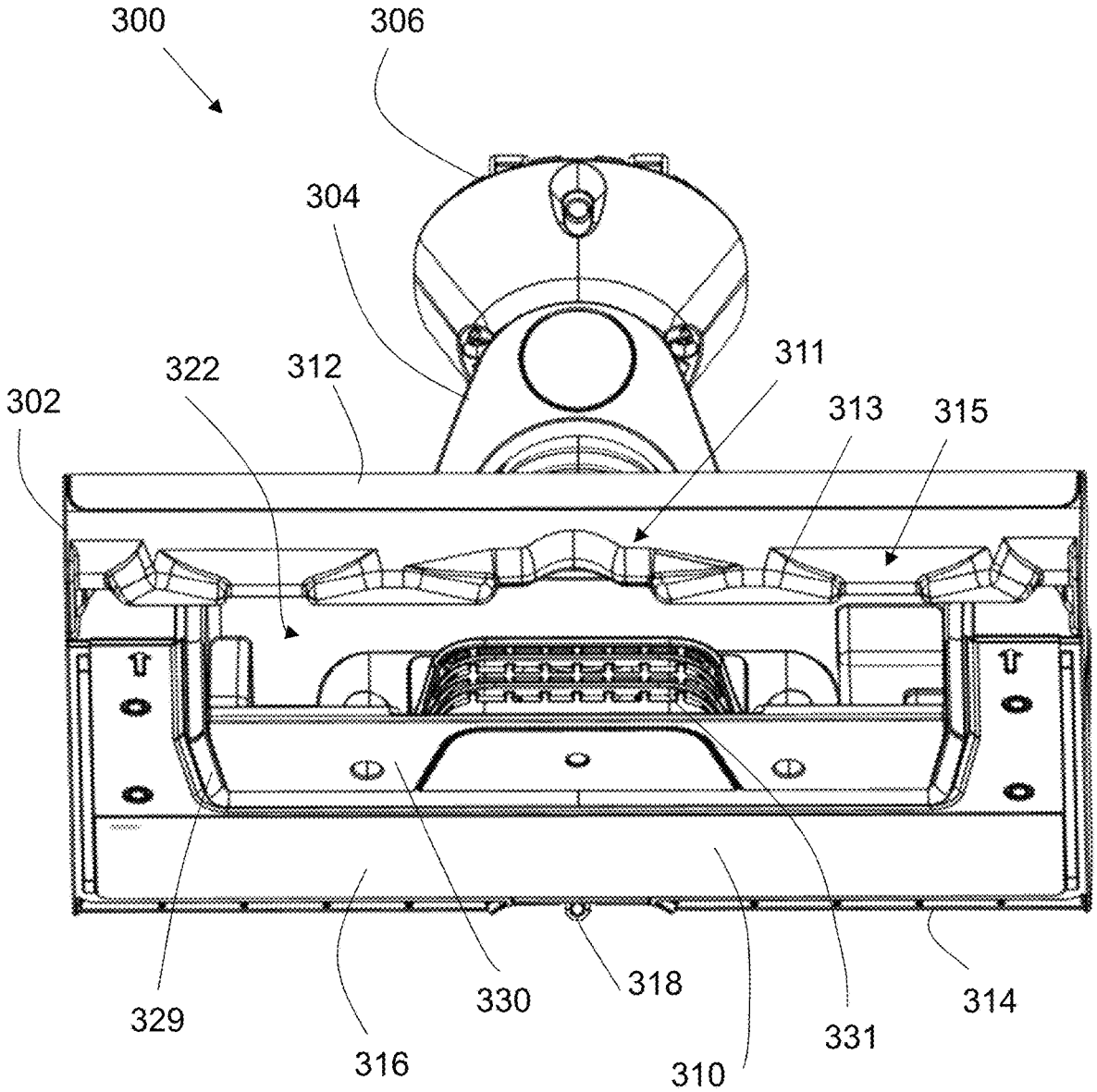
FIG. 10 is a bottom perspective view of the connector housing of FIG. 9.
Figure 11:
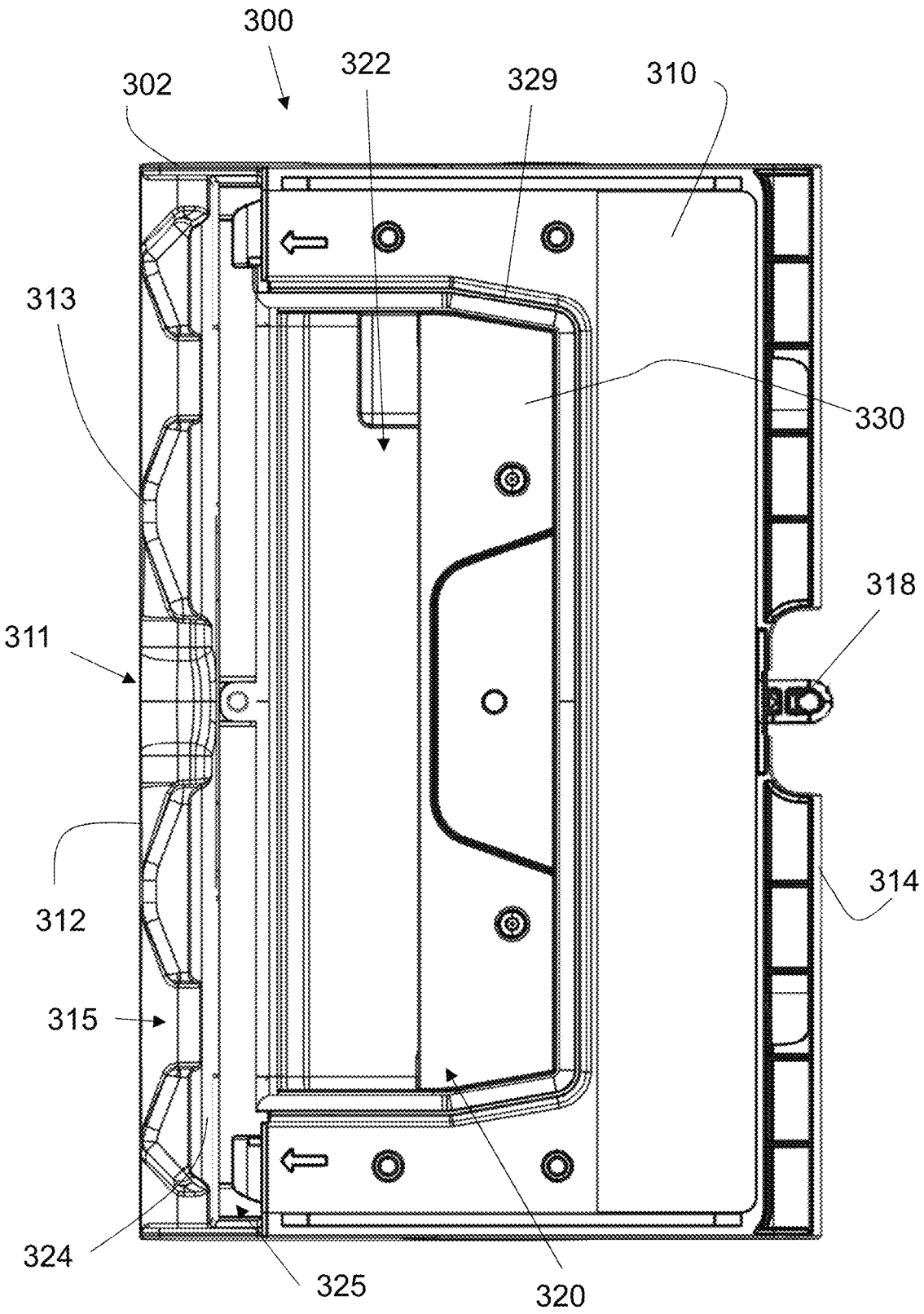
FIG. 11 is a bottom view of the connector housing of FIG. 9.
Figure 12:
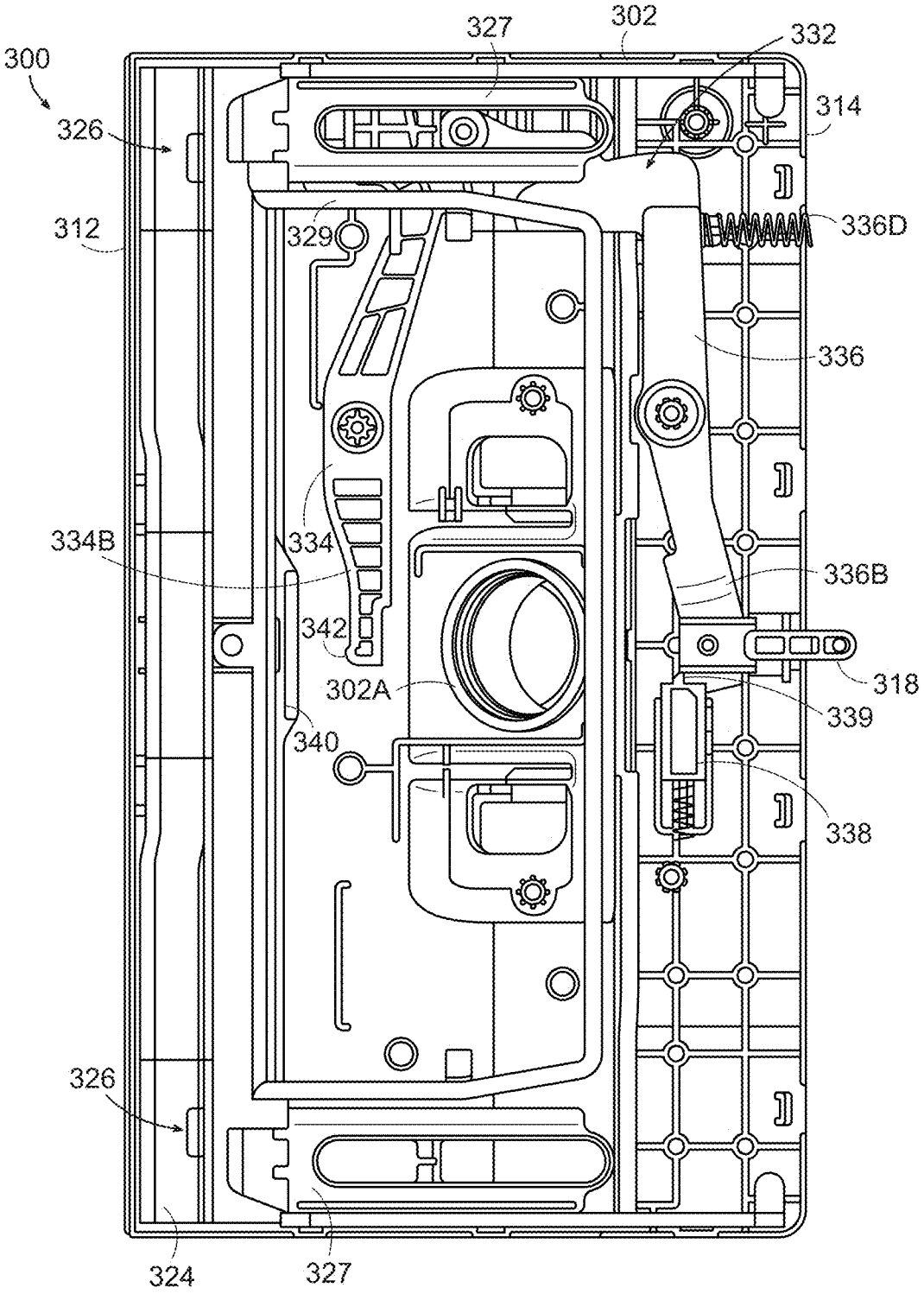
FIG. 12 is a bottom view of the connector housing of FIG. 9 with the outer housing removed, depicting a linkage assembly in a first position.
Figure 13:
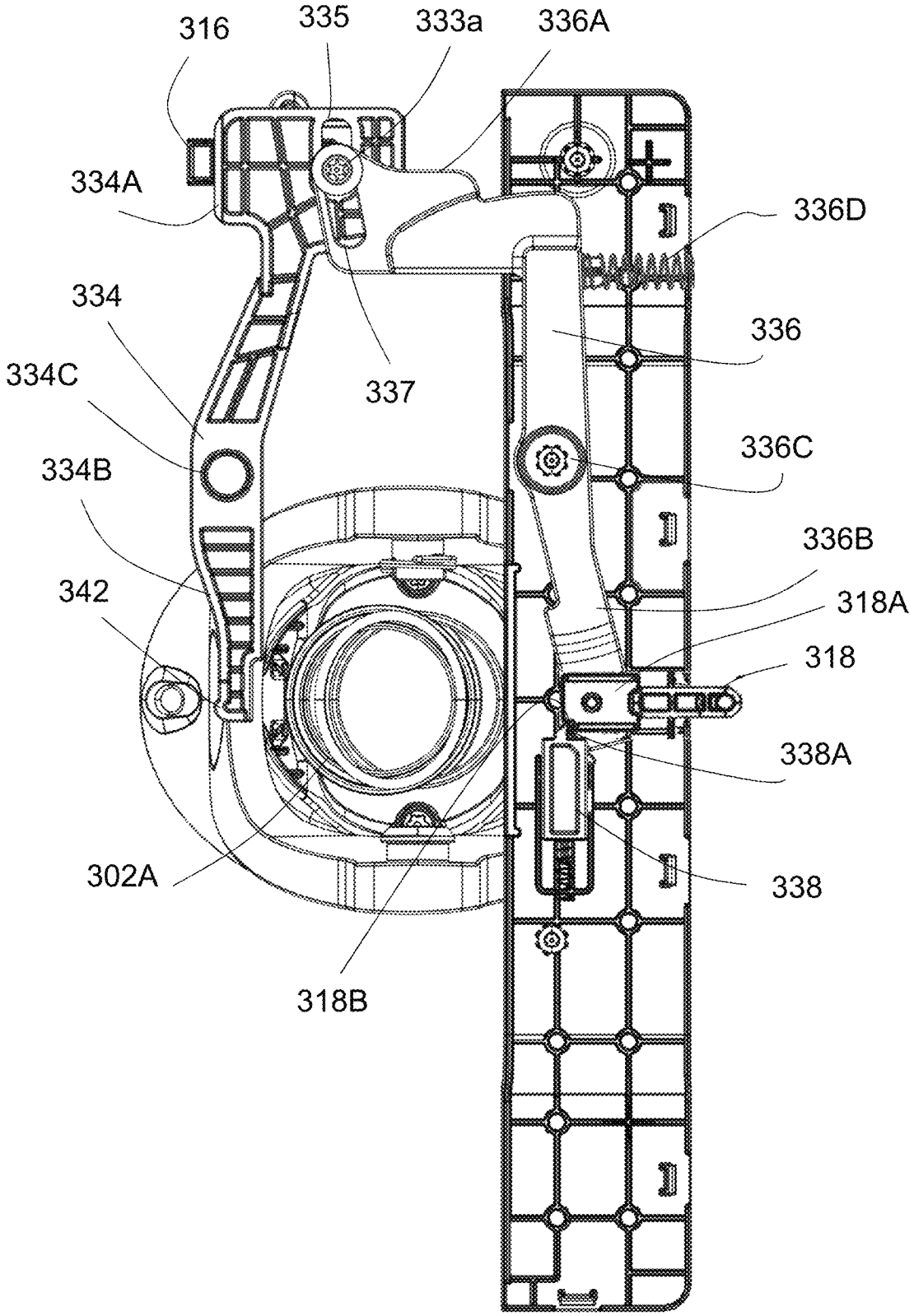
FIG. 13 is a bottom view of the connector housing of FIG. 9 showing a portion of the linkage assembly in a first position with the outer housing removed.
Figure 14:
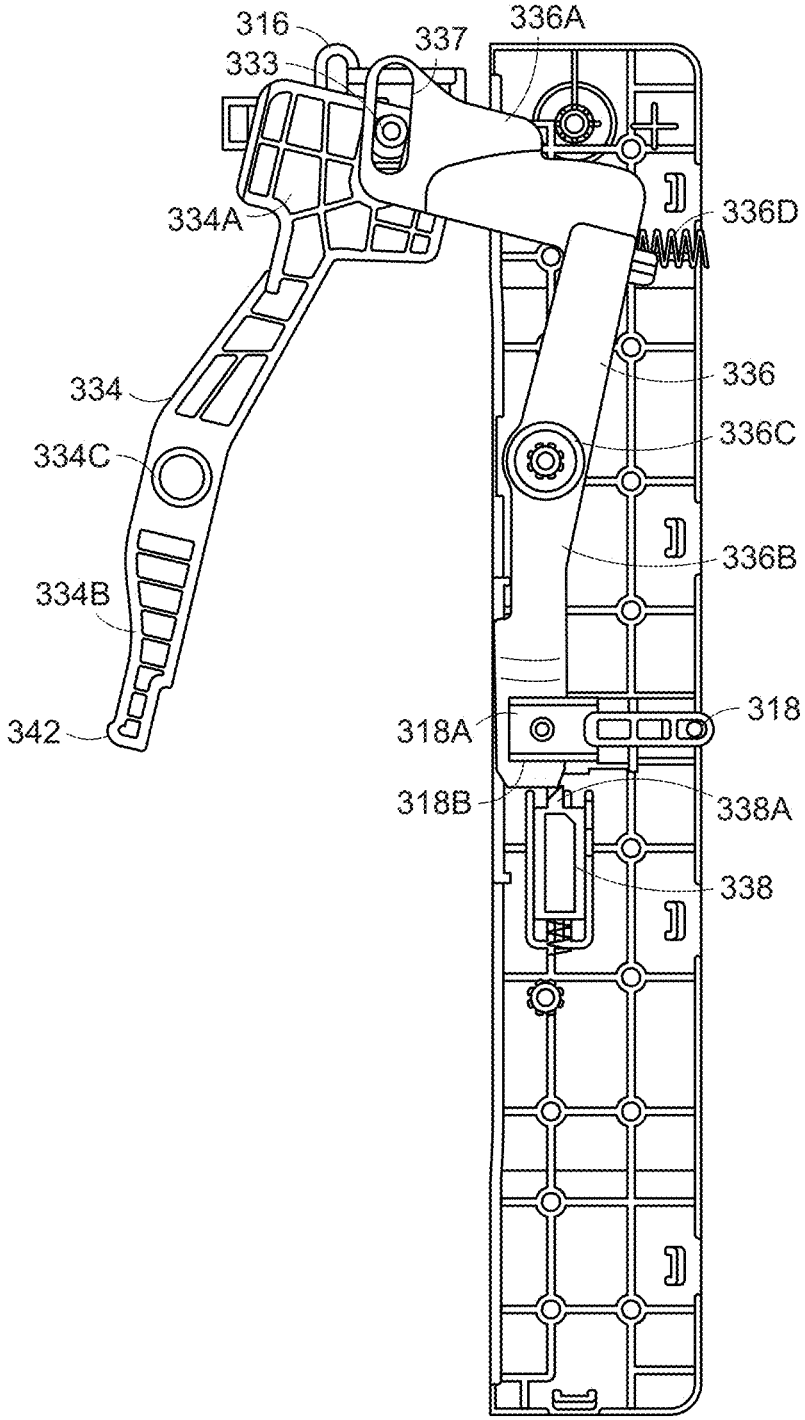
FIG. 14 is a bottom view of the linkage assembly of FIG. 13 in a second position with the outer housing removed.

FIGS. 16-21 show cross-sectional views taken at lines 16-16 and 17-17 in FIG. 9, further illustrating the bores 326 and the projection 328. As illustrated, the bracket 324 is in a retention position, where the engagement slot 325 has a minimal width and the projections 328 extend into the bores 326. However, once the bracket 324 is actuated as detailed above, the bracket 324 moves in a forward direction FD, increasing the width of the engagement slot 325 and removing the projections 328 from the bores 326. Even though only two channels and two projections are illustrated, a person skilled would appreciate that more or less channels or projections can be used, as well as other types of mechanical connections in order to secure a cleaning head to the connector housing 300.

A securement tab 344 can be arranged within the front surface 312 of the body 302. The securement tab 344 can be spring biased downward into a retention position by a spring 345. When in the retention position, the securement tab 344 rests on top of the bracket 324, with the bracket 324 fully pushed backward in the body 302 to minimize the width of the engagement slot 325. However, when a new cleaning head is to be secured to the connector housing 300, the release button 316 is actuated causing it to move to a release position, which in turn moves the bracket 324 forward in the body 302 to a release position. With the pin 318 retracted and the projections 328 not engaged within the bores 326, a used cleaning head can fall off the connector housing 300 or be easily removed with minimal force. This enables the removal of a soiled cleaning head without requiring physical contact between the user and the soiled material.

In the release position, as shown in FIG. 18, the bracket 324 is moved forward such that the securement tab 344 is pushed upward until an aperture 323 of the bracket 324 reaches a notch 346 arranged in the securement tab 344. With the notch 346 arranged within the aperture 323, the bracket 324 cannot move back to the retention position and is locked in the release position. Additionally, even though the bracket 324 is in the release position, the release button 316 can slide back to a retention position, and the pin 318 can extend outward and return to the retention position. The bracket 324 slides back to the retention position once a cleaning head is inserted into the engagement slot 325 and releases the securement tab 344 from the aperture 323.

In another exemplary embodiment, when the bracket 324 is in the release position, and since the bracket 324 is connected to the other components of the linkage assembly 332, the pin 318 can remain retracted within the body 302 in the release position, and the release button 316 can remain in a release position. In this embodiment, as the bracket 324 moves to the retention position, the pin 318 would extend from the housing, simultaneously securing a cleaning head via the bracket 324 and the pin 318.

In order to move the linkage assembly 332 and its components back to a retention position, a portion of a cleaning head (e.g., foldable portion 106) is inserted into the engagement slot 325. When the portion of the cleaning head is fully inserted into the engagement slot 325, the cleaning head will push the securement tab 344 upward, releasing the bracket 324 from the notch 346. Since the bracket 324 and/or linkage assembly 332 is spring biased to the retention position, once the securement tab 344 releases the bracket 324, the bracket 324 slides backwards to the retention position, securing the portion of the cleaning head which abutted the securement tab 344 within the engagement slot 325. With the foldable portion 106 secured to the body 302 and the attachment tab 122 secured to the body 302, the cleaning head 100 is secured at both the leading edge and trailing edge of the cleaning head 100. With a portion of the cleaning head secured to the connector housing 300, a suction inlet of the cleaning head is secured at the front surface 312 of the body 302 such that the foldable portion cannot move relative to the body 302. Additionally, a cleaning head 100 secured to the connector housing 300 by the pin 318 and bracket 324 will cover the opening 320 and create a suction seal with the gasket 329, allowing a suction force to flow from a suction source, through the tube 306, the cavity 322, a dirt collection chamber of the cleaning head, and through the nozzle of the cleaning head to collect debris into the dirt collection chamber.

FIGS. 23-26 illustrate another embodiment of a cleaning head 400 having a support structure 404, a dirt collection chamber 402 for collecting debris removed from the surface, and a cleaning sheet 412. As shown, the support structure 404 can be in the form of a generally planar rectangular sheet, e.g., formed from cardboard. One or more sides of the support structure 404 can be configured to fold upward to form a sidewall around an outer perimeter thereof. In the illustrated embodiment, the support structure includes foldable portions 406, 408 arranged along a leading and trailing edges of the support structure 404. The support structure can be pre-bent, e.g., with creases formed therein, to facilitate folding up of the portions 406, 408. The foldable portions 406, 408 allow the cleaning head to be attached to a cleaning device, as will be discussed in detail below.

A suction inlet 410, e.g., a cut-out, may be arranged in the leading foldable portion 406 to allow debris to be suctioned into the dirt collection chamber 402. A valve (not shown) may be arranged within the suction inlet 410 in order to prevent debris from falling back through the suction inlet 410 from the dirt collection chamber 402 when suction is not applied to the dirt collection chamber 402.

The dirt collection chamber can be in the form of a dirt cup, a dirt bin, or any other suitable container for collecting dirt such as dust or wet and/or dry media. In some embodiments, the dirt collection chamber 402 is pleated and folded in such a way that when the foldable portion 406, 408 are folded from the stored configuration to the use configuration at approximately 90°, the dirt collection chamber 402 can be unfolded to form an internal volume. As a result, when the foldable portion 406 is folded up, the sheet will form a dirt collection chamber having a volume therein for receiving and retaining debris. In the illustrated embodiment, the dirt collection chamber 402 is in the form of a folded, fabric sheet that is arranged to form a bag-like structure. For example, the sheet can have an elongate rectangular configuration with opposed ends of the sheet being folded to create a pleat. The bottom of each pleat can be secured to opposed sides of the support structure, e.g., by glue, heat sealing, or any other permanent attachment technique. The leading edge of the sheet can be secured to leading foldable portion 406 and the trailing edge of the sheet can be secured to the support structure.

When the cleaning device is operated to apply a suction force to the dirt collection chamber 402, the dirt collection chamber 402 can be drawn upwardly away from the support structure 404. For purposes herein, the term "upwardly" means that the dirt collection chamber extends in a direction away from the surface being cleaned. The dirt collection chamber 402 can be made from a permeable material which allows the applied suction force to pull the dirt collection chamber 402 open to form an internal volume within the dirt collection chamber 402.

As will be appreciated, the support structure and the dirt collection chamber need not be the same shape or size. For example, the support structure may be larger than the dirt collection chamber in some embodiments. In some embodiments, the support structure may have a substantially rectangular shape (top view) while the dirt collection chamber has a generally oval, racetrack, or otherwise curved shape (top view).

As indicated above, the cleaning head 400 can include a cleaning sheet 412. The cleaning sheet may be attached to the lower surface of the cleaning head, such as to the support structure. The cleaning sheet can be positioned on a surface of the support structure that is opposite to the surface on which the dirt collection chamber is attached. In some embodiments, the cleaning sheet may be larger than the support structure, although it may be the same size as, or smaller than, the support structure in other embodiments. The support structure and cleaning sheet may be the same shape or they may have different shapes. In use, the cleaning sheet can contact the surface to be cleaning, whereas the support structure may be spaced apart from the surface to be cleaned. The suction inlet 410, however, can be aligned with a leading edge of the cleaning sheet to allow debris to be drawn into the chamber as the cleaning sheet is moved along a surface.

The cleaning head 400 can be removably secured to a cleaning device, such as to a connector 26 on a cleaning device 20. In some embodiments, the connector 26 can include retention slots 26A-26D arranged about the connecter 26 such that the ends 406A, 406B of foldable portion 406 and the ends 408A, 408B of foldable portion 408 can be advanced into and engaged within the slots 26A-26D to secure the cleaning head 400 to the device 20. In some embodiments, the connection between the ends 406A, 406B, 408A, 408B and the slots 16A-16D can be a positive mechanical connection where a device within the connector 26 grips onto the ends 406A, 406B, 408A, 408B within the slots 26A-26D. In some embodiments, a release button or tab can be arranged on the connector so that the positive mechanical connection can be released when the button is depressed in order to remove the cleaning head 400 from the connector 26. In other embodiments, the ends 406A, 406B, 408A, 408B can include cut outs that receive a protrusion or other engagement structure on the connector to positively secure the cleaning head to the device until a release mechanism is actuated to release the cleaning head.

Once assembled, the foldable portion 406 is positioned at a leading portion of the assembly to allow debris in front of the cleaning head to be drawn into the chamber just prior to advancing the cleaning sheet over the surface to be cleaned. The connector 26 can include a front guard feature extending forward of the cleaning head and downward toward the floor surface, thus defining a nozzle region for allowing the suction force to be directed toward the surface to be cleaned. The front guard preferably does not contact the floor surface.

As stated above, the cleaning head can have various configurations to secure to the cleaning device. FIGS. 27-32 illustrate another embodiment of a cleaning head 500 having a dirt collection chamber 502 to collect debris removed from a surface. In this embodiment, the cleaning head 500 has a support structure 504 that is substantially planar and that includes a leading foldable portion 506, which is arranged on a single side of the support structure 504. A suction inlet 510 may be arranged in the foldable portion 506 to allow debris to be suctioned into the dirt collection chamber 502. A valve may be arranged within the suction inlet 510 in order to prevent debris from falling back through the suction inlet 510.

Similar to cleaning head 200, cleaning head 500 can include a dirt collection chamber 502 attached to the support structure, e.g., via glue, heat sealed, or otherwise permanently affixed to the support structure. In this embodiment, the dirt collection chamber 502 is a foldable bag which can protrude upwardly from the support structure 504. The dirt collection chamber 502 can be formed from a sheet of fabric that is pleated and folded in such a way that when the foldable portion 506 is unfolded from the stored configuration to the use configuration at approximately 90°, the dirt collection chamber 502 forms an internal volume. The dirt collection chamber 502 can be made from a permeable material to allow unfolding of the dirt collection chamber 502 under suction.

The cleaning head 500 can also include a cleaning sheet 512, similar to the cleaning sheet 412. The cleaning sheet may be attached to the lower surface of the support structure and can extend past the edge of the support structure 504. The lower surface of the support structure may be positioned opposite to the surface on which the dirt collection chamber is attached to the support structure.

Since the dirt collection chamber only has a single foldable portion for connecting to the connector at the leading edge of the cleaning head, the cleaning sheet 512 can include a securement portion 514 which can aid in securing the cleaning head 500 to the connector 36. The securement portion 514 can have various configurations, and can be in the form of a pocket that extends around a portion 37 of the connector 36. In other embodiments, the securement portion can be a strap, an adhesive, or any other features configured to engage the connector on the cleaning device.

The cleaning head 500 can be removably secured to the connector 36. As shown, the connector 36 can include retention slots 36A, 36B arranged about the connecter 36 such that the ends 506A, 506B of the foldable portion 506 are arranged within the slots 36A, 36B when the foldable portion 506 is in a use configuration. In some embodiments, the connection between the ends 506A, 506B and the slots 36A, 36B can be in the form of a positive mechanical connection, friction fit, or other suitable mechanical engagement, similar to cleaning head 200. In some embodiments, to fully secure the cleaning head 500 to the connector 36, both the ends 506A, 506B must be secured to the slots 36A, 36B and the pocket 516 must be secured on the portion 17'. A release mechanism can also be provided for releasing the cleaning head from the connector on the device.

FIGS. 33-36 illustrate another embodiment of cleaning head 600 having a support structure 604 and a dirt collection chamber 602 to collect debris removed from the surface, similar to the cleaning head 200. The illustrated support structure 604 is in the form of a planar rectangular sheet, e.g., a cardboard sheet, that includes a foldable portion 606, which is arranged on a single side of the support structure 604. In this embodiment, the support structure 604 has a length extending between the leading and trailing edges that is reduced, such that a length of the support structure is significantly less than that of the cleaning sheet. The support structure extends along only the front or leading portion of the cleaning head. A suction inlet can be arranged in the foldable portion 606 to allow debris to be suctioned into the dirt collection chamber 602. A valve may be arranged within the suction inlet in order to prevent debris from falling back through the suction inlet.

The dirt collection chamber 602 can have a similar configuration to the aforementioned dirt collection chambers, however in this embodiment the dirt collection chamber 602 can be attached to the support structure along the leading edge only. As a result, the remainder of the chamber, which can be folded to form a bag, can extend freely from the support structure. Such a configuration allows a portion of the connector on the device to extend between the bag and the cleaning sheet to facilitate attachment, as will be discussed below. As with prior embodiments, the dirt collection chamber can be made from a permeable material to allow unfolding of the dirt collection chamber 602 under suction.

As further shown, the cleaning sheet 612 may be attached to the lower surface of the cleaning head 600 at the support structure 604. The lower surface of the support structure may be positioned opposite to the surface on which the dirt collection chamber is attached to the support structure. Due to the reduced length of the support structure, the support structure is only attached to the leading portion of the cleaning sheet.

In order to removably attach the cleaning head 600 to the connector 46, the connector 46 can include a lower support structure 47 and an upper housing structure defining a confinement volume therein arrange to receive the chamber. With the chamber 602 arranged within the confinement volume, the foldable portion 606 will extend along the leading edge, and the cleaning pad 612 will extend along the underside of the lower support structure 47. This arrangement separates the dirt collection chamber 602 from the cleaning pad 612, and allows for a shorter support structure 604 to be used since the confinement volume can support the dirt collection chamber 602 and the lower support structure 47 can support the cleaning pad 612 while in use.

Figure 37:
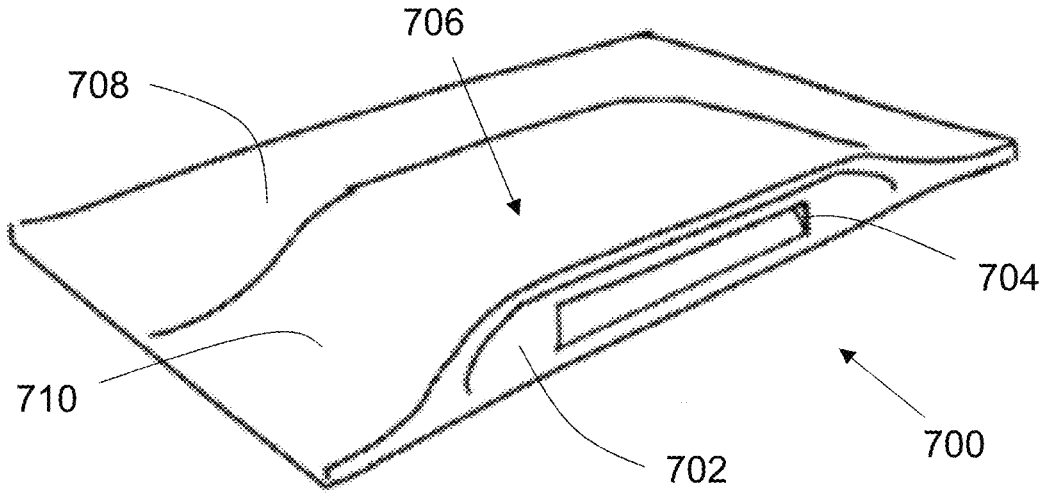
FIG. 37 is a top perspective view of a cleaning head according to another embodiment.
Figure 38:
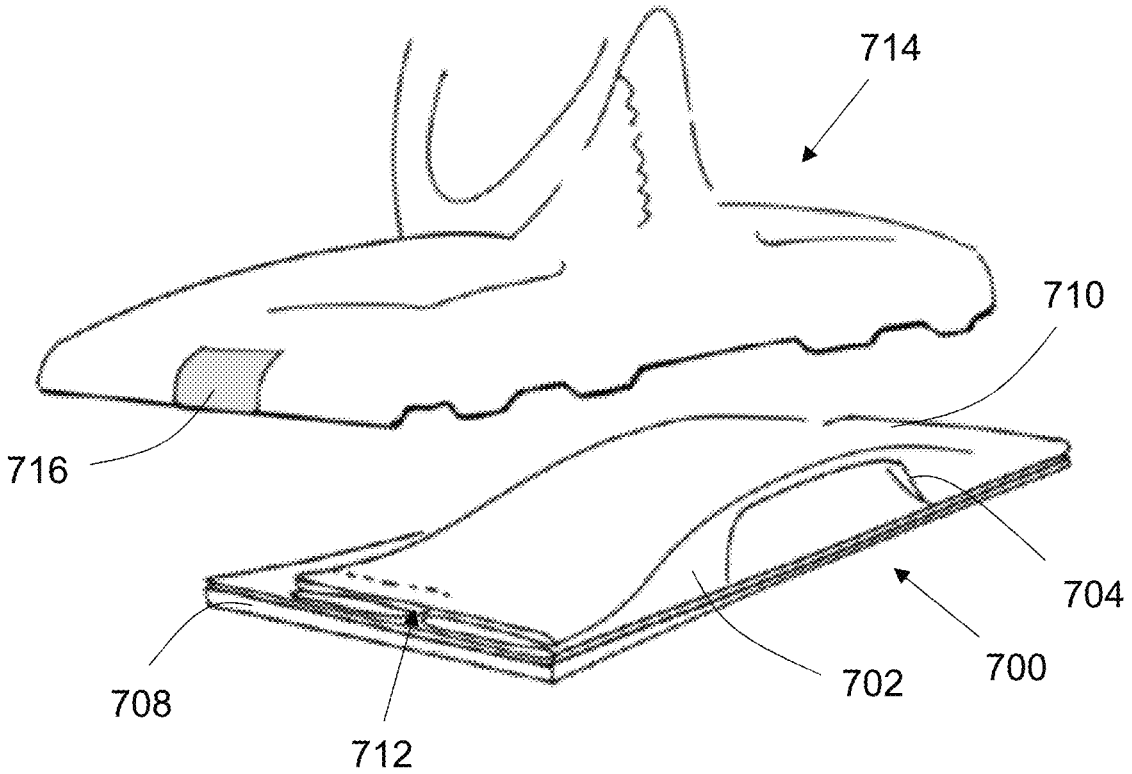
FIG. 38 is a top perspective view of the cleaning head of FIG. 37 about to be attached to another embodiment of a connector housing of a cleaning device.

As stated above, the cleaning heads can have a variety of configurations. FIGS. 37-38 depict another embodiment of a cleaning head 700. The cleaning head 700 includes a front wall 702, a nozzle 704 arranged in the front wall 702, a dirt collection chamber 706, and a cleaning pad 708. The dirt collection chamber 706 can be formed from a single piece of material 710 arranged over and secured to a support structure 712. During transportation and storage, the front wall 702 is folded parallel to the cleaning pad 708. When the front wall 702 is folded to be substantially perpendicular to the cleaning pad 708, the material 710 is raised up, creating a cavity between the support structure 712 and the material 710 to form the dirt collection chamber 706. As the connector 714 is arranged on the cleaning pad 708, a tab 716, arranged on the side of the connector 714, can deform or pivot in order to clasp the support structure 712 of the cleaning head 700 to secure the cleaning head 700 to the connector 714.

Figure 39:
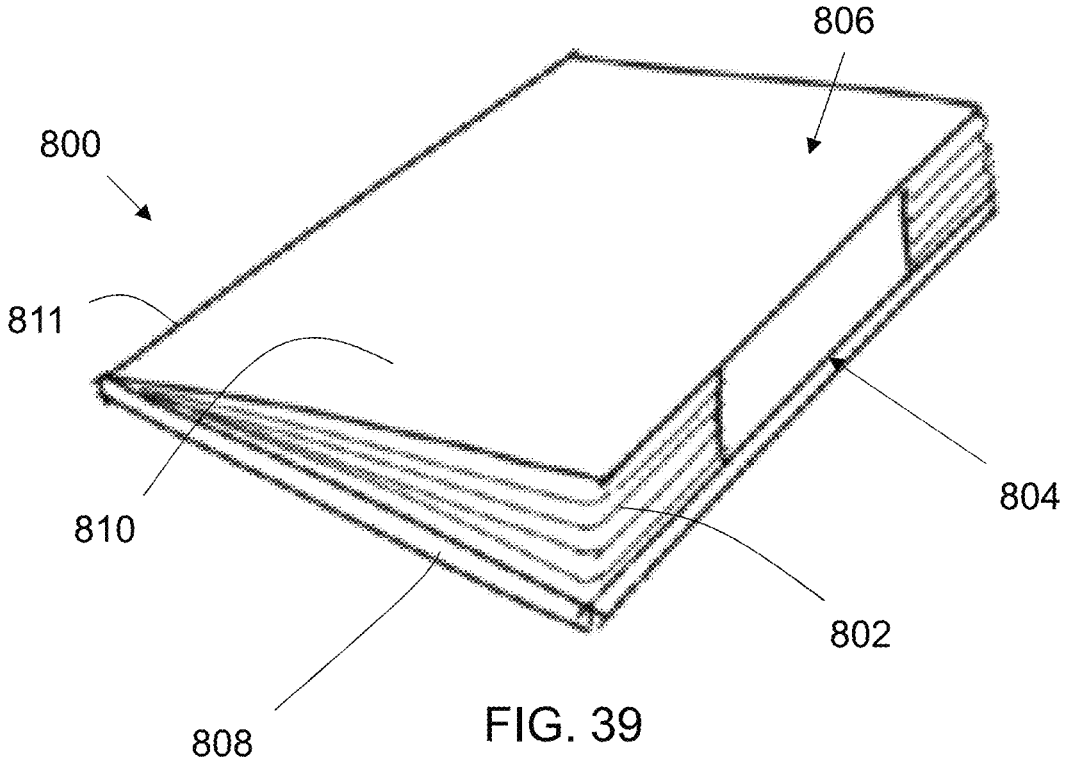
FIG. 39 is a top perspective view of a cleaning head according to another embodiment.
Figure 40:
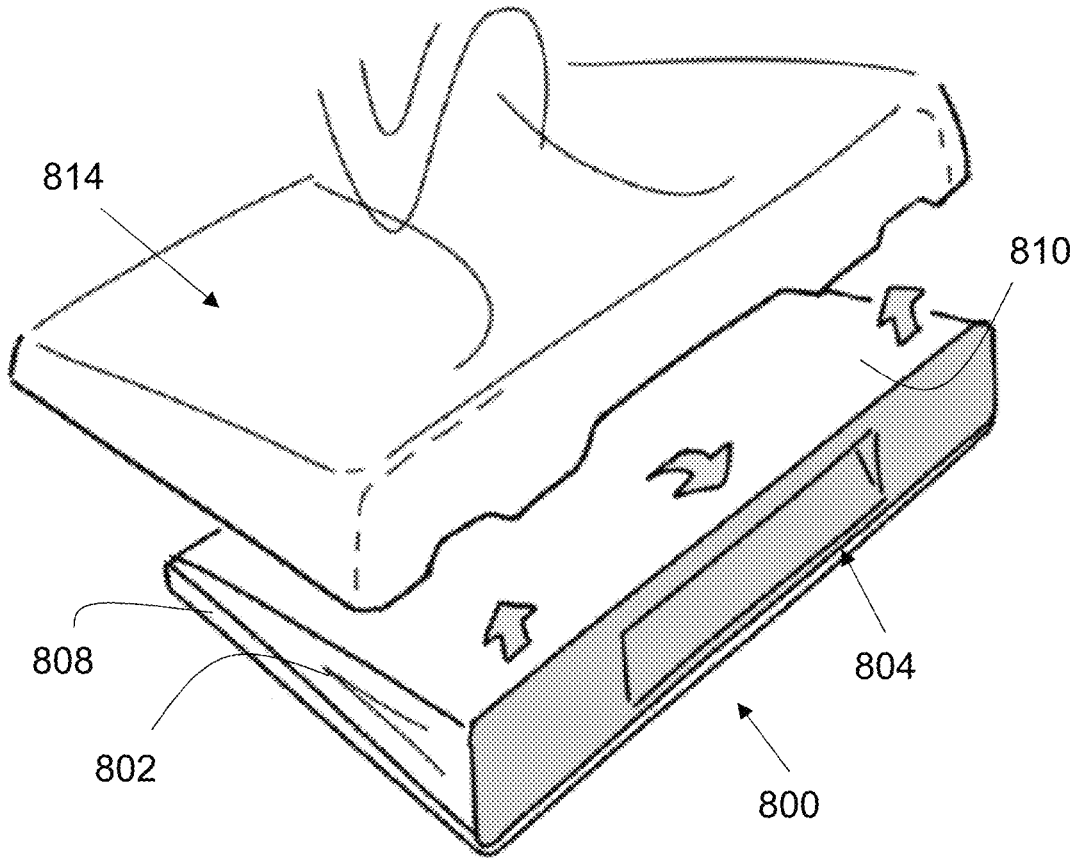
FIG. 40 is a top perspective view of the cleaning head of FIG. 39 about to be attached to another embodiment of a connector housing of a cleaning device.

FIGS. 39-40 depict another embodiment of a cleaning head 800. The cleaning head 800 includes a pleated wall 802, a nozzle 804 arranged in the pleated wall 802, a dirt collection chamber 806, and a cleaning pad 808. The dirt collection chamber 806 can be formed from a top wall 810 and the cleaning pad 808, with the pleated wall 802 encapsulating the sides and front of the dirt collection chamber 806. The pleated wall 802 can include multiple folds, or can include no folds. Additionally, the top wall can be formed partially or fully from a filter material. During transportation and storage, the top wall 810 is folded parallel to the cleaning pad 808 at a hinged edge 811. When the top wall 810 separated from the cleaning pad 808, the pleated wall 802 extends at the pleats in order to expand the increased distance between the cleaning pad 808 and the top wall 810. In some embodiments, the top wall 810 can be raised and the pleated wall 802 expanded after the cleaning head 800 is attached to the connector 814. In certain embodiments, a suction force passing through the connector can create the force required to expand the pleated wall 802, creating a cavity between the cleaning pad 808 and the top wall 810 to form the dirt collection chamber 806. In an alternative embodiment, the dirt collection chamber is in the form of a foldable bag having a stiff front formed from cardboard or cardstock. The stiff front can be used to guide the cleaning head 800 into the cleaning device, and is secured to the cleaning device via the stiff front.

Figure 41:
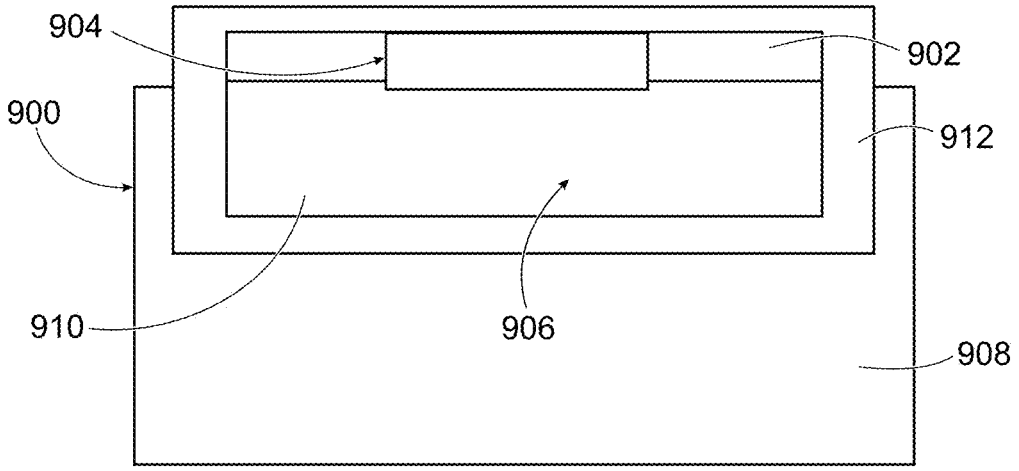
FIG. 41 is a schematic view showing a cleaning head of a cleaning device.
Figure 42:
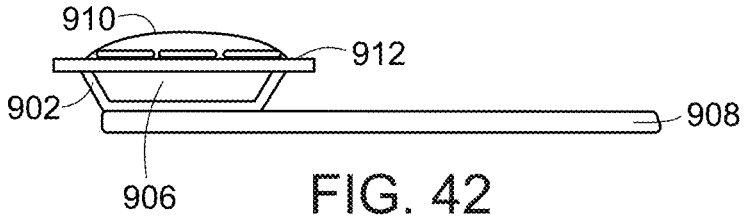
FIG. 42 is a side view of the cleaning head of FIG. 41.
Figure 43:
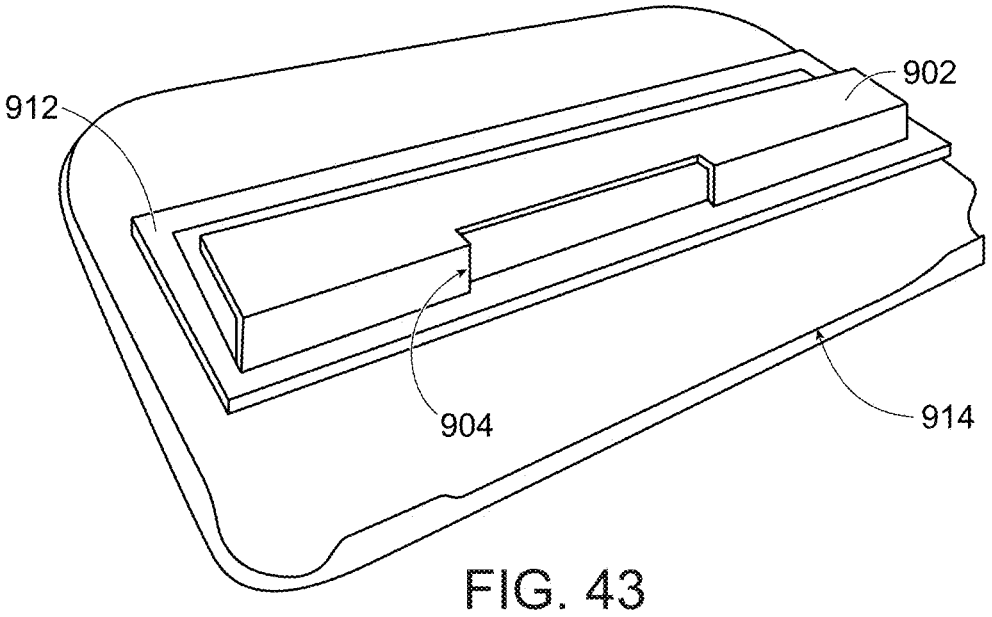
FIG. 43 is a bottom perspective view of the cleaning head of FIG. 41 attached to another embodiment of a connector housing of a cleaning device.

FIGS. 41-43 depict another embodiment of a cleaning head 900. The cleaning head 900 includes a front wall 902, a nozzle 904 arranged in the front wall 902, a self-opening dust cup 906, and a cleaning pad 908. In this embodiment, the dirt collection chamber can include the self-opening dust cup 906 which opens up when placed under suction when the cleaning head 900 is arranged on a connector 914. The dust cup 906 includes a filter member 910 and a support structure 912 to support the filter member 910, where the filter member 910 is configured to allow a suction force to pass therethrough.

Figure 23:
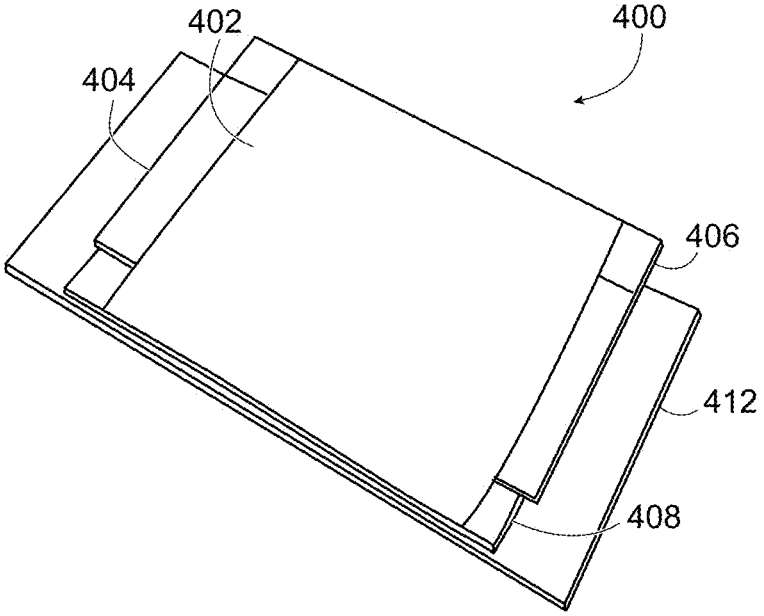
FIG. 23 is a top perspective view of a cleaning head according to another embodiment.
Figure 24:
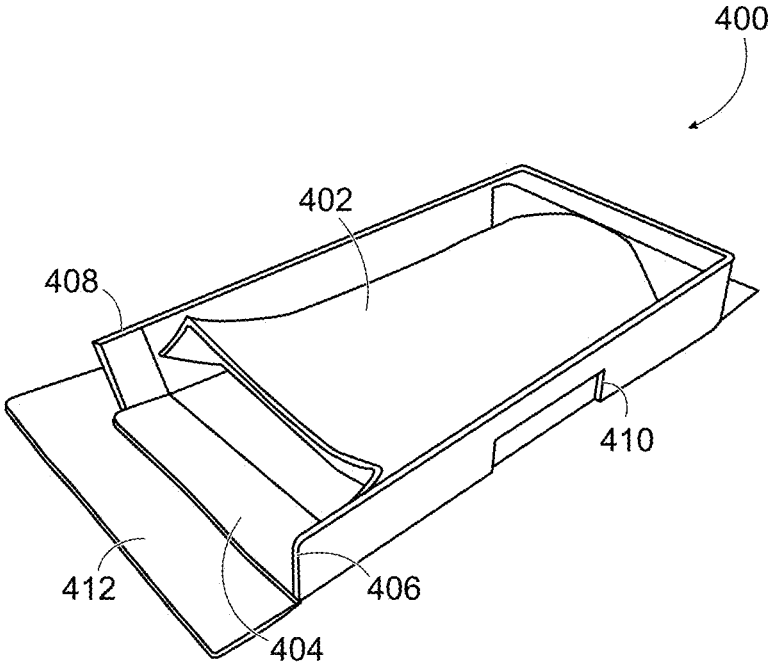
FIG. 24 is a top perspective view of the cleaning head of FIG. 23 in a folded configuration.
Figure 25:
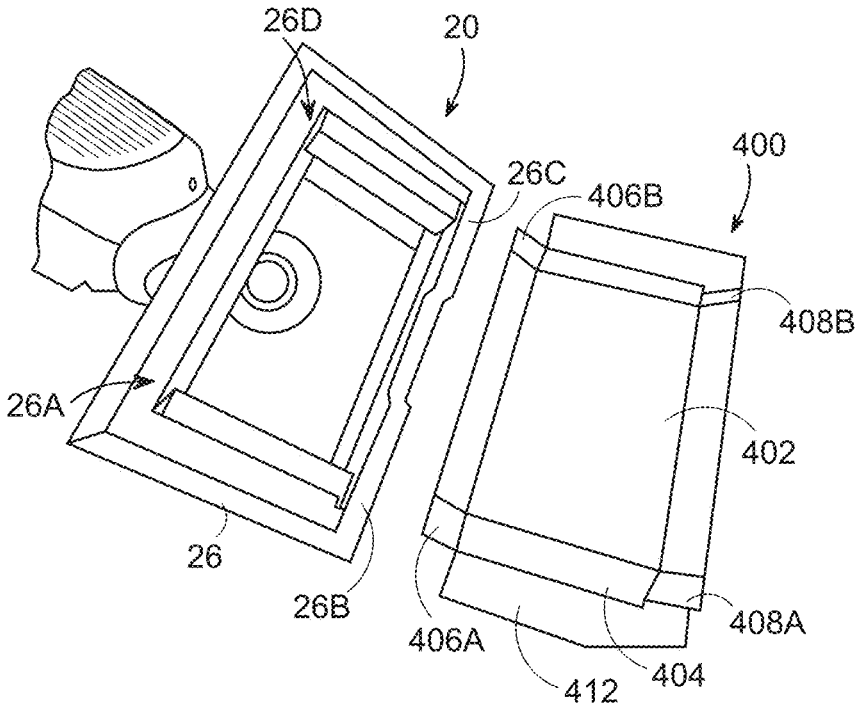
FIG. 25 is a top perspective view of the cleaning head of FIG. 24 about to be attached to another embodiment of a connector housing of a cleaning device.
Figure 26:
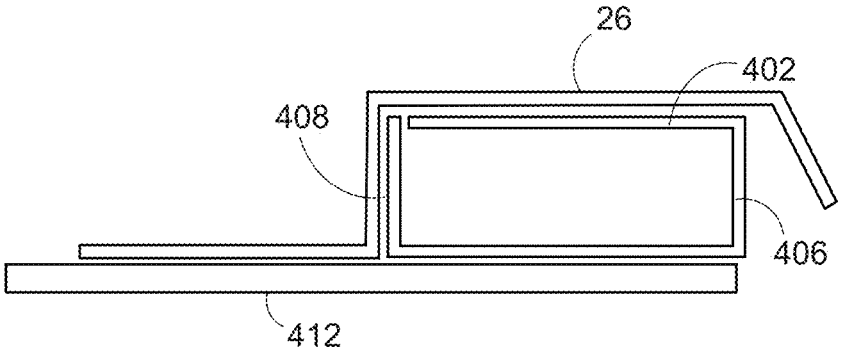
FIG. 26 is a schematic view showing the cleaning head mated to the connector housing of FIG. 25.
Figure 27:
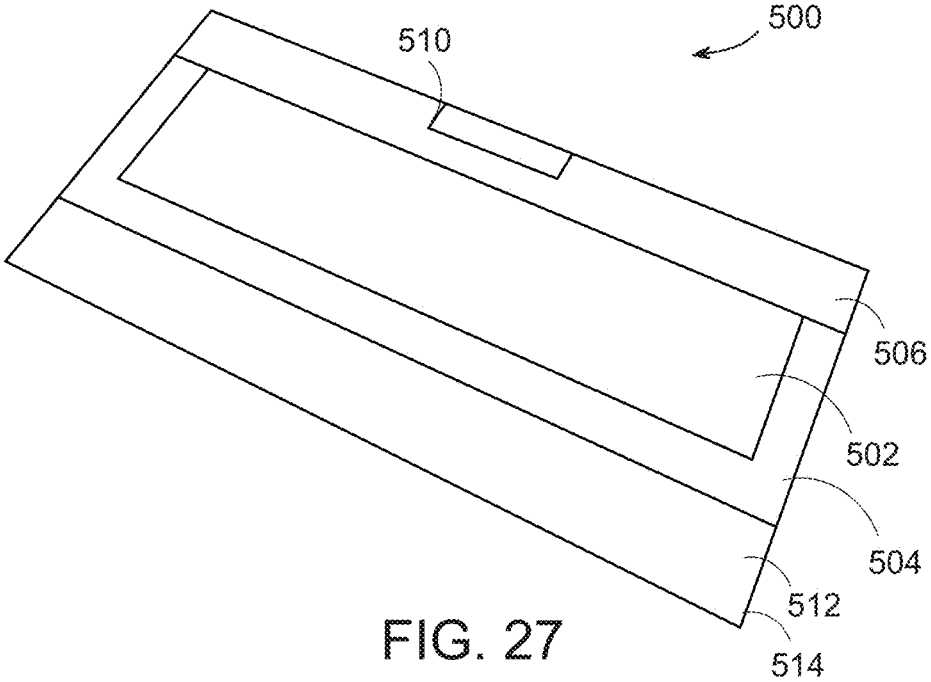
FIG. 27 is a top perspective views of a cleaning head according to another embodiment.
Figure 28:
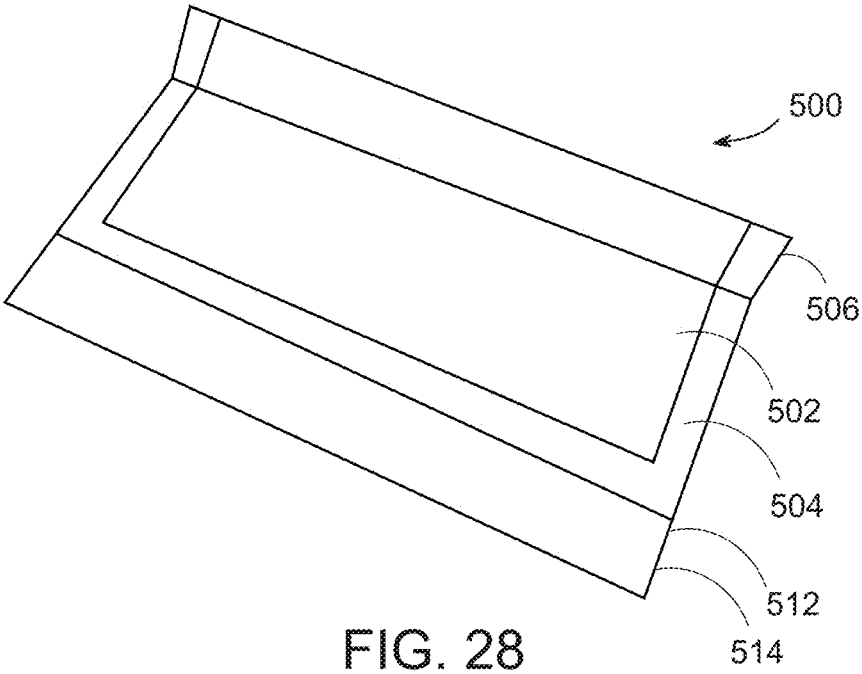
FIG. 28 is a top perspective view of the cleaning head of FIG. 27 in a folded configuration.
Figure 29:
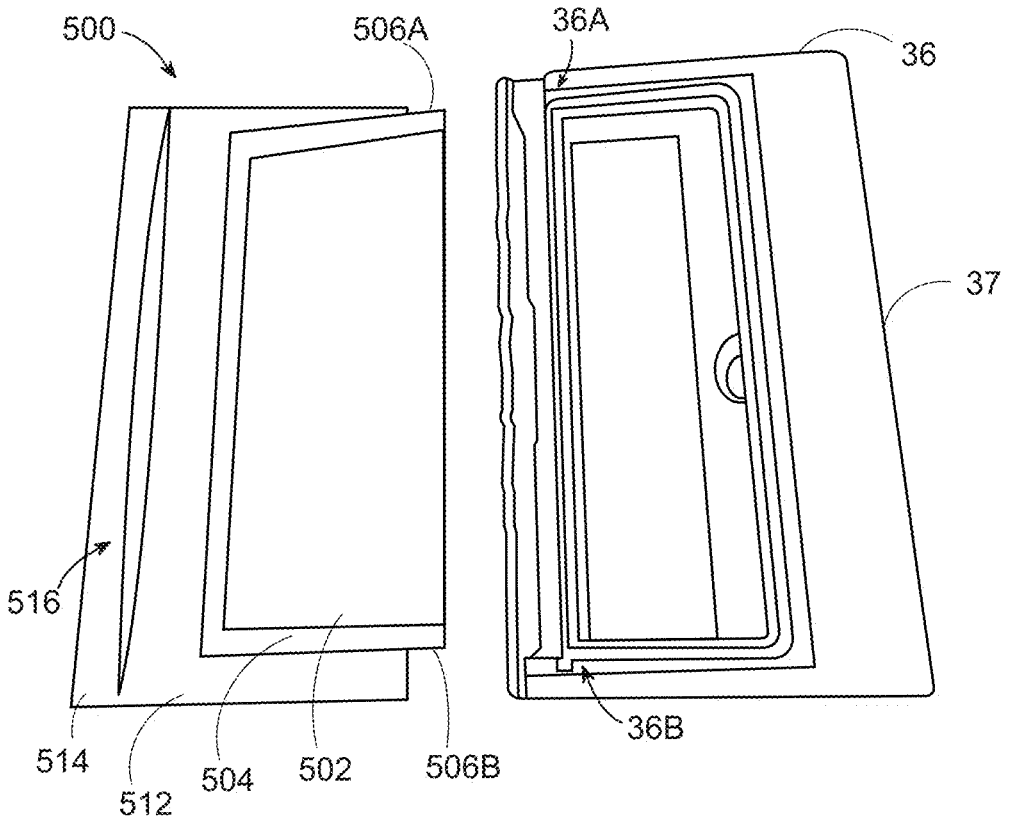
FIG. 29 is a top perspective view of the cleaning head of FIG. 28 about to be attached to another embodiment of and a connector housing of a cleaning device.
Figure 30:
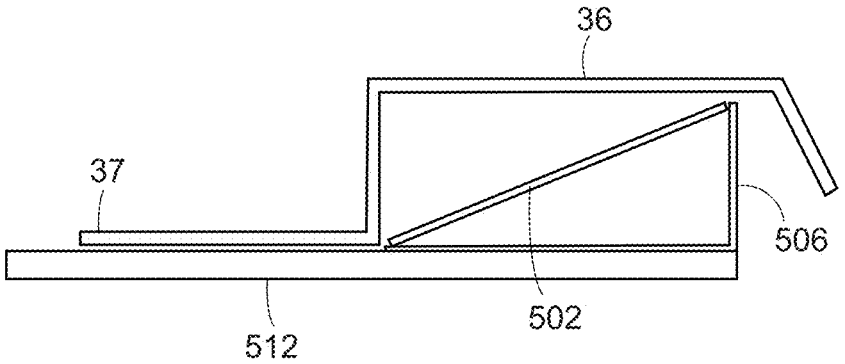
FIG. 30 is a schematic view showing the cleaning head mated to the connector housing of FIG. 29.
Figure 31:
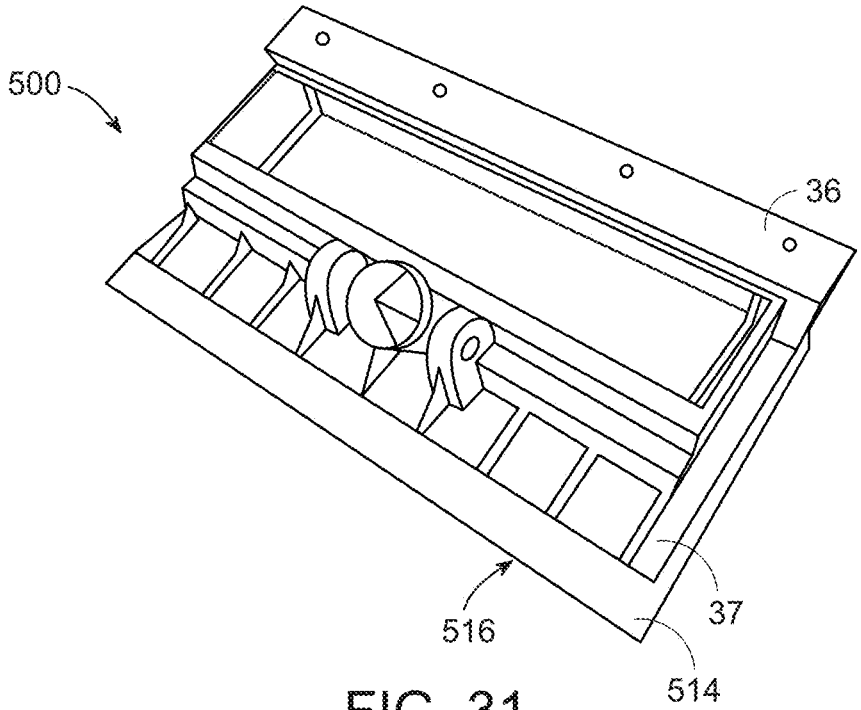
FIG. 31 is a top perspective view of the cleaning head mated to the connector housing of FIG. 29.
Figure 32:
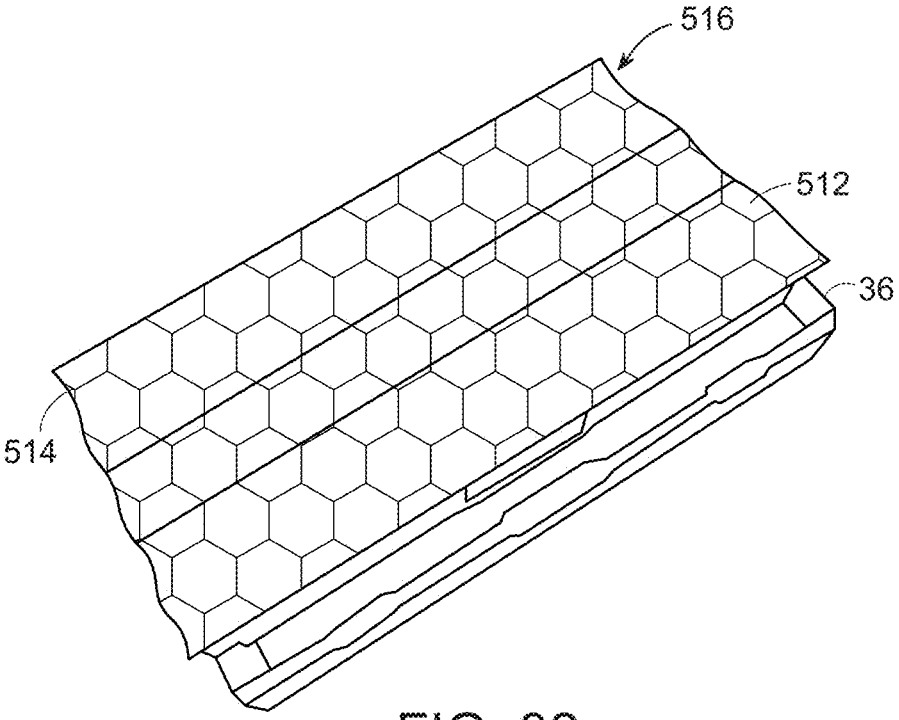
FIG. 32 is a bottom perspective view of the cleaning head mated to the connector housing of FIG. 29.
Figure 33:
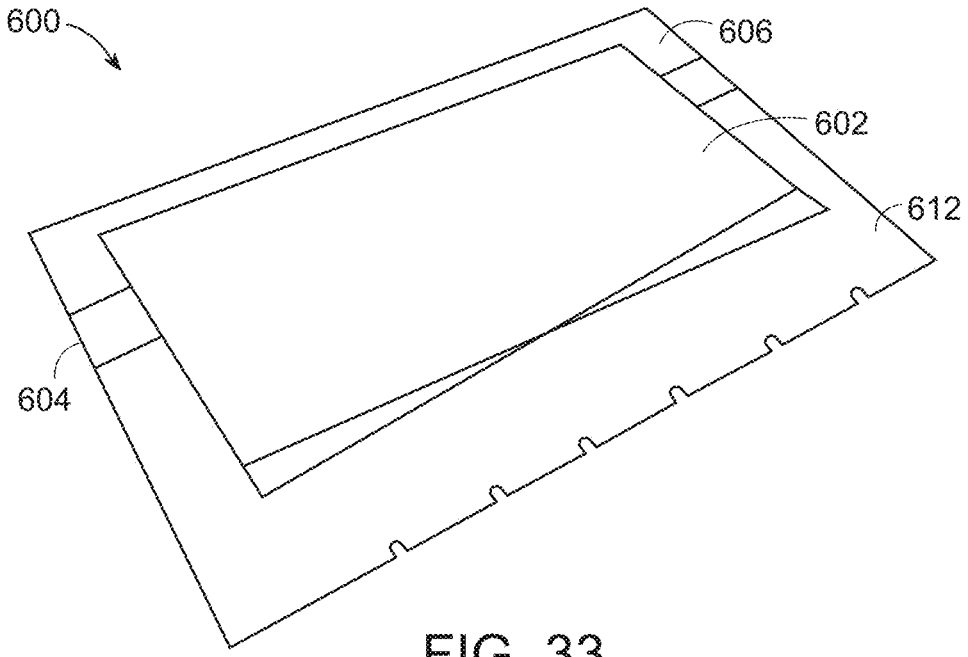
FIG. 33 is a top perspective view of a cleaning head according to another embodiment.
Figure 34:
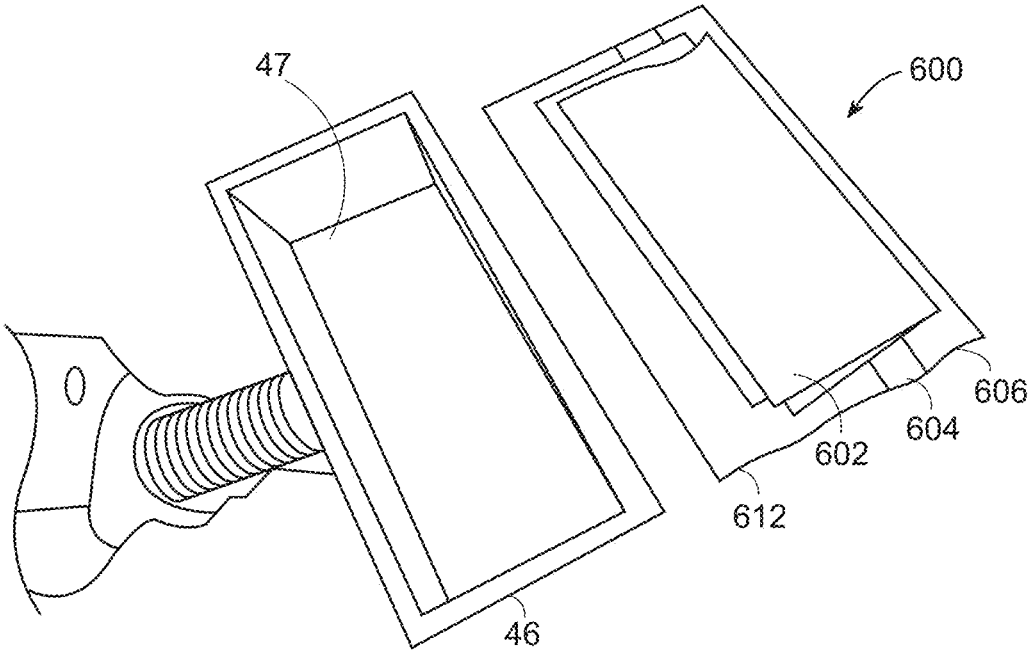
FIG. 34 is a top perspective view of the cleaning head of FIG. 33 about to be attached to another embodiment of a connector housing of a cleaning device.
Figure 35:
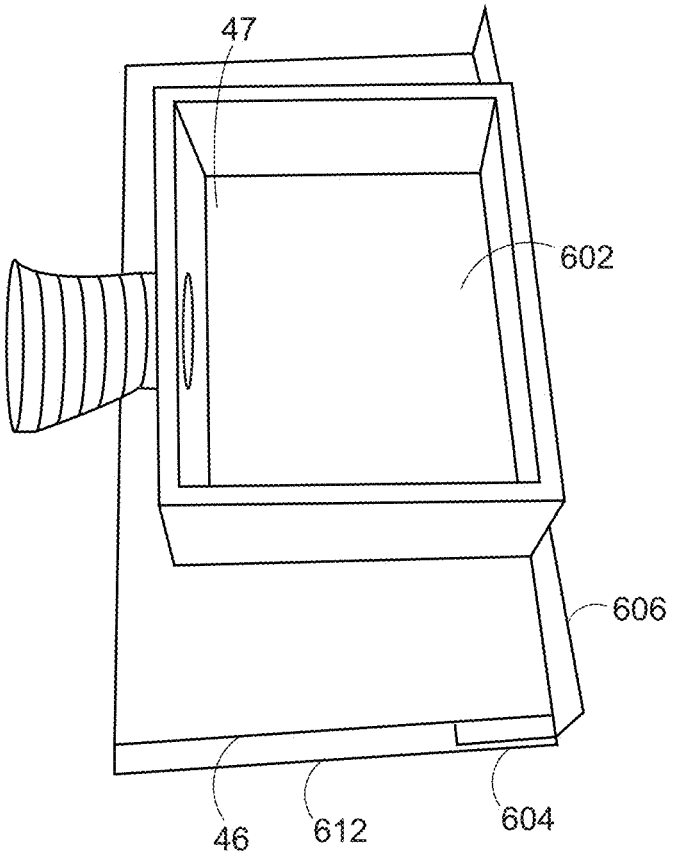
FIG. 35 is a top perspective view of the cleaning head mated to the connector housing of FIG. 34.
Figure 36:
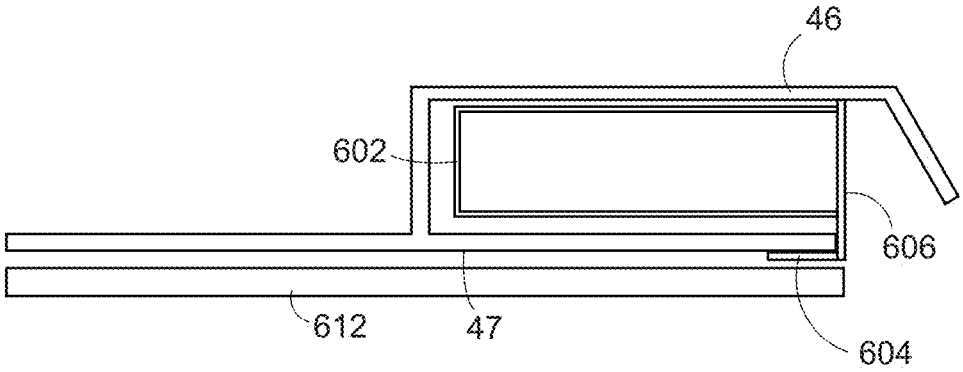
FIG. 36 is a schematic view showing the cleaning head mated to the connector housing of FIG. 35.
Figure 44:
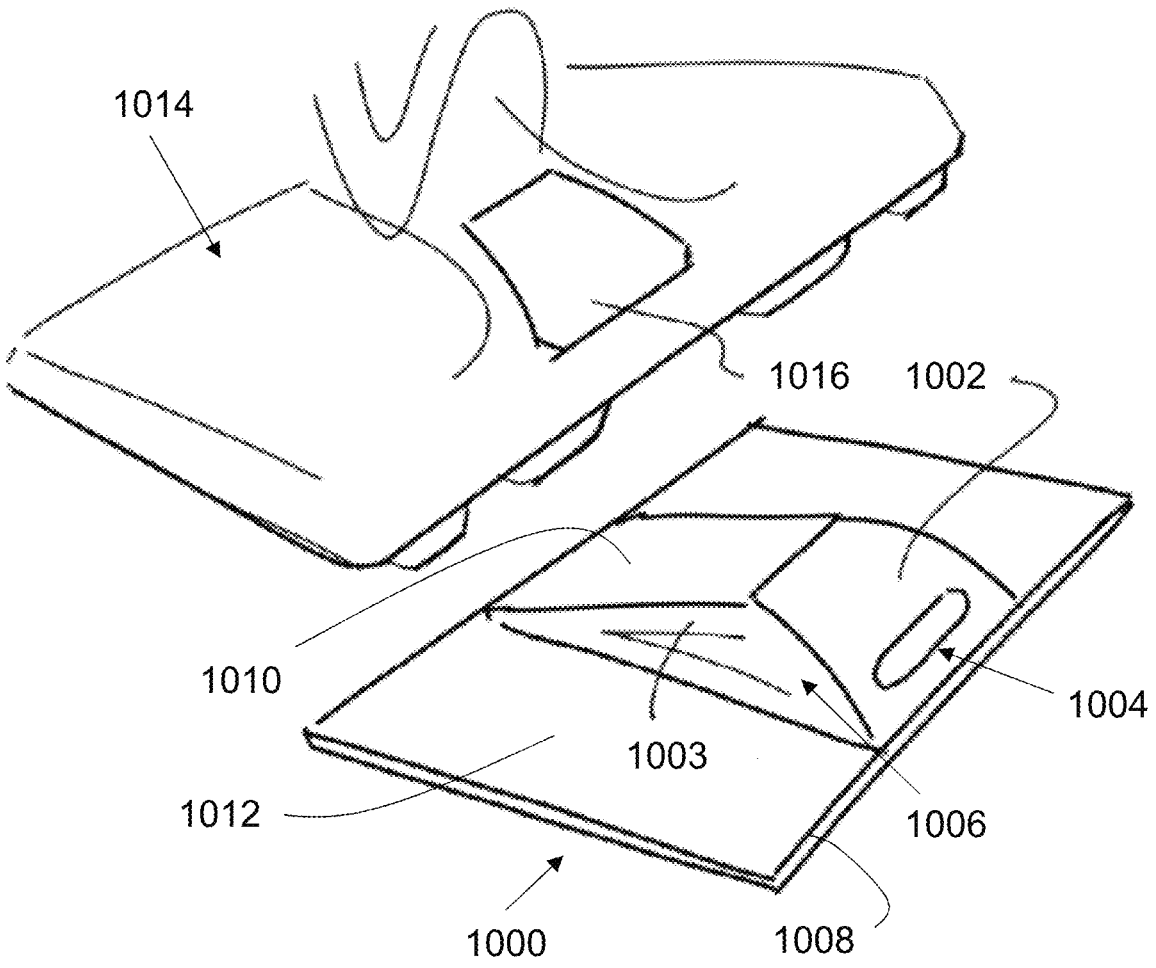
FIG. 44 is a top perspective view of a cleaning head about to be attached to another embodiment of a connector housing of a cleaning device.

FIG. 44 depicts another embodiment of a cleaning head 1000. The cleaning head 1000 includes a front wall 1002, a pleated side wall 1003, a nozzle 1004 arranged in the front wall 1002, a dirt collection chamber 1006, a cleaning pad 1008, a top wall 1010, and a support structure 1012. The front wall 1002 can be a clear window in order to see the contents of the dirt collection chamber 1006. FIG. 23 is a perspective view of another exemplary embodiment of a cleaning head. In this embodiment, the dirt collection chamber 1006 is a foldable bag secured to the stiff front wall 1002. The dirt collection chamber 1006 is arranged such that the chamber is substantially within the middle of the cleaning head 1000 and extends from the front edge to the back edge of the cleaning head 1000. Additionally, the connector 1014 connected to the cleaning head 100 includes a front window 1016 as to no obstruct the view through the front wall 1002.

Figure 45:
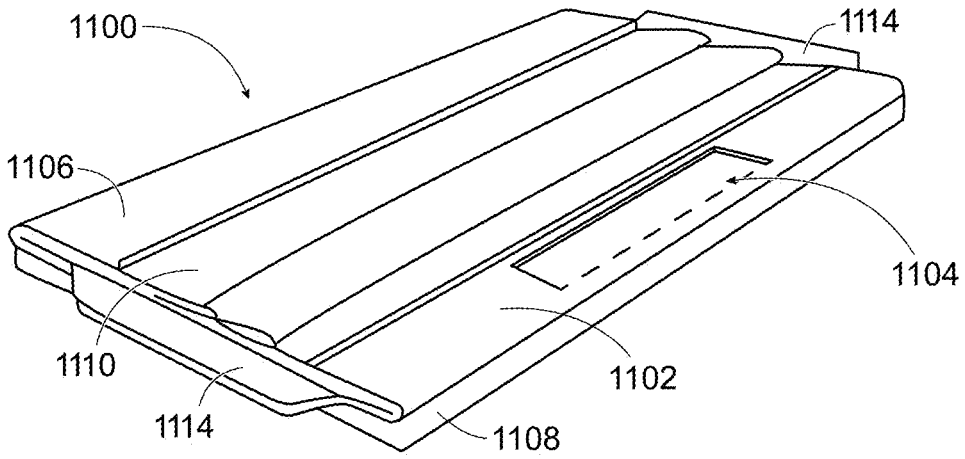
FIG. 45 is a top perspective view of a cleaning head according to another embodiment in an unfolded configuration.
Figure 46:
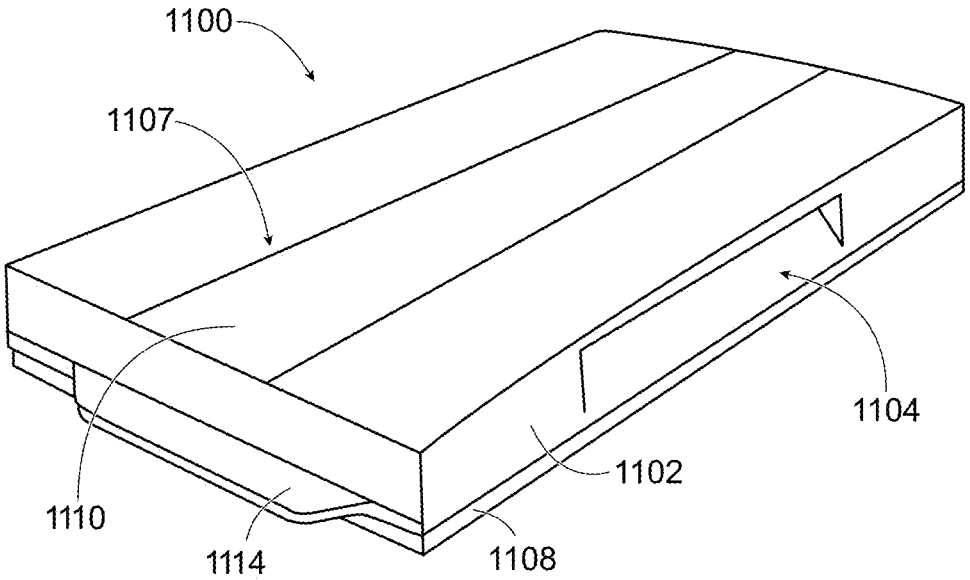
FIG. 46 is a top perspective view of the cleaning head of FIG. 45 in a folded configuration.

FIGS. 45-46 depict another embodiment of a cleaning head 1100. The cleaning head 1100 includes a front wall 1102, a nozzle 1104 arranged in the front wall 1102, a back wall 1106, a cleaning pad 1108, and a top wall 1110. The top wall 1110 can include pleats which allow the top wall 1110 to expand when the cleaning head 1100 is unfolded. The front wall 1102, back wall 1106, and top wall 1110 encapsulate a dirt collection chamber 1107. In this embodiment, the dirt collection chamber 1107 can be formed from stiff material that has been folded for shipping. The folded material can be unfolded in order to form an internal volume as the dirt collection chamber 1107. The shape of the dirt collection chamber 1107 depends on the folds used to form the cleaning head 1100. The cleaning head 1100 can further include tabs 1114 which snap into a retention feature on a cleaning device to secure the cleaning head 1100 within the cleaning device.

Figure 47:
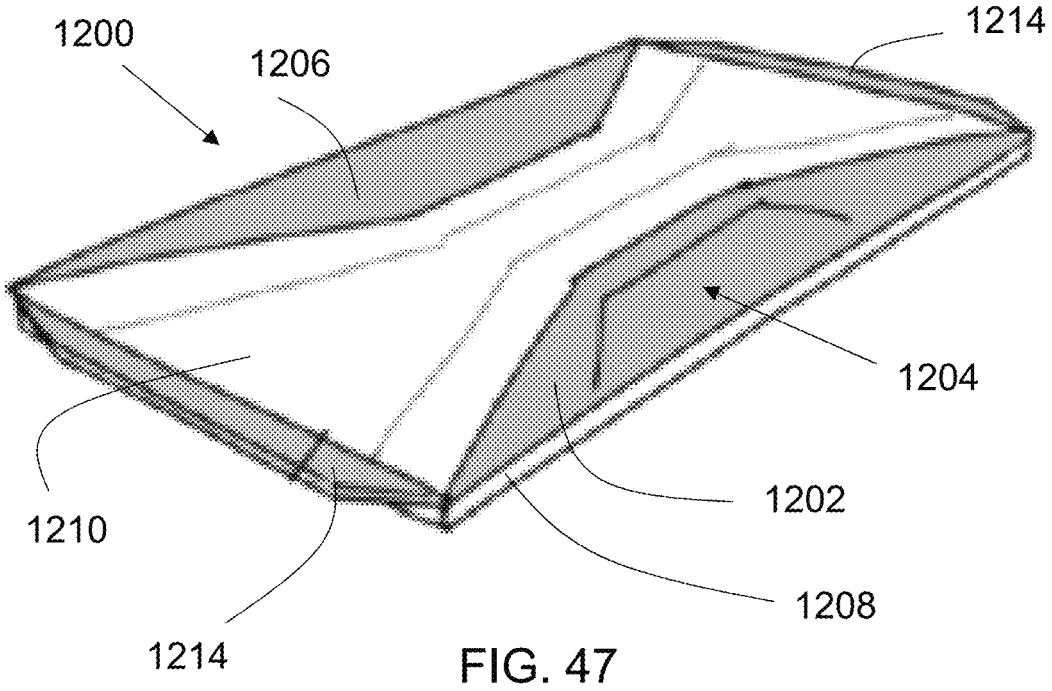
FIG. 47 is a top perspective view of a cleaning head according to another embodiment in an unfolded configuration.
Figure 48:
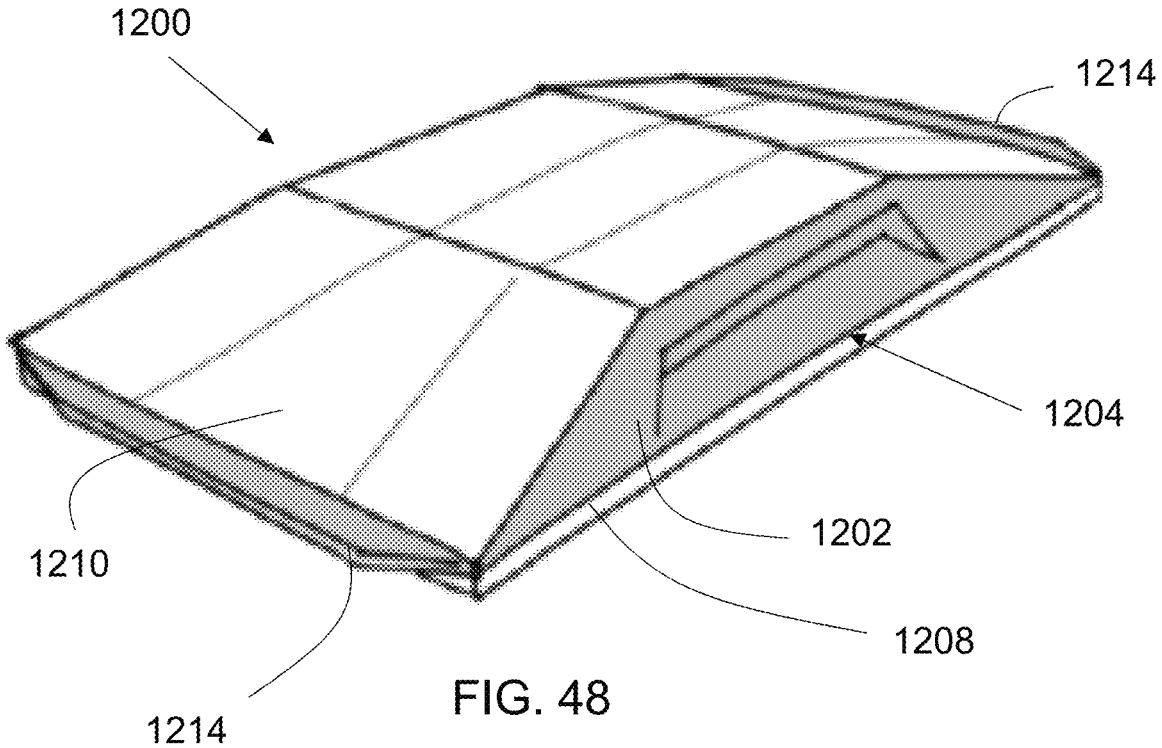
FIG. 48 is a top perspective view of the cleaning head of FIG. 47 in a folded configuration.
Figure 49:
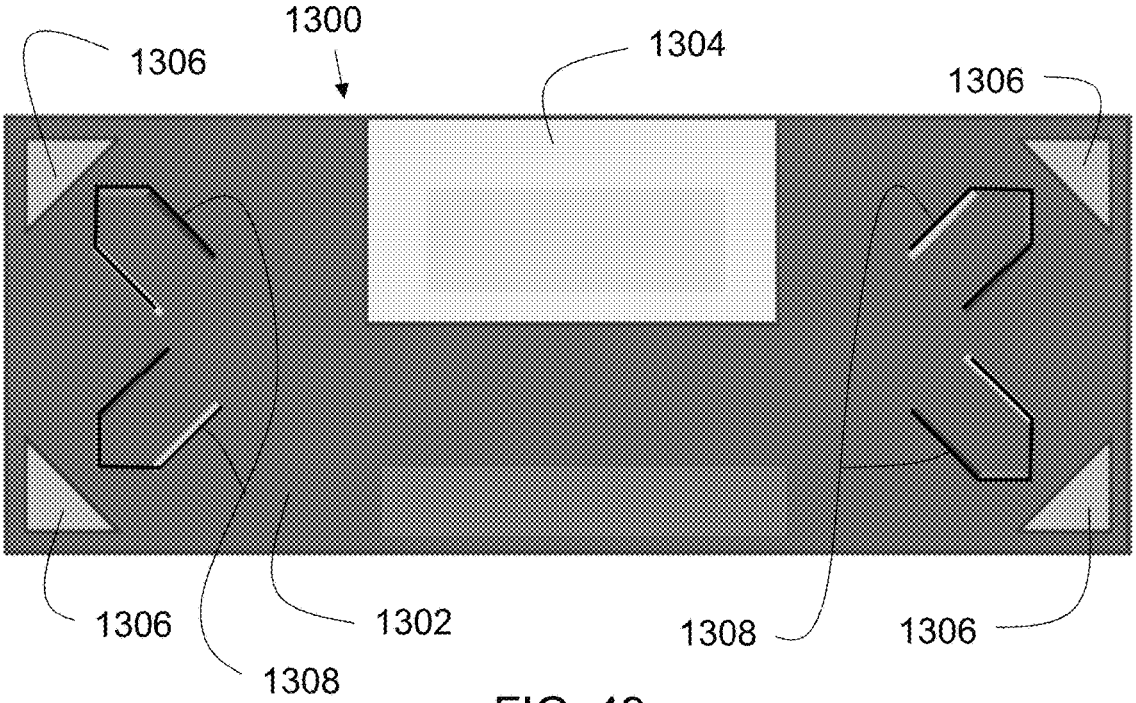
FIG. 49 is a schematic view showing a cleaning head and connector housing according to another embodiment in a disengaged position.
Figure 50:
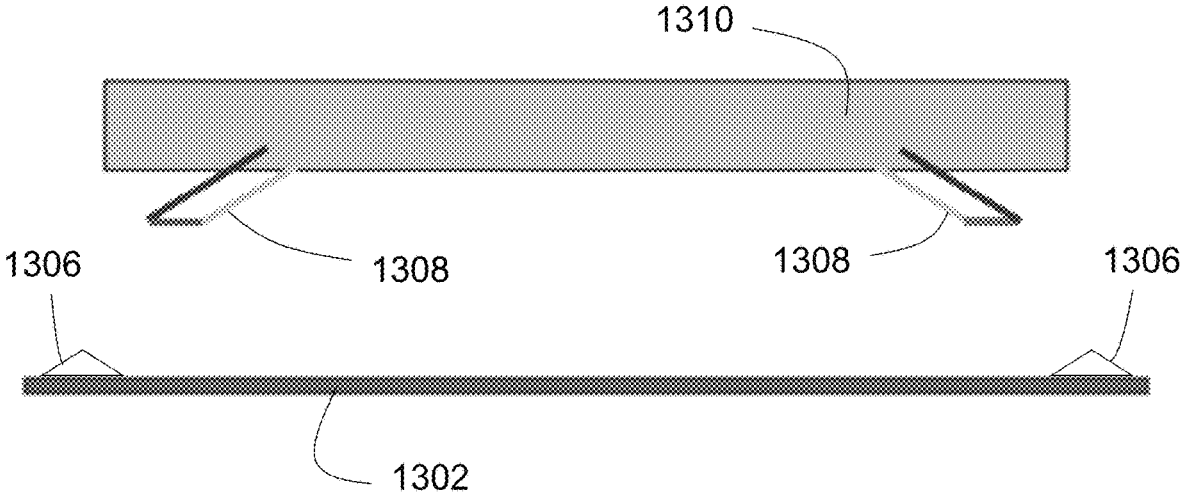
FIG. 50 is a schematic view showing the cleaning head and connector housing of FIG. 49 in a disengaged position.
Figure 51:
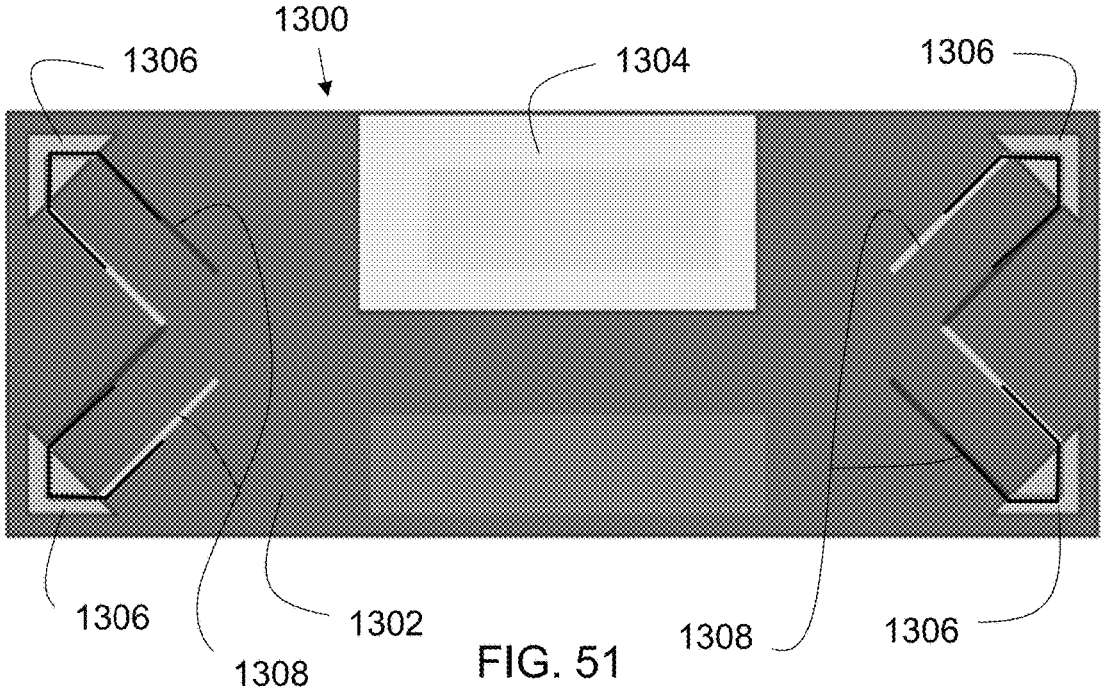
FIG. 51 is a schematic view showing the cleaning head and connector housing of FIG. 49 in an engaged position.
Figure 52:
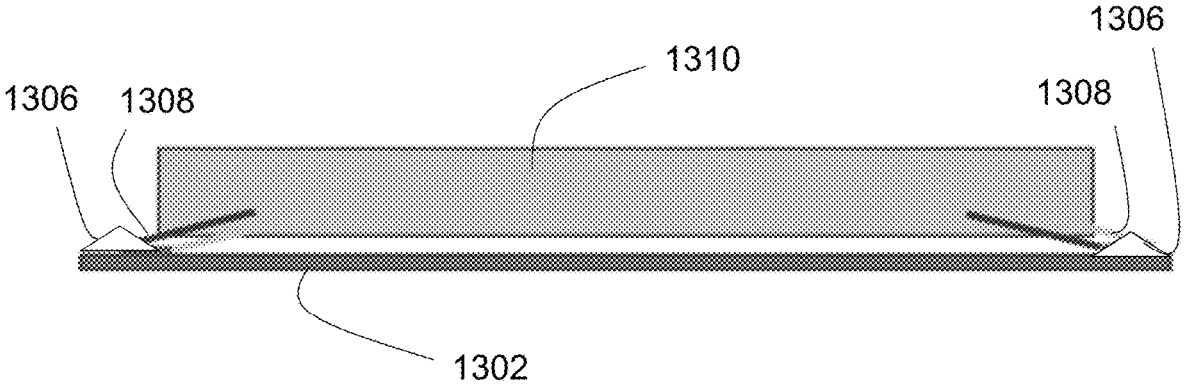
FIG. 52 is a schematic view showing the cleaning head and connector housing of FIG. 51 in an engaged position.

FIGS. 47-48 depict another embodiment of a cleaning head 1200. The cleaning head 1200 is substantially similar to the cleaning head 1100. Therefore, similar components will not be discussed. The cleaning head 1200 includes a front wall 1202, a nozzle 1204 arranged in the front wall 1202, a back wall 1206, a cleaning pad 1208, and a top wall 1210. The cleaning head 1200 can further include tabs 1214 which snap into a retention feature on a cleaning device to secure the cleaning head 1200 within the cleaning device. The difference between the cleaning head 1100 and the cleaning head 1200 is that the top wall 1210 is formed from distinct panels, forming a trapezoidal shape for the dirt collection chamber.

FIGS. 49-52 depict another embodiment of a cleaning head 1300. The cleaning head 1300 includes a cleaning pad 1302, a dirt collection chamber 1304, and multiple attachment points 1306 arranged at the corners of the cleaning pad 1302. The attachment points are configured to allow the attachment arms 1308 of a connector 1310 to slide within each of the attachment points 1306. The attachment arms 1308 of the connector 1310 can slide inward and outward such that when a user places the cleaning head 1300 on the floor, a user can place the connector 1310 on the top of the cleaning head 1300 and then actuate the attachment arms 1308 to extend into the attachment points 1306. The attachment points 1306 can be pockets attached to the cleaning pad 1302, indents in the cleaning pad 1302, or a form of attachment feature, such as hook and loop fasters.

Figure 53:
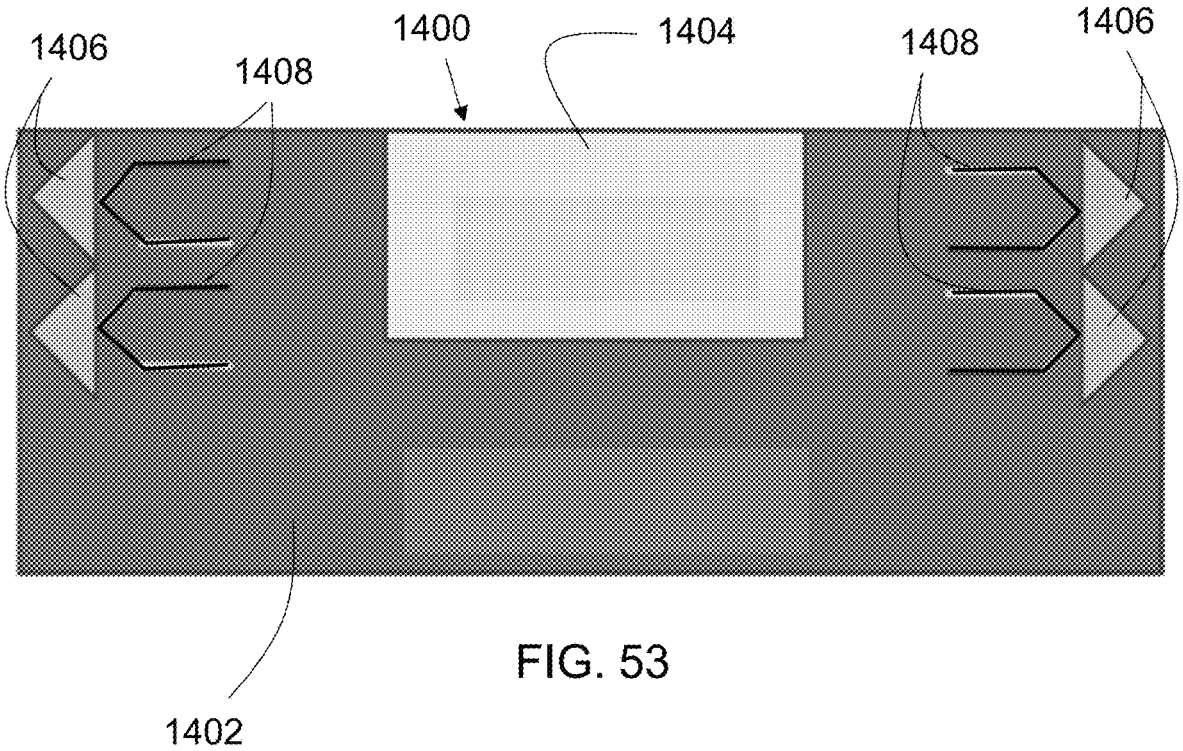
FIG. 53 is a schematic view showing a cleaning head and connector housing according to another embodiment in a disengaged position.

FIG. 53 depicts another embodiment of a cleaning head 1400. The cleaning head 1400 is substantially similar to the cleaning head 1300, expect that the attachment points 1306 are arranged on the sides of the cleaning head 1402 in a line, parallel and next to the dirt collection chamber 1404, instead of being angled outward in the corners. As such, the attachment arms 1408 would move outward parallel to the front edge of the cleaning head 1402 instead of diagonally to the corners.

Another exemplary embodiment of a cleaning head can include a dirt collection chamber in the form of a box formed from a stiff material, such as cardboard or cardstock. The top of the dirt collection chamber can include a filter, which can be a permeable material which allows suction to be applied through the filter to the dirt collection chamber. The dirt collection chamber can also include tabs or slots arranged on the sides of the dirt collection chamber in order to secure the cleaning head to the cleaning device. The dirt collection chamber can also be secured to a cleaning pad.

In another exemplary embodiment of a cleaning head, the dirt collection chamber is in the form of a foldable box formed from a stiff material, such as cardboard or cardstock. The top of the dirt collection chamber includes a filter. The dirt collection chamber can be folded during transportation for increased shipping efficiency. When desired to be used the dirt collection chamber can be unfolded to create an internal volume. In order to keep the dirt collection chamber in a use configuration, end tabs, which can be integral to the dirt collection chamber, can be folded towards the internal volume of the dirt collection chamber to prevent collapse of the chamber.

In another exemplary embodiment of a cleaning head, the dirt collection chamber is in the form of a foldable box which is manufactured separately from the cleaning pad. When desired to be used, the dirt collection chamber can be unfolded and secured to the cleaning pad. The cleaning pad can include pockets or slots which can receive tabs on the dirt collection chamber.

In other exemplary embodiments of a cleaning head, the dirt collection chambers are each in the form of a foldable box. Each dirt collection chamber can further include tabs which are arranged on the top surface of the dirt collection chamber. The tabs can include a slot which the end tabs can fold into to further secure the dirt collection chamber in a use configuration. Additionally, the tabs can extend to allow the cleaning device to snap over the tabs to secure the cleaning head to the cleaning device.

In another exemplary embodiment of a cleaning head, the end tabs of a foldable dirt collection chamber can include two parts extending from the top surface and bottom surface of the chamber. The end tabs can be secured in a use configuration via tap or adhesive arranged on the end tabs. Additionally, the end tabs can be secured using tabs locks, which include one tab portion having a male connector, and other tab having a female connector, such as a slot.

In other exemplary embodiments of a cleaning head, each dirt collection chamber can be reusable, while the cleaning pad is not reusable. The dirt collection chamber can include an opening mechanism which allows for emptying the contents of the dirt collection chamber, such as a hinge connection. Additionally, the dirt collection chamber can include a removable drawer in order to empty the contents of the chamber.

In another exemplary embodiment of a cleaning head, the dirt collection chamber is in the form of a bag having a cleaning pad secured to the chamber. The chamber can include side pockets which allow arms of the cleaning device to slide within in order to secure the cleaning head to the cleaning device.

In another exemplary embodiment of a cleaning device, the cleaning device can include a vacuum mode and a mop mode. The handle of the cleaning device can be used to engage the vacuum mode or the mop mode, where suction is only applied in the vacuum mode and the cleaning pad is retracted into the cleaning device.

In other exemplary embodiments of a cleaning head, the dirt collection chamber is a foldable bag, and the cleaning head includes a semi-rigid layer that tucks into the front, rear, and sides of the cleaning device. Additionally, in some embodiments, the cleaning head can include tabs which extend through the cleaning device to further secure the cleaning head to the cleaning device.

In other exemplary embodiments of a cleaning head, the cleaning head can be formed from minimal stiff material. The dirt collection chamber can be a foldable bag and include a partial from portion made from a stiff material. The cleaning head can further include tabs which snap into a retention feature on the cleaning device to secure the cleaning head within the cleaning device.

Various methods for forming a cleaning head are also provided herein. In general, a cleaning head can be manufactured in a flat, unfolded configuration to maximize shipping efficiency and cost. The cleaning head is then unfolded when desired to be used with a cleaning device, where the unfolding of the cleaning head creates an internal volume within the dirt collection chamber. The cleaning head can then be secured to the connector of the cleaning device and used with suction and a cleaning pad. When the cleaning head has been sufficiently soiled, the cleaning head, including the dirt collection chamber and the cleaning pad can be removed from the cleaning device and disposed of A new cleaning pad can then be unfolded and attached to the cleaning device to be used.

For purposes herein, dirt being suctioned into the dirt collection chamber may include dry and/or wet media. For example, in some embodiments, a liquid applied to the surface may be absorbed by a cleaning sheet and also suctioned by the vacuum into the dirt collection chamber. In some embodiments, the wet media may be absorbed by at least a portion of the material used to form the dirt collection chamber. In some embodiments, the dirt collection chamber may be formed of a material which allows for fluid absorption into the material but does not allow for fluid transfer through the material. In such embodiments, fluid may not travel through the dirt collection chamber. For example, the material used to form the dirt collection chamber may be absorptive on the inner side of the dirt collection chamber, but impermeable.

In some embodiments, the cleaning head includes a support structure to which the dirt collection chamber is attached. In such embodiments, the user may simply attach the cleaning head to the cleaning device, operate the cleaning device to move dirt from the surface and into the dirt collection chamber, remove the cleaning head, and dispose the cleaning head into a trash receptacle. Such a process may be repeated each time the user cleans the surface.

In some embodiments, the cleaning device may include a cleaning sheet and/or a liquid spray assembly to help with cleaning. In such embodiments, because the cleaning head may be the only part of the cleaning device to contact the surface and contain the wet and/or dry debris, the remainder of the cleaning device may remain clean throughout and after operation of the cleaning device.

In some embodiments, the cleaning head includes a suction inlet to move debris from the surface into the dirt collection chamber. In some embodiments, the suction inlet includes a suction nozzle that, in some embodiments, extends laterally across a front of the cleaning head. The suction nozzle may be permanently attached to the cleaning head in some embodiments. For example, the suction nozzle may be integrally formed with the support structure of the cleaning head. The suction nozzle also may be removably attached to the cleaning head in other embodiments. In some embodiments, the suction nozzle is fluidically connected to a vacuum source of the cleaning head.

In some embodiments, the dirt collection chamber is positioned on the upper side of the cleaning head. In some embodiments, the dirt collection chamber protrudes from the upper side of the cleaning head.

In some embodiments, the dirt collection chamber may be arranged to maintain the dirt within the dirt collection chamber once the dirt has been moved into the dirt collection chamber. In some embodiments, the dirt collection chamber includes a lip and internal valve that keeps dust, dry media, and/or wet media within the dirt collection chamber once the dirt has been moved into the chamber, thereby preventing dust and dry media from exiting via the suction inlet, such as when the vacuum is powered off. In some embodiments, the dirt collection chamber may include a selectively openable and closeable valve at or near the air flow conduit. In some embodiments, the valve may include one or more flaps that are pivotable between an open position when the cleaning device is turned on and a closed position when the cleaning device is turned off.

As will be appreciated, in some embodiments, the valve may be integrally formed with at least a portion of the cleaning head. For example, the valve may be integrally formed with the support structure. The valve also may be separately formed and attached to the cleaning head. For example, they valves may be fixedly attached to the dirt collection chamber.

In some embodiments, the cleaning device includes a body having a handle, a vacuum, source, and a connector to connect the cleaning head to the cleaning body. In some embodiments, the connector includes a first engagement element and the cleaning head includes a second engagement element arranged to engage with the first engagement element to connect the cleaning head to the body of the cleaning device. In such embodiments, the cleaning head is held to the connector once the first and second engagement elements are engaged with one another.

In some embodiments, when the cleaning head is attached to the cleaning device, at least a portion of the dirt collection chamber may be covered by the cleaning device. For example, in some embodiments, the dirt collection chamber may be covered by the connector used to connect the cleaning head to the cleaning device. In some embodiments, the dirt collection chamber may be formed at least in part by an air filter. In such embodiments, the air filter portion is covered by the connector when the cleaning head is attached to the cleaning device, and suction is applied to the air filter.

In some embodiments, the cleaning head is arranged to be disposable. For example, the cleaning head may include a support that is made of a thermoformed plastic or a cardboard pulp. In some embodiments, the cleaning heads are stackable. In some embodiments, the dirt collection chambers are arranged to be collapsible. For example, the dirt collection receptacle may include a bag.

Certain exemplary implementations have been described to provide an overall understanding of the principles of the structure, function, manufacture, and use of the systems, devices, and methods disclosed herein. One or more examples of these implementations have been illustrated in the accompanying drawings. Those skilled in the art will understand that the systems, devices, and methods specifically described herein and illustrated in the accompanying drawings are non-limiting exemplary implementations and that the scope of the present invention is defined solely by the claims. The features illustrated or described in connection with one exemplary implementation may be combined with the features of other implementations. Such modifications and variations are intended to be included within the scope of the present invention. Further, in the present disclosure, like-named components of the implementations generally have similar features, and thus within a particular implementation each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described implementations. Accordingly, the present application is not to be limited by what has been particularly shown and described, except as indicated by the appended claims. All publications and references cited herein are expressly incorporated by reference in their entirety.

What is claimed is:

1. A cleaning head for use with a cleaning device, comprising:

a support structure having a front edge;

a foldable portion coupled to the support structure at least partially along the front edge wherein the front edge of the support structure forms a living hinge with the foldable portion;

a receptacle connected to the foldable portion and defining a chamber therein;

a suction inlet arranged within the foldable portion for allowing debris to flow into the chamber;

a cleaning pad positioned underneath the support structure; and an attachment tab extending from a rear edge of the cleaning pad.

2. The cleaning head of claim 1, wherein the receptacle is partially formed from an air permeable filter configured to allow a suction force to be applied therethrough and through the suction inlet while retaining debris within the chamber.

3. The cleaning head of claim 1, wherein a valve is arranged within the receptacle and is movable relative to the suction inlet in response to a suction force applied to the chamber, the valve arranged to allow debris to enter the chamber while limiting debris from exiting the chamber.

4. The cleaning head of claim 1, wherein the foldable portion is configured to move from a first position substantially parallel to the cleaning pad, to a second position substantially perpendicular to the cleaning pad.

5. The cleaning head of claim 1, wherein the foldable portion includes apertures formed in opposed sides of the suction inlet.

6. The cleaning head of claim 1, wherein the attachment tab includes an aperture formed therethrough.

7. The cleaning head of claim 1, wherein the attachment tab is configured to move from a first position substantially parallel to the cleaning pad, to a second position substantially perpendicular to the cleaning pad.

8. The cleaning head of claim 1, wherein a total area of the support structure is less than a total area of the cleaning pad.

9. The cleaning head of claim 1, wherein the receptacle is configured to expand when a suction force is applied to the chamber.

10. A cleaning device assembly, comprising:

a body having a proximal end and a distal end;

a vacuum source positioned within the body;

a handle coupled to the proximal end of the body;

a connector housing coupled to the distal end of the body, the connector housing having a cavity formed in a bottom surface of the connector housing, and a pin extending from a rear wall of the connector housing; and a cleaning head configured to removably attach to the connector housing, the cleaning head comprising:

a support structure including a front edge;

a foldable portion coupled to the support structure at least partially along the front edge, the foldable portion configured to extend into the cavity;

a receptacle connected to the foldable portion and defining a chamber;

a suction inlet arranged within the foldable portion for allowing debris to flow into the chamber;

a cleaning pad positioned underneath the support structure; and an attachment tab extending from a rear edge of the cleaning pad and configured to connect with the pin of the connector housing.

11. The cleaning device of claim 10, wherein the pin is configured to extend through an aperture formed in the attachment tab.

12. The cleaning device of claim 11, wherein the pin is configured to retract within the connector housing to remove the pin from the aperture on the attachment tab.

13. The cleaning device of claim 10, wherein the foldable portion includes apertures arranged on opposed sides of the suction inlet, and wherein each said aperture is configured to align with a protrusion formed in the receptacle to connect the cleaning head to the connector housing.

14. The cleaning device of claim 10, wherein the connector housing includes a moveable bracket configured to clamp the foldable portion between an internal wall of the cavity and the bracket.

15. The cleaning device of claim 14, wherein the bracket is configured to move away from the internal wall to release the foldable portion from the connector housing.

16. The cleaning device of claim 10, wherein the foldable portion and the support structure are configured to contact a gasket arranged within the bottom surface of the connector housing.

17. The cleaning device of claim 10, wherein the receptacle is configured to expand within the cavity when a suction force is applied to the chamber.

18. The cleaning device of claim 10, wherein the bottom surface of the connector housing is configured to contact the cleaning pad when the cleaning head is connected to the connector housing.

19. A cleaning head for use with a cleaning device, comprising:

a support structure having a front edge;

a foldable portion coupled to the support structure at least partially along the front edge;

a receptacle connected to the foldable portion and defining a chamber therein;

a suction inlet arranged within the foldable portion for allowing debris to flow into the chamber, wherein the receptacle is partially formed from an air permeable filter configured to allow a suction force to be applied therethrough and through the suction inlet while retaining debris within the chamber;

a cleaning pad positioned underneath the support structure; and an attachment tab extending form a rear edge of the cleaning pad.

* * * * *